US009147515B2

(12) United States Patent
Li et al.

(10) Patent No.: US 9,147,515 B2
(45) Date of Patent: Sep. 29, 2015

(54) METHOD FOR MAKING MAGNETIC COMPONENTS WITH M-PHASE COUPLING, AND RELATED INDUCTOR STRUCTURES

(71) Applicant: Volterra Semiconductor Corporation, San Jose, CA (US)

(72) Inventors: Jieli Li, Fremont, CA (US); Charles R. Sullivan, West Lebanon, NH (US); Angel Gentchev, Fremont, CA (US)

(73) Assignee: Volterra Semiconductor LLC, San Jose, CA (US)

( * ) Notice: Subject to any disclaimer, the term of this patent is extended or adjusted under 35 U.S.C. 154(b) by 0 days.

(21) Appl. No.: 14/276,497

(22) Filed: May 13, 2014

(65) Prior Publication Data

US 2014/0247104 A1 Sep. 4, 2014

Related U.S. Application Data

(60) Division of application No. 13/792,084, filed on Mar. 10, 2013, now Pat. No. 8,779,885, which is a continuation of application No. 13/662,821, filed on Oct. 29, 2012, now Pat. No. 9,019,064, which is a (Continued)

(51) Int. Cl.

| | |
|---|---|
| ***H01F 27/00*** | (2006.01) |
| ***H01F 5/00*** | (2006.01) |
| ***H01F 17/00*** | (2006.01) |
| ***H01F 17/06*** | (2006.01) |
| ***H01F 30/12*** | (2006.01) |

(Continued)

(52) U.S. Cl.

CPC ..... *H01F 27/006* (2013.01); *H01F 5/00* (2013.01); *H01F 17/0006* (2013.01); *H01F 17/06* (2013.01); *H01F 27/24* (2013.01); *H01F 30/12* (2013.01); *H01F 3/10* (2013.01); *H01F 2017/067* (2013.01)

(58) Field of Classification Search

CPC ..... H01F 5/00; H01F 27/00–27/30
USPC ..... 336/200, 232, 212
See application file for complete search history.

(56) References Cited

U.S. PATENT DOCUMENTS

| | | | |
|---|---|---|---|
| 2,170,446 | A | 8/1939 | Edwards |
| 2,212,543 | A | 8/1940 | Jovy |

(Continued)

FOREIGN PATENT DOCUMENTS

| | | |
|---|---|---|
| DE | 922 423 | 1/1955 |
| DE | 26 53 568 | 6/1978 |

(Continued)

OTHER PUBLICATIONS

PCT/US11/59193, International Search Report and Written Opinion of Mar. 27, 2012, 9 pages.

(Continued)

*Primary Examiner* — Tuyen Nguyen
(74) *Attorney, Agent, or Firm* — Lathrop & Gage LLP

(57) ABSTRACT

An M phase coupled inductor includes a magnetic core including a first end magnetic element, a second end magnetic element, and M legs disposed between and connecting the first and second end magnetic elements. M is an integer greater than one. The coupled inductor further includes M windings, where each winding has a substantially rectangular cross section. Each one of the M windings is at least partially wound about a respective leg.

8 Claims, 36 Drawing Sheets

Related U.S. Application Data continuation of application No. 13/107,784, filed on May 13, 2011, now Pat. No. 8,299,885, which is a continuation-in-part of application No. 12/271,497, filed on Nov. 14, 2008, now Pat. No. 7,965,165, which is a continuation-in-part of application No. 11/929,827, filed on Oct. 30, 2007, now Pat. No. 7,498,920, which is a continuation-in-part of application No. 11/852,207, filed on Sep. 7, 2007, now abandoned, which is a division of application No. 10/318,896, filed on Dec. 13, 2002, now Pat. No. 7,352,269, said application No. 12/271,497 is a continuation of application No. PCT/US2008/081886, filed on Oct. 30, 2008, which is a continuation-in-part of application No. 11/929,827, filed on Oct. 30, 2007, now Pat. No. 7,498,920.

(60) Provisional application No. 61/036,836, filed on Mar. 14, 2008.

(51) Int. Cl.
*H01F 27/24* (2006.01)
*H01F 3/10* (2006.01)

(56) References Cited

U.S. PATENT DOCUMENTS

| | | | |
|---|---|---|---|
| 2,298,935 | A | 10/1942 | Freeman |
| 2,403,393 | A | 7/1946 | Peterson |
| 3,201,731 | A | 8/1965 | Baenziger et al. |
| 3,447,068 | A | 5/1969 | Hart |
| 3,671,847 | A | 6/1972 | Shibano |
| 3,878,495 | A | 4/1975 | Thomas |
| 3,988,665 | A | 10/1976 | Neumaier et al. |
| 4,223,360 | A | 9/1980 | Sansom et al. |
| 4,249,229 | A | 2/1981 | Hester |
| 4,455,545 | A | 6/1984 | Shelly |
| 4,488,136 | A | 12/1984 | Hansen et al. |
| 4,531,085 | A | 7/1985 | Mesenhimer |
| 4,636,752 | A | 1/1987 | Saito |
| 4,777,406 | A | 10/1988 | Ross et al. |
| 4,800,479 | A | 1/1989 | Bupp |
| 4,975,671 | A | 12/1990 | Dirks |
| 5,003,277 | A | 3/1991 | Sokai et al. |
| 5,103,201 | A | 4/1992 | Schmeller |
| 5,123,989 | A | 6/1992 | Horiishi et al. |
| 5,161,098 | A | 11/1992 | Balakrishnan |
| 5,177,460 | A | 1/1993 | Dhyanchand et al. |
| 5,182,535 | A | 1/1993 | Dhyanchand |
| 5,204,809 | A | 4/1993 | Andresen |
| 5,225,971 | A | 7/1993 | Spreen |
| 5,353,001 | A | 10/1994 | Meinel et al. |
| 5,436,818 | A | 7/1995 | Barthold |
| 5,469,334 | A | 11/1995 | Balakrishnan |
| 5,525,951 | A | 6/1996 | Sunano et al. |
| 5,565,837 | A | 10/1996 | Godek et al. |
| 5,568,111 | A | 10/1996 | Metsler |
| 5,574,420 | A | 11/1996 | Roy et al. |
| 5,594,402 | A | 1/1997 | Kritchafovitch et al. |
| 5,631,822 | A | 5/1997 | Siberkleit et al. |
| 5,737,203 | A | 4/1998 | Barrett |
| 5,764,500 | A | 6/1998 | Matos |
| 5,908,069 | A | 6/1999 | Baldwin et al. |
| 5,939,966 | A | 8/1999 | Shin' Ei |
| 6,018,468 | A | 1/2000 | Archer et al. |
| 6,060,977 | A | 5/2000 | Yamamoto et al. |
| 6,114,932 | A | 9/2000 | Wester et al. |
| 6,147,584 | A | 11/2000 | Shin'el |
| 6,198,375 | B1 | 3/2001 | Shafer |
| 6,204,744 | B1 | 3/2001 | Shafer et al. |
| 6,259,345 | B1 | 7/2001 | De Graaf et al. |
| 6,304,460 | B1 | 10/2001 | Cuk |
| 6,342,778 | B1 | 1/2002 | Catalano et al. |
| 6,348,848 | B1 | 2/2002 | Herbert |
| 6,356,179 | B1 | 3/2002 | Yamada |
| 6,362,986 | B1 | 3/2002 | Schultz et al. |
| 6,377,155 | B1 | 4/2002 | Allen et al. |
| 6,420,953 | B1 | 7/2002 | Dadafshar |
| 6,449,829 | B1 | 9/2002 | Shafer |
| 6,460,244 | B1 | 10/2002 | Shafer et al. |
| 6,477,414 | B1 | 11/2002 | Silvian |
| 6,549,111 | B1 | 4/2003 | De Graaf et al. |
| 6,578,253 | B1 | 6/2003 | Herbert |
| 6,714,428 | B2 | 3/2004 | Huang et al. |
| 6,737,951 | B1 | 5/2004 | Decristofaro et al. |
| 6,765,468 | B2 | 7/2004 | Chen et al. |
| 6,784,644 | B2 | 8/2004 | Xu et al. |
| 6,856,230 | B2 | 2/2005 | Lu |
| 6,867,678 | B2 | 3/2005 | Yang |
| 6,885,274 | B2 | 4/2005 | Hsu et al. |
| 6,903,648 | B2 | 6/2005 | Baumann et al. |
| 7,034,645 | B2 | 4/2006 | Shafer et al. |
| 7,187,263 | B2 | 3/2007 | Vinciarelli |
| 7,199,695 | B1 | 4/2007 | Zhou et al. |
| 7,233,132 | B1 | 6/2007 | Dong et al. |
| 7,239,530 | B1 | 7/2007 | Djekic et al. |
| 7,248,139 | B1 | 7/2007 | Podlisk |
| 7,259,648 | B2 | 8/2007 | Matsutani et al. |
| 7,280,025 | B2 | 10/2007 | Sano |
| 7,310,039 | B1 | 12/2007 | Zhang |
| 7,315,463 | B2 | 1/2008 | Schrom et al. |
| 7,317,305 | B1 | 1/2008 | Stratakos et al. |
| 7,352,269 | B2 | 4/2008 | Li et al. |
| 7,425,883 | B2 | 9/2008 | Matsutani et al. |
| 7,498,920 | B2 | 3/2009 | Sullivan et al. |
| 7,525,406 | B1 | 4/2009 | Cheng |
| 7,525,408 | B1 | 4/2009 | Li et al. |
| 7,548,046 | B1 | 6/2009 | Stratakos et al. |
| 7,567,163 | B2 | 7/2009 | Dadafshar et al. |
| 7,649,434 | B2 | 1/2010 | Xu et al. |
| 7,755,463 | B2 | 7/2010 | Hopper et al. |
| 7,880,577 | B1 | 2/2011 | Glaser et al. |
| 7,994,888 | B2 | 8/2011 | Ikriannikov |
| 2001/0043135 | A1 | 11/2001 | Yamada et al. |
| 2002/0067234 | A1 | 6/2002 | Kung |
| 2002/0093413 | A1 | 7/2002 | Shin'ei |
| 2004/0017276 | A1 | 1/2004 | Chen |
| 2004/0085173 | A1 | 5/2004 | Decristofaro et al. |
| 2004/0125627 | A1 | 7/2004 | Nadd et al. |
| 2004/0160298 | A1 | 8/2004 | Hsu et al. |
| 2005/0024179 | A1 | 2/2005 | Chandrasekaran et al. |
| 2006/0049907 | A1 | 3/2006 | Liu |
| 2006/0145800 | A1 | 7/2006 | Dadafshar et al. |
| 2006/0158297 | A1 | 7/2006 | Sutardja |
| 2006/0197510 | A1 | 9/2006 | Chandrasekaran |
| 2007/0175701 | A1 | 8/2007 | Xu et al. |
| 2007/0176726 | A1 | 8/2007 | Xu et al. |
| 2008/0012674 | A1 | 1/2008 | Sano et al. |
| 2008/0136576 | A1 | 6/2008 | Emmons et al. |
| 2008/0150666 | A1 | 6/2008 | Chandrasekaran et al. |
| 2008/0205098 | A1 | 8/2008 | Xu et al. |
| 2008/0303624 | A1 | 12/2008 | Yamada et al. |
| 2009/0231081 | A1 | 9/2009 | Ikriannikov et al. |
| 2009/0237197 | A1 | 9/2009 | Ikriannikov et al. |
| 2010/0007457 | A1 | 1/2010 | Yan et al. |
| 2010/0013587 | A1 | 1/2010 | Yan et al. |
| 2010/0271161 | A1 | 10/2010 | Yan et al. |
| 2011/0018669 | A1 | 1/2011 | Ikriannikov |
| 2011/0032068 | A1 | 2/2011 | Ikriannikov |
| 2011/0035607 | A1 | 2/2011 | Ikriannikov |
| 2012/0056704 | A1 | 3/2012 | Nagano et al. |

FOREIGN PATENT DOCUMENTS

| | | |
|---|---|---|
| DE | 3123006 | 1/1983 |
| DE | 37 03 561 | 8/1988 |
| DE | 101 05 087 | 8/2001 |
| DE | 10 2006 034553 | 6/2007 |
| EP | 0 012 629 | 6/1980 |
| EP | 0 142 207 | 5/1985 |
| EP | 0 225 830 | 6/1987 |
| EP | 0 577 334 | 1/1994 |

(56) References Cited

FOREIGN PATENT DOCUMENTS

| | | |
|---|---|---|
| EP | 1 519 392 | 3/2005 |
| EP | 1 519 473 | 3/2005 |
| EP | 1 835 604 | 9/2007 |
| JP | 60 015908 | 1/1985 |
| JP | 08-250332 | 9/1996 |
| JP | 11 144983 | 5/1999 |
| JP | 11 307369 | 11/1999 |
| JP | 2000-164431 | 6/2000 |
| JP | 2002057049 | 2/2002 |
| JP | 20100050160 | 3/2010 |
| WO | WO 2006/026674 | 3/2006 |
| WO | WO 2006/109329 | 10/2006 |

OTHER PUBLICATIONS

U.S. Appl. No. 12/987,944, Response to Office Action filed Sep. 23, 2011, 13 pages.
U.S. Appl. No. 12/987,944, Final Rejection issued Feb. 3, 2012, 8 pages.
U.S. Appl. No. 12/987,944, Response to Office Action filed Apr. 3, 2012, 8 pages.
U.S. Appl. No. 12/987,944, Advisory Action issued Apr. 11, 2012, 3 pages.
U.S. Appl. No. 12/987,944, Pre-Appeal Brief Request for Review filed May 3, 2012, 6 pages.
S. Chandrasekaran et al., "Integrated Magnetics for Interleaved DC-DC Boost for Fuel Cell Powered Vehicles," 35th Annual IEEE Power Electronics Specialists Conferences, 356-61 (2004).
Pulse, Product News Press Release, dated Nov. 25, 2008, 1 page.
U.S. Appl. No. 11/852,216, Restriction Requirement mailed Aug. 5, 2010, 6 pages.
U.S. Appl. No. 11/852,216, Response to Restriction Requirement filed Sep. 3, 2010, 3 pages.
U.S. Appl. No. 11/852,216, Notice of Allowance mailed Oct. 7, 2010, 7 pages.
U.S. Appl. No. 11/852,216, Issue Fee Payment filed Oct. 13, 2010, 2 pages.
U.S. Appl. No. 11/852,231, Notice of Allowance mailed Mar. 26, 2010, 6 pages.
U.S. Appl. No. 11/852,231, Issue Fee Payment filed Jun. 28, 2010, 1 page.
U.S. Appl. No. 12/271,497, Restriction Requirement mailed Jun. 11, 2009, 7 pages.
U.S. Appl. No. 12/271,497, Response to Restriction Requirement filed Aug. 11, 2009, 4 pages.
U.S. Appl. No. 12/271,497, Office Action mailed Dec. 14, 2009, 7 pages.
U.S. Appl. No. 12/271,497, Response to Office Action filed Mar. 12, 2010, 11 pages.
U.S. Appl. No. 12/271,497, Office Action mailed Jun. 25, 2010, 7 pages.
U.S. Appl. No. 12/271,497, Notice of Appeal and Pre-Appeal Brief Conference Request filed Oct. 25, 2010, 7 pages.
U.S. Appl. No. 12/271,497, Notice of Allowance mailed Mar. 9, 2011, 5 pages.
U.S. Appl. No. 12/271,497, Issue Fee Payment filed May 13, 2011, 1 page.
U.S. Appl. No. 12/344,163, Office Action mailed Mar. 22, 2010, 6 pages.
U.S. Appl. No. 12/344,163, Response to Office Action filed Sep. 22, 2010, 9 pages.
U.S. Appl. No. 12/344,163, Notice of Allowance mailed Oct. 18, 2010, 4 pages.
U.S. Appl. No. 12/344,163, Issue Fee Payment filed Jan. 18, 2011, 2 pages.
U.S. Appl. No. 12/392,602, Office Action mailed Apr. 5, 2010, 8 pages.
U.S. Appl. No. 12/392,602, Response to Office Action filed Oct. 5, 2010, 15 pages.
U.S. Appl. No. 12/392,602, Notice of Allowance mailed Oct. 18, 2010, 4 pages.
U.S. Appl. No. 12/392,602, Issue Fee Payment filed Jan. 18, 2011, 2 pages.
U.S. Appl. No. 12/987,944, Office Action Mailed Apr. 6, 2011, 7 pages.
Dong et al., Twisted Core Coupled Inductors for Microprocessor Voltage Regulators, Power Electronics Specialists Conference, pp. 2386-2392, Jun. 17-21, 2007.
Dong et al., The Short Winding Path Coupled Inductor Voltage Regulators, Applied Power Electronics Conference and Exposition, pp. 1446-1452, Feb. 24-28, 2008.
Dong et al., Evaluation of Coupled Inductor Voltage Regulators, Applied Power Electronics Conference and Exposition, pp. 831-837, Feb. 24-28, 2008.
Vishay, Low Profile, High Current IHLP Inductor, 3 pages, Jan. 21, 2009.
Panasonic, Power Choke Coil, 2 pages, Jan. 2008.
Cooper Bussmann, "Product Data Sheet for Low Profile Inductor (Surface Mount)" retreived from http://www.angliac.com, May 2003.
Papers received from Santangelo Law Office dated Dec. 22, 2006 and May 30, 2007.
Pulse, SMT Power Inductors datasheet, 2 pages, Nov. 2007.
Pulse, SMT Power Inductors Power Beads—PA0766NL Series; pp. 53-55; Mar. 2006.
Vitec, Dual High Frequency High Power Inductor, AF4390A data sheet; date unknown.
Wong, Pit-Leong, et al., "Investigating Coupling Inductors in the Interleaving QSW VRM" Applied Power Electronics Conference and Exposition, 2000. APEC 2000. Fifteenth Annual IEEE; Mar. 2000; pp. 973-978.
Wong, Pit-Leong, et al.; A Novel Modeling Concept for Multi-coupling Core Structures; Center for Power Electronics Systems; IEEE.
Wong, Pit-Leong, et al.; Performance Improvements of Interleaving VRMs With Coupling Inductors, IEEE Transactions on Power Electronics; vol. 16, No. 4; pp. 499-507; Jul. 2001.
Xu, J., et al; Analysis by Finite Element Method of a Coupled Inductor Circuit Used as Current Injection Interface; IEEE; pp. 147-151; 1996.
U.S. Appl. No. 11/929,827, Restriction Requirement mailed Aug. 18, 2008, 7 pages.
U.S. Appl. No. 11/929,827, Response to Restriction Requirement filed Sep. 4, 2008, 3 pages.
U.S. Appl. No. 11/929,827, Notice of Allowance mailed Oct. 21, 2008, 7 pages.
U.S. Appl. No. 11/929,827, Issue Fee Payment and Comments on Statement of Reasons for Allowance, Jan. 21, 2009, 2 pages.
U.S. Appl. No. 11/852,207, Restriction Requirement mailed Feb. 26, 2008, 7 pages.
U.S. Appl. No. 11/852,207, Response to Restriction Requirement filed Mar. 26, 2008, 3 pages.
U.S. Appl. No. 11/852,207, Office Action mailed Jun. 20, 2008, 7 pages.
U.S. Appl. No. 11/852,207, Notice of Abandonment mailed Dec. 23, 2008, 2 pages.
U.S. Appl. No. 10/318,896, Issue Fee Payment, Jan. 4, 2008, 1 page.
U.S. Appl. No. 10/318,896, Supplemental Notice of Allowance, Dec. 13, 2007, 2 pages.
U.S. Appl. No. 10/318,896; Notice of Allowance, Oct. 4, 2007, 4 pages.
U.S. Appl. No. 10/318,896, Sixth Request for Acknowledgement of an Information Disclosure Statement, Jan. 4, 2008, 6 pages.
U.S. Appl. No. 10/318,896; Statement of the Substance of Interview, Sep. 27, 2007, 2 pages.
U.S. Appl. No. 10/318,896, Supplemental Amendment filed Sep. 14, 2007, 12 pages.
U.S. Appl. No. 10/318,896, Response to Office Action mailed Jan. 18, 2007 and RCE; filed Jul. 18, 2007, 46 pages.
U.S. Appl. No. 10/318,896, Statement of the Substance of Interview; filed Apr. 23, 2007, 2 pages.
U.S. Appl. No. 10/318,896, Office Action mailed Jan. 18, 2007, 8 pages.

(56) References Cited

OTHER PUBLICATIONS

U.S. Appl. No. 10/318,896, Petition to Review Restriction Requirement, filed Aug. 24, 2006, 89 pages.
U.S. Appl. No. 10/318,896, Response to Office Action mailed Jun. 30, 2006; filed Oct. 25, 2006, 26 pages.
U.S. Appl. No. 10/318,896, Office Action mailed Jun. 30, 2006, 6 pages.
U.S. Appl. No. 10/318,896, Response to Office Action mailed Dec. 2, 2005; filed Mar. 24, 2006, 23 pages.
U.S Appl. No. 10/318,896, Office Action mailed Dec. 2, 2005, 7 pages.
U.S. Appl. No. 10/318,896, Response to Office Action mailed Jun. 14, 2005; filed Sep. 14, 2005, 30 pages.
U.S. Appl. No. 10/318,896, Office Action mailed Jun. 14, 2005, 9 pages.
U.S. Appl. No. 10/318,896, Response to Office Action mailed Jun. 15, 2004; filed Aug. 16, 2004; 13 pages.
U.S. Appl. No. 10/318,896, Office Action mailed Jun. 15, 2004, 6 pages.
U.S. Appl. No. 10/318,896, Response to Office Action mailed Dec. 6, 2004; filed Feb. 7, 2005, 12 pages.
U.S. Appl. No. 10/318,896, Office Action mailed Dec. 6, 2004, 5 pages.
U.S. Appl. No. 11/852,231, Response to Restriction Requirement, filed Jan. 9, 2009; 3 pages.
U.S. Appl. No. 11/852,231, Restriction Requirement mailed Dec. 11, 2008; 8 pages.
U.S. Appl. No. 11/852,231, Response to Restriction Requirement, filed Sep. 2, 2008, 3 pages.
U.S. Appl. No. 11/852,231, Applicant Interview Summary, Aug. 29, 2008, 2 pages.
U.S. Appl. No. 11/852,231, Examiner Interview Summary mailed Aug. 6, 2008, 2 pages.
U.S. Appl. No. 11/852,231, Restriction Requirement mailed Feb. 26, 2008, 7 pages.
U.S. Appl. No. 11/852,231, Response to Restriction Requirement filed Mar. 26, 2008, 3 pages.
U.S. Appl. No. 11/852,231, Notice of Noncompliant Amendment mailed Jul. 2, 2008, 3 pages.
U.S. Appl. No. 11/852,216, Response to Restriction Requirement filed Jan. 22, 2009, 3 pages.
U.S. Appl. No. 11/852,216, Restriction Requirement mailed Dec. 22, 2008, 7 pages.
U.S. Appl. No. 11/852,216, Response to Restriction Requirement filed Mar. 26, 2008, 3 pages.
U.S. Appl. No. 11/852,216, Restriction Requirement mailed Feb. 26, 2008, 7 pages.
U.S. Appl. No. 11/852,216, Notice of Noncompliant Amendment mailed Jul. 7, 2008, 3 pages.
U.S. Appl. No. 11/852,216, Response to Restriction Requirement filed Sep. 4, 2008, 3 pages.
U.S. Appl. No. 11/852,226, Issue Fee Payment and Comments on Statement of Reasons for Allowance, Mar. 18, 2009, 2 pages.
U.S. Appl. No. 11/852,226, Notice of Allowance mailed Dec. 18, 2008, 8 pages.
U.S. Appl. No. 11/852,226, Response to Restriction Requirement filed Mar. 26, 2008, 7 pages.
U.S. Appl. No. 11/852,226, Restriction Requirement mailed Feb. 25, 2008, 7 pages.
U.S. Appl. No. 11/852,216 Notice Regarding Noncompliant Response mailed May 14, 2009, 3 pages.
U.S. Appl. No. 11/852,231 Notice Regarding Noncompliant Response mailed Apr. 29, 2009, 3 pages.
PCT/US08/81886 International Search Report and Written Opinion mailed Jun. 23, 2009, 21 pages.
PCT/US09/37320 International Search Report and Written Opinion mailed Jun. 30, 2009, 19 pages.
U.S. Appl. No. 12/202,929, Requirement for Election/Restriction mailed Jun. 11, 2009, 3 pages.
U.S. Appl. No. 12/202,929, Response to Requirement for Election/Restriction filed Jul. 10, 2009, 7 pages.
U.S. Appl. No. 11/852,231, Response to Restriction Requirement, filed Jun. 30, 2009; 7 pages.
U.S. Appl. No. 11/852,216, Response to Restriction Requirement and Interview Summary filed Jul. 14, 2009, 4 pages.
U.S. Appl. No. 11/852,231, Office Action mailed Oct. 6, 2009, 7 pages.
U.S. Appl. No. 11/852,216, Response to Restriction Requirement filed Nov. 17, 2009, 3 pages.
U.S. Appl. No. 11/852,216, Restriction Requirement mailed Oct. 19, 2009, 7 pages.
U.S. Appl. No. 11/852,231, Response to Office Action filed Jan. 28, 2010, 17 pages.
U.S. Appl. No. 12/202,929, Notice of Allowance mailed Dec. 24, 2009, 8 pages.
U.S. Appl. No. 12/202,929, Issue Fee payment, Request for Acknowledgement of an IDS and Comments on Statement of Reasons for Allowance filed Feb. 11, 2010, 8 pages.
U.S. Appl. No. 12/344,163, Restriction Requirement mailed Dec. 11, 2009, 6 pages.
U.S. Appl. No. 12/344,163, Response to Restriction Requirement filed Jan. 11, 2010, 4 pages.
U.S. Appl. No. 12/392,602, Response to Restriction Requirement filed Jan. 11, 2010, 4 pages.
U.S. Appl. No. 12/392,602, Restriction Requirement mailed Dec. 11, 2009, 6 pages.
U.S. Appl. No. 13/107,784, Non-Final Rejection, issued Feb. 17, 2012, 7 pages.
U.S. Appl. No. 13/107,784, Response to Non-Final Rejection, filed May 17, 2012, 11 pages.
U.S. Appl. No. 13/107,784, Notice of Allowance, issued Jun. 29, 2012, 5 pages.
U.S. Appl. No. 13/107,784, Notice of Allowance, issued Jul. 24, 2012, 2 pages.
U.S. Appl. No. 13/107,784, Issue Fee payment, filed Sep. 28, 2012, 1 page.
U.S. Appl. No. 13/792,084, Non-Final Office Action issued Sep. 6, 2013, 5 pages.
U.S. Appl. No. 13/792,084, Response to Non-Final Office Action filed Nov. 20, 2013, 6 pages.
U.S. Appl. No. 13/792,084, Notice of Allowance issued Feb. 11, 2014, 9 pages.

METHOD FOR MAKING MAGNETIC COMPONENTS WITH M-PHASE COUPLING, AND RELATED INDUCTOR STRUCTURES

CROSS-REFERENCE TO RELATED APPLICATIONS

This application is a divisional of copending U.S. patent application Ser. No. 13/792,084, filed 10 Mar. 2013, which is a continuation of copending U.S. patent application Ser. No. 13/662,821, filed 29 Oct. 2012, which is a continuation of U.S. patent application Ser. No. 13/107,784, filed 13 May 2011, now U.S. Pat. No. 8,299,885, which is a continuation-in-part of U.S. patent application Ser. No. 12/271,497, filed 14 Nov. 2008, now U.S. Pat. No. 7,965,165, which is a continuation-in-part of U.S. patent application Ser. No. 11/929,827, filed 30 Oct. 2007, now U.S. Pat. No. 7,498,920, which is a continuation-in-part of U.S. patent application Ser. No. 11/852,207, filed 7 Sep. 2007, which is a divisional of U.S. patent application Ser. No. 10/318,896, filed 13 Dec. 2002, now U.S. Pat. No. 7,352,269. U.S. patent application Ser. No. 12/271,497 is also a continuation of International Patent Application No. PCT/US08/81886, filed 30 Oct. 2008, which claims benefit of priority to U.S. patent application Ser. No. 11/929,827, filed 30 Oct. 2007 and to U.S. Provisional Patent Application Ser. No. 61/036,836 filed 14 Mar. 2008. U.S. patent application Ser. No. 12/271,497 also claims benefit of priority to U.S. Provisional Patent Application Ser. No. 61/036,836, filed 14 Mar. 2008. All of the above-mentioned applications are incorporated herein by reference.

BACKGROUND

A DC-to-DC converter, as known in the art, provides an output voltage that is a step-up, a step-down, or a polarity reversal of the input voltage source. Certain known DC-to-DC converters have parallel power units with inputs coupled to a common DC voltage source and outputs coupled to a load, such as a microprocessor. Multiple power-units can sometimes reduce cost by lowering the power and size rating of components. A further benefit is that multiple power units provide smaller per-power-unit peak current levels, combined with smaller passive components.

The prior art also includes switching techniques in parallel-power-unit DC-to-DC converters. By way of example, power units may be switched with pulse width modulation (PWM) or with pulse frequency modulation (PFM). Typically, in a parallel-unit buck converter, the energizing and de-energizing of the inductance in each power unit occurs out of phase with switches coupled to the input, inductor and ground. Additional performance benefits are provided when the switches of one power unit, coupling the inductors to the DC input voltage or to ground, are out of phase with respect to the switches in another power unit. Such a "multi-phase," parallel power unit technique results in ripple current cancellation at a capacitor, to which all the inductors are coupled at their respective output terminals.

It is clear that smaller inductances are needed in DC-to-DC converters to support the response time required in load transients and without prohibitively costly output capacitance. More particularly, the capacitance requirements for systems with fast loads, and large inductors, may make it impossible to provide adequate capacitance configurations, in part due to the parasitic inductance generated by a large physical layout. But smaller inductors create other issues, such as the higher frequencies used in bounding the AC peak-to-peak current ripple within each power unit. Higher frequencies and smaller inductances enable shrinking of part size and weight. However, higher switching frequencies result in more heat dissipation and lower efficiency. In short, small inductance is good for transient response, but large inductance is good for AC current ripple reduction and efficiency.

The prior art has sought to reduce the current ripple in multiphase switching topologies by coupling inductors. For example, one system set forth in U.S. Pat. No. 5,204,809, incorporated herein by reference, couples two inductors in a dual-phase system driven by an H bridge to help reduce ripple current. In one article, Investigating Coupling Inductors in the Interleaving QSW VRM, IEEE APEC (Wong, February 2000), slight benefit is shown in ripple reduction by coupling two windings using presently available magnetic core shapes. However, the benefit from this method is limited in that it only offers slight reduction in ripple at some duty cycles for limited amounts of coupling.

One known DC-to-DC converter offers improved ripple reduction that either reduces or eliminates the afore-mentioned difficulties. Such a DC-to-DC converter is described in commonly owned U.S. Pat. No. 6,362,986 issued to Schultz et al. ("the '986 patent"), incorporated herein by reference. The '986 patent can improve converter efficiency and reduce the cost of manufacturing DC-to-DC converters.

Specifically, the '986 patent shows one system that reduces the ripple of the inductor current in a two-phase coupled inductor within a DC-to-DC buck converter. The '986 patent also provides a multi-phase transformer model to illustrate the working principles of multi-phase coupled inductors. It is a continuing problem to address scalability and implementation issues of DC-to-DC converters.

As circuit components and, thus, printed circuit boards (PCB), become smaller due to technology advancements, smaller and more scalable DC-to-DC converters are needed to provide for a variety of voltage conversion needs.

SUMMARY

As used herein, a "coupled" inductor implies an interaction between multiple inductors of different phases. Coupled inductors described herein may be used within DC-to-DC converters or within a power converter for power conversion applications, for example.

In an embodiment, an M phase coupled inductor includes a magnetic core including a first end magnetic element, a second end magnetic element, and M legs disposed between and connecting the first and second end magnetic elements. M is an integer greater than one. Each leg has a respective width in a direction connecting the first and second end magnetic elements. The coupled inductor further includes M windings, where each one of the M windings is at least partially wound about a respective leg. Each winding has a substantially rectangular cross section and a respective width that is at least eighty percent of the width of its respective leg.

In an embodiment, an M phase coupled inductor includes a magnetic core including a first end magnetic element, a second end magnetic element, and M legs disposed between and connecting the first and second end magnetic elements. M is an integer greater than one, and each leg has an outer surface. The coupled inductor further includes M windings, where each winding has a substantially rectangular cross section. Each one of the M windings is at least partially wound about a respective leg such that the winding diagonally crosses at least a portion of its leg's outer surface.

In an embodiment, an M phase coupled inductor includes a magnetic core including a first end magnetic element, a second end magnetic element, and M legs disposed between and connecting the first and second end magnetic elements. M is an integer greater than one, and each leg forms at least two turns. The coupled inductor further includes M windings, where each winding has a substantially rectangular cross section. Each one of the M windings is at least partially wound about a respective leg.

In an embodiment, an M phase coupled inductor includes a magnetic core including a first end magnetic element, a second end magnetic element, and M legs disposed between and connecting the first and second end magnetic elements. M is an integer greater than two. The magnetic core further includes M windings, where each winding has a substantially rectangular cross section with an aspect ratio of at least two. Each one of the M windings is at least partially wound about a respective leg.

In an embodiment, a multi-phase DC-to-DC converter includes an M-phase coupled inductor and M switching subsystems. M is an integer greater than two. The coupled inductor includes a magnetic core including a first end magnetic element, a second end magnetic element, and M legs disposed between and connecting the first and second end magnetic elements. The coupled inductor further includes M windings, where each winding has a substantially rectangular cross section, a first end, and a second end. Each one of the M windings is at least partially wound about a respective leg. Each switching subsystem is coupled to the first end of a respective winding, and each switching subsystem switches the first end of its respective winding between two voltages. Each second end is electrically coupled together.

DETAILED DESCRIPTION OF THE EMBODIMENTS

Figure 1:
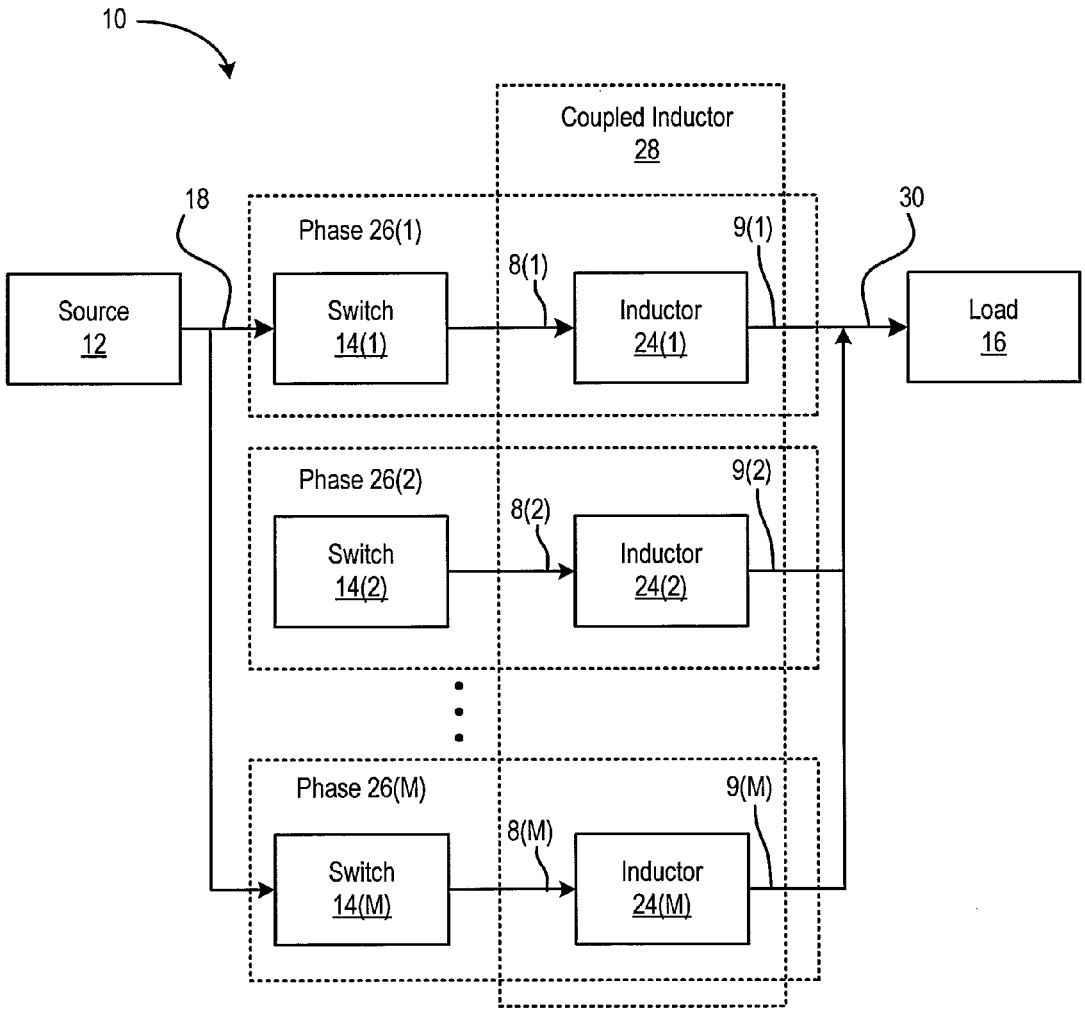
FIG. 1 shows one multi-phase DC-to-DC converter system, according to an embodiment.

It is noted that, for purposes of illustrative clarity, certain elements in the drawings may not be drawn to scale. Specific instances of an item may be referred to by use of a numeral in parentheses (e.g., winding 506(1)) while numerals without parentheses refer to any such item (e.g., windings 506).

Embodiments of methods disclosed herein provide for constructing a magnetic core. Such a core is, for example, useful in applications detailed in the '986 patent. In one embodiment, the method provides for constructing M-phase coupled inductors as both single and scalable magnetic structures, where M is greater than 1. Some embodiments of M-phase inductors described herein may include M-number of windings. One embodiment of a method additionally describes construction of a magnetic core that enhances the benefits of using the scalable M-phase coupled inductor.

In one embodiment, the M-phase coupled inductor is formed by coupling first and second magnetic cores in such a way that a planar surface of the first core is substantially aligned with a planar surface of the second core in a common plane. The first and second magnetic cores may be formed into shapes that, when coupled together, may form a single scalable magnetic core having desirable characteristics, such as ripple current reduction and ease of implementation. In one example, the cores are fashioned into shapes, such as a U-shape, an I-shape (e.g., a bar), an H-shape, a ring-shape, a rectangular-shape, or a comb. In another example, the cores could be fashioned into a printed circuit trace within a PCB.

In some embodiments, certain cores form passageways through which conductive windings are wound when coupled together. Other cores may already form these passageways (e.g., the ring-shaped core and the rectangularly shaped core). For example, two H-shaped magnetic cores may be coupled at the legs of each magnetic core to form a passageway. As another example, a multi-leg core may be formed as a comb-shaped core coupled to an I-shaped core. In yet another example, two I-shaped cores are layered about a PCB such that passageways are formed when the two cores are coupled to one another at two or more places, or when pre-configured holes in the PCB are filled with a ferromagnetic powder.

Advantages of some embodiments of methods and structures disclosed herein include scalable and cost effective DC-to-DC converters that reduce or nearly eliminate ripple current. The methods and structures of some embodiments further techniques that achieve the benefit of various performance characteristics with a single, scalable, topology.

FIG. 1 shows a multi-phase DC-to-DC converter system 10. System 10 includes a power source 12 electrically coupled with M switches 14 and M inductors 24, with M≥2, for supplying power to a load 16. Each switch and inductor pair 14, 24 represent one phase 26 of system 10, as shown. Inductors 24 cooperate together as a coupled inductor 28. Each inductor 24 has, for example, a leakage inductance value ranging from 10 nanohenrys ("nH") to 200 nH; such exemplary leakage inductance values may enable system 10 to advantageously have a relatively low ripple voltage magnitude and an acceptable transient response at a typical switching frequency. Power source 12 may, for example, be either a DC power source, such as a battery, or an AC power source cooperatively coupled to a rectifier, such as a bridge rectifier, to provide DC power in signal 18. Each switch 14 may include a plurality of switches to perform the functions of DC-to-DC converter system 10.

In operation, DC-to-DC converter system 10 converts an input signal 18 from source 12 to an output signal 30. The voltage of signal 30 may be controlled through operation of switches 14, to be equal to or different from signal 18. Specifically, coupled inductor 28 has one or more windings (not shown) that extend through and about inductors 24, as described in detail below. These windings attach to switches 14, which collectively operate to regulate the output voltage of signal 30 by sequentially switching inductors 24 to signal 18.

When M=2, system 10 may for example be used as a two-phase power converter (e.g., power supply). System 10 may also be used in both DC and AC based power supplies to replace a plurality of individual discrete inductors such that coupled inductor 28 reduces inductor ripple current, filter capacitances, and/or PCB footprint sizes, while delivering higher system efficiency and enhanced system reliability. Other functional and operational aspects of DC-to-DC converter system 10 may be exemplarily described in the '986 patent. Some embodiments of coupled inductor 28 are described as follows.

Those skilled in the art should appreciate that system 10 may be arranged with different topologies to provide a coupled inductor 28 and without departing from the scope hereof. For example, in another embodiment of system 10, a first terminal 8 of each inductor 24 is electrically coupled together and directly to source 12. In such embodiment, a respective switch 14 couples second terminal 9 of each inductor 24 to load 16. As another example, although each inductor 24 is illustrated in FIG. 1 as being part of coupled inductor 28, one or more of inductors 24 may be discrete (non-coupled) inductors. Additionally, single coupled inductor 28 illustrated in FIG. 1 may be replaced with a plurality of coupled inductors 28. For example, an embodiment of system 10 having six phases may include a quantity of three two-phase coupled inductors. Furthermore, some embodiments of system 10 include one or more transformers to provide electrical isolation.

Figure 2:
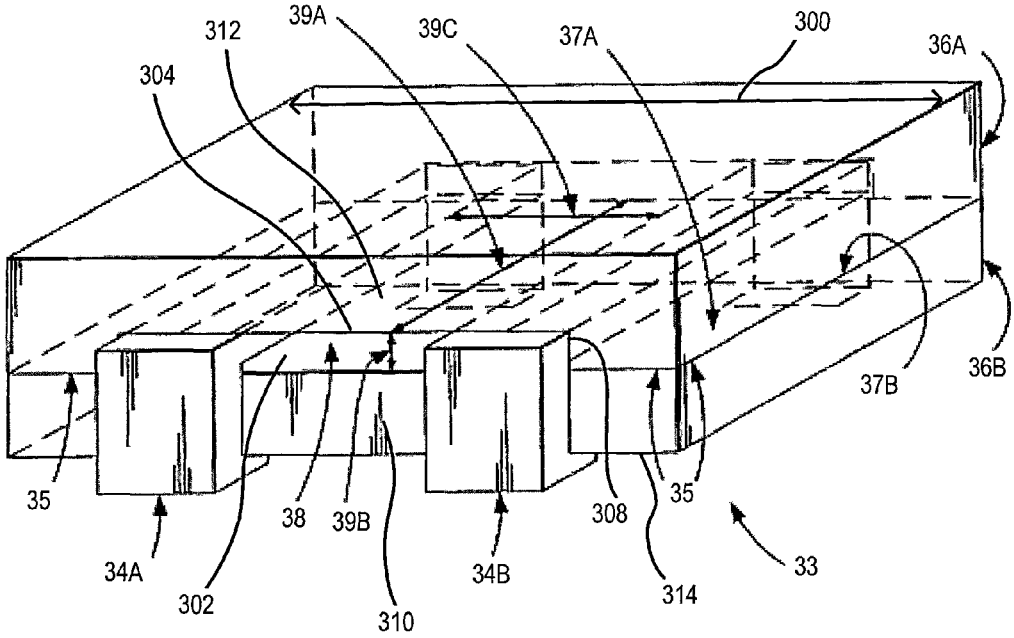
FIG. 2 shows one two-phase coupled inductor.

FIG. 2 shows a two-phase coupled inductor 33, in accord with one embodiment. Inductor 33 may, for example, serve as inductor 28 of FIG. 1, with M=2. The two-phase coupled inductor 33 may include a first magnetic core 36A and a second magnetic core 36B. The first and second magnetic cores 36A, 36B, respectively, are coupled together such that planar surfaces 37A, 37B, respectively, of each core are substantially aligned in a common plane, represented by line 35. When the two magnetic cores 36A and 36B are coupled together, they cooperatively form a single magnetic core for use as a two-phase coupled inductor 33.

In this embodiment, the first magnetic core 36A may be formed from a ferromagnetic material into a U-shape. The second magnetic core 36B may be formed from the same ferromagnetic material into a bar, or I-shape, as shown. As the two magnetic cores 36A, 36B are coupled together, they form a passageway 38 through which windings 34A, 34B are wound. The windings 34A, 34B may be formed of a conductive material, such as copper, that wind through and about the passageway 38 and the magnetic core 36B. Moreover, those skilled in the art should appreciate that windings 34A, 34B may include a same or differing number of turns about the magnetic core 36B. Windings 34A, 34B are shown as single turn windings, to decrease resistance through inductor 33.

The windings 34A and 34B of inductor 33 may be wound in the same or different orientation from one another. The windings 34A and 34B may also be either wound about the single magnetic core in the same number of turns or in a different number of turns. The number of turns and orientation of each winding may be selected so as to support the functionality of the '986 patent, for example. By orienting the windings 34A and 34B in the same direction, the coupling is directed so as to reduce the ripple current flowing in windings 34A, 34B.

Those skilled in the art should appreciate that a gap (not shown) may exist between magnetic cores 36A, 36B, for example to reduce the sensitivity to direct current when inductor 33 is used within a switching power converter. Such a gap is for example illustratively discussed as dimension A, FIG. 5.

The dimensional distance between windings 34A, 34B may also be adjusted to adjust leakage inductance. Such a dimension is illustratively discussed as dimension E, FIG. 5.

As shown, magnetic core 36A is a "U-shaped" core while magnetic core 36B is an unshaped flat plate. Those skilled in the art should also appreciate that coupled inductor 33 may be formed with magnetic cores with different shapes. By way of example, two "L-shaped" or two "U-shaped" cores may be coupled together to provide like overall form as combined cores 36A, 36B, to provide like functionality within a switching power converter. Cores 36A, 36B may be similarly replaced with a solid magnetic core block with a hole therein to form passageway 38. At least part of passageway 38 is free from intervening magnetic structure between windings 34A, 34B; air or non-magnetic structure may for example fill the space of passageway 38 and between the windings 34A, 34B. In one embodiment, intervening magnetic structure fills no more than 50% of a cross-sectional area between windings 34A, 34B, and within passageway 38; by way of example, the cross-sectional area of passageway 38 may be defined by the plane of dimensions 39A (depth), 39B (height), which is perpendicular to a line 39C (separation distance) between windings 34A, 34B.

FIG. 2 also illustrates one advantageous feature associated with windings 34A, 34B. Specifically, each of windings 34A, 34B is shown with a rectangular cross-section that, when folded underneath core 36B, as shown, produces a tab for soldering to a PCB, and without the need for a separate item. Other windings discussed below may have similar beneficial features.

FIG. 2 also shows surfaces 302, 304, 308, and 314, legs or sides 310 and 312, and width 300.

Figure 3:
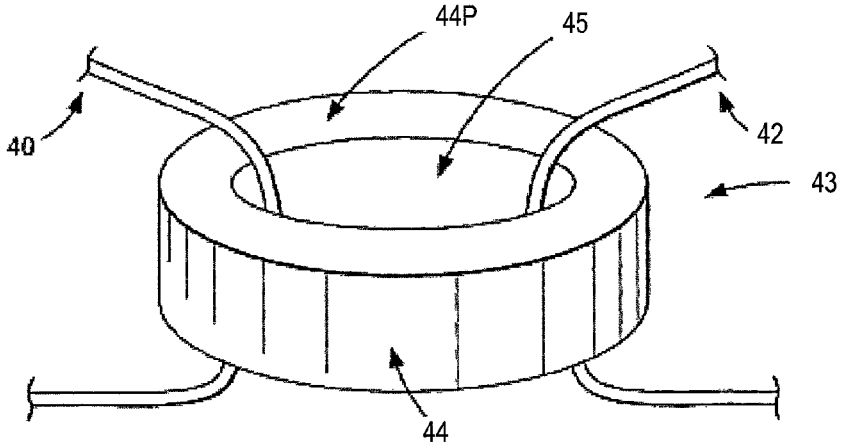
FIG. 3 shows one two-phase coupled ring-core inductor.

FIG. 3 shows a single two-phase ring-core coupled inductor 43, in accord with one embodiment. Inductor 43 may be combined with other embodiments herein, for example, to serve as inductor 28 of FIG. 1. The ring-core inductor 43 is formed from a ring magnetic core 44. The core 44 has a passageway 45; windings 40 and 42 are wound through passageway 45 and about the core 44, as shown. In this embodiment, core 44 is formed as a single magnetic core; however multiple magnetic cores, such as two semi-circles, may be cooperatively combined to form a similar core structure. Other single magnetic core embodiments shown herein may also be formed by cooperatively combining multiple magnetic cores as discussed in FIG. 17. Such a combination may align plane 44P of magnetic core 44 in the same plane of other magnetic cores 44, for example to facilitate mounting to a PCB. At least part of passageway 45 is free from intervening magnetic structure between windings 40, 42; air may for example fill the space of passageway 45 and between windings 40, 42. In one embodiment, intervening magnetic structure fills no more than 50% of a cross-sectional area between windings 40, 42, and within passageway 45.

In one embodiment, windings 40, 42 wind through passageway 45 and around ring magnetic core 44 such that ring magnetic core 44 and windings 40, 42 cooperate with two phase coupling within a switching power converter. Winding 40 is oriented such that DC current in winding 40 flows in a first direction within passageway 45; winding 42 is oriented such that DC current in winding 42 flows in a second direction within passageway 45, where the first direction is opposite to the second direction. Such a configuration avoids DC saturation of core 44, and effectively reduces ripple current. See U.S. Pat. No. 6,362,986.

Figure 4:
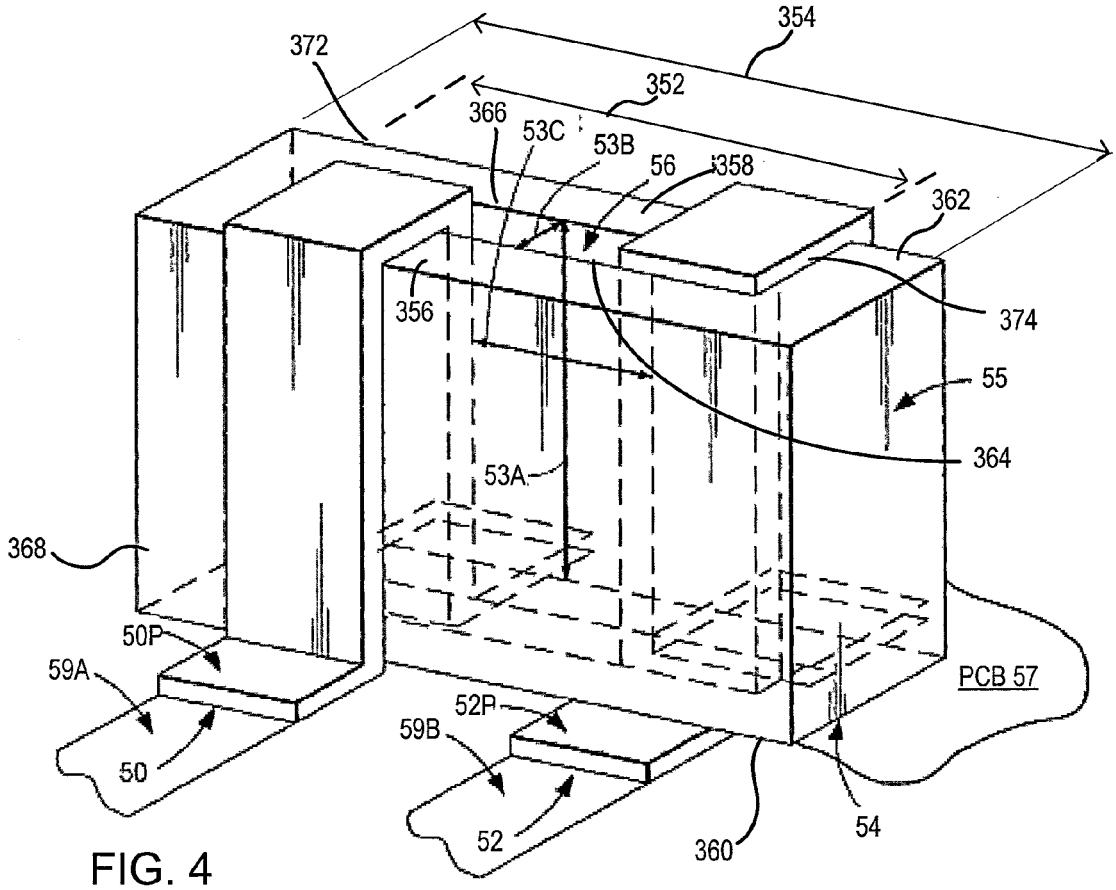
FIG. 4 shows one vertically mounted two-phase coupled inductor.

FIG. 4 shows a vertically mounted two-phase coupled inductor 54, in accord with one embodiment. Inductor 54 may be combined and/or formed with other embodiments herein, for example, to serve as inductor 28 of FIG. 1. The inductor 54 is formed as a rectangular-shaped magnetic core 55. The core 55 forms a passageway 56; windings 50 and 52 may be wound through passageway 56 and about the core 55. In this embodiment, the inductor 54 may be vertically mounted on a plane of PCB 57 (e.g., one end of passageway 56 faces the plane of the PCB 57) so as to minimize a "footprint", or real estate, occupied by the inductor 54 on the PCB 57. This embodiment may improve board layout convenience. Windings 50 and 52 may connect to printed traces 59A, 59B on the PCB 57 for receiving current. Additionally, windings 50 and 52 may be used to mount inductor 54 to the PCB 57, such as by flat portions 50P, 52P of respective windings 50, 52. Specifically, portions 50P, 52P may be soldered underneath to PCB 57. At least part of passageway 56 is free from intervening magnetic structure between windings 50, 52; air may for example fill the space of passageway 56 and between windings 50, 52. In one embodiment, intervening magnetic structure fills no more than 50% of a cross-sectional area between windings 50, 52, and within passageway 56; by way of example, the cross-sectional area of passageway 56 may be defined by the plane of dimensions 53A (height), 53B (depth), which is perpendicular to a line 53C (separation distance) between windings 50, 52. Also shown in FIG. 4 are widths 352 and 354, legs 356 and 358, surfaces 360, 362, 364, 366, 368, 372, and 374.

FIG. 4 further has advantages in that one winding 50 winds around one side of core 55, while winding 52 winds around another side of core 55, as shown. Such a configuration thus provides for input on one side of inductor 54 and output on the other side with convenient mating to a board layout of PCB 57.

Figure 5:
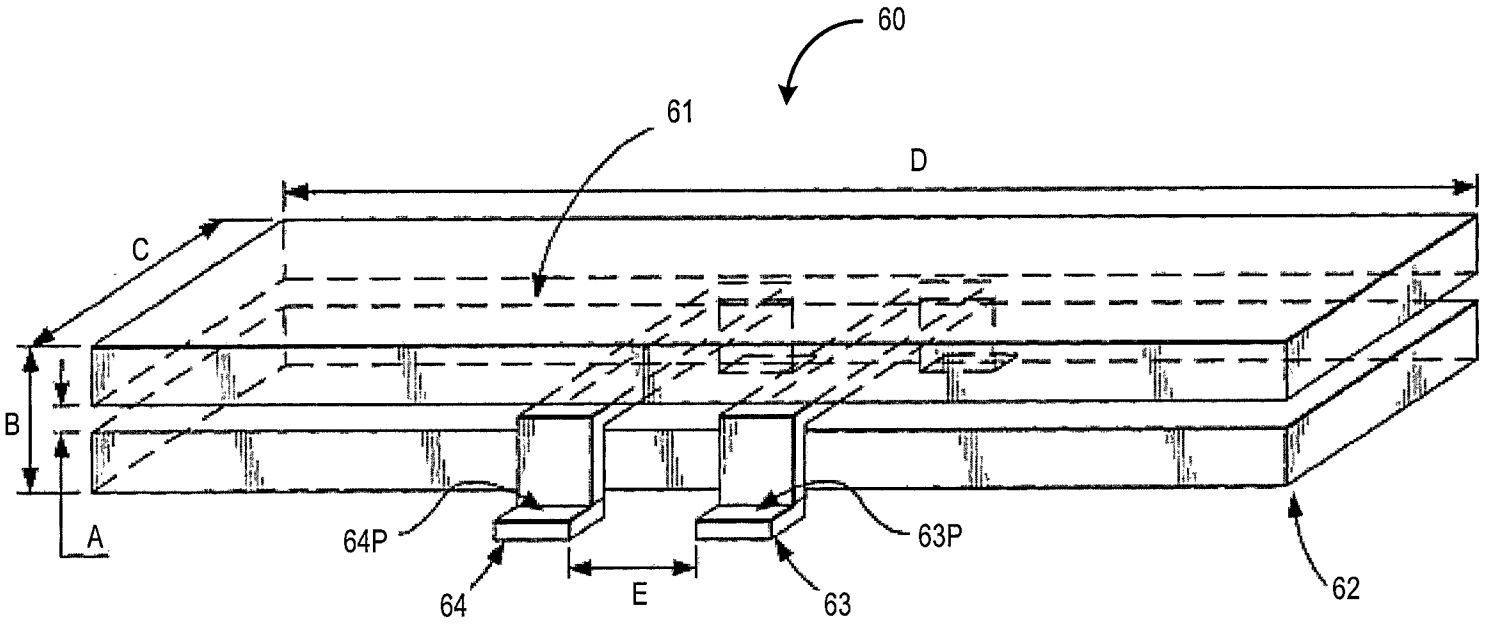
FIG. 5 shows one plate structured two-phase coupled inductor.

FIG. 5 shows a two-phase coupled inductor 60, in accord with one embodiment. Inductor 60 may, for example, serve as inductor 28 of FIG. 1. The inductor 60 may be formed from first and second magnetic cores 61 and 62, respectively. The illustration of the cores 61 and 62 is exaggerated for the purpose of showing detail of inductor 60. The two cores 61 and 62 may be "sandwiched" about the windings 64 and 63. The dimensions E, C and A, in this embodiment, are part of the calculation that determines a leakage inductance for inductor 60. The dimensions of D, C, and A, combined with the thickness of the first and second cores 61 and 62, are part of the calculation that determines a magnetizing inductance of the inductor 60. For example, assuming dimension D is much greater than E, the equations for leakage inductance and magnetizing inductance can be approximated as:

$$L_1 = \frac{\mu_0 * E * C}{2 * A} \text{ and} \tag{1}$$

$$Lm = \mu_0 * D * C / (4 * A) \tag{2}$$

$\mu_0$) is the permeability of free space, $L_1$ is leakage inductance, and $L_m$ is magnetizing inductance. One advantage of this embodiment is apparent in the ability to vary the leakage and the magnetizing inductances by varying the dimensions of inductor 60. For example, the leakage inductance and the magnetizing inductance can be controllably varied by varying the dimension E (e.g., the distance between the windings 64 and 63). In one embodiment, the cores 61 and 62 may be formed as conductive prints, or traces, directly with a PCB, thereby simplifying assembly processes of circuit construction such that windings 63, 64 are also PCB traces that couple through one or more planes of a multi-plane PCB. In one embodiment, the two-phase inductor 60 may be implemented on a PCB as two parallel thin-film magnetic cores 61 and 62. In another embodiment, inductor 60 may form planar surfaces 63P and 64P of respective windings 63, 64 to facilitate mounting of inductor 60 onto the PCB. Dimensions E, A between windings 63, 64 may define a passageway through inductor 60. At least part of this passageway is free from intervening magnetic structure between windings 63, 64; air may for example fill the space of the passageway and between windings 63, 64. In one embodiment, intervening magnetic structure fills no more than 50% of a cross-sectional area between windings 63, 64, and within the passageway; by way of example, the cross-sectional area of the passageway may be defined by the plane of dimensions A, C, which is perpendicular to a line parallel to dimension E between windings 63, 64.

Figure 6:
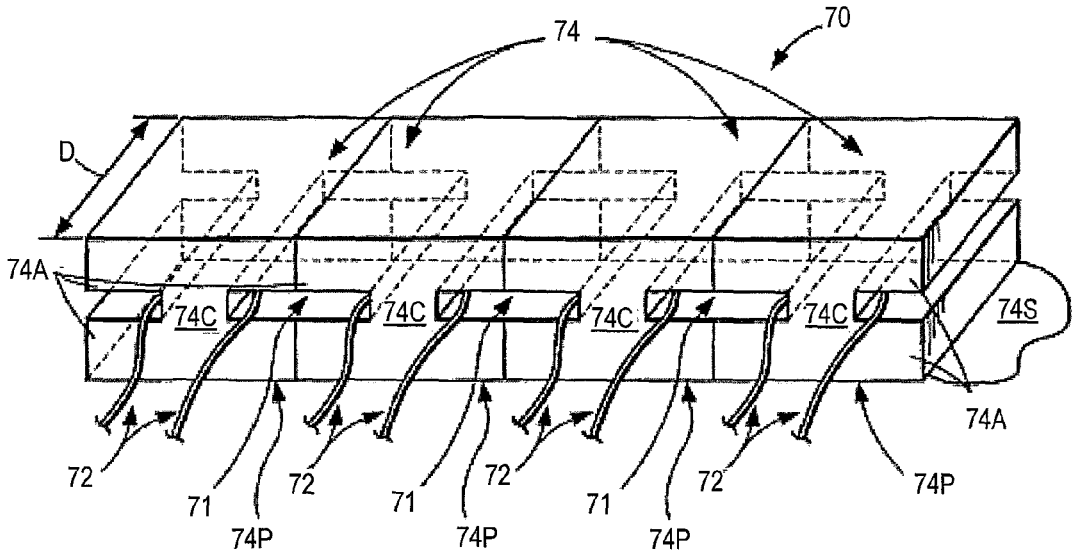
FIG. 6 shows one scalable multi-phase coupled inductor with H-shaped cores.

FIG. 6 shows a scalable, multi-phase coupled inductor 70 that may be formed from a plurality of H-shaped magnetic cores 74, in accord with one embodiment. Inductor 70 may, for example, serve as inductor 28 of FIG. 1. The inductor 70 may be formed by coupling "legs" 74A of each H-shaped core 74 together. Each core 74 has one winding 72. The windings 72 may be wound through the passageways 71 formed by legs 74A of each core 74. The winding of each core 74 may be wound prior to coupling the several cores together such that manufacturing of inductor 70 is simplified. By way of example, cores 74 may be made and used later; if a design requires additional phases, more of the cores 74 may be coupled together "as needed" without having to form additional windings 72. Each core 74 may be mounted on a PCB, such as PCB 57 of FIG. 4, and be coupled together to implement a particular design. One advantage to inductor 70 is that a plurality of cores 74 may be coupled together to make a multi-core inductor that is scalable. In one embodiment, H-shaped cores 74 cooperatively form a four-phase coupled inductor. Other embodiments may, for example, scale the number of phases of the inductor 70 by coupling more H-shaped cores 74. For example, the coupling of another H-shaped core 74 may increase the number of phases of the inductor 70 to five. In one embodiment, the center posts 74C about which the windings 72 are wound may be thinner (along direction D) than the legs 74A (along direction D). Thinner center posts 74C may reduce winding resistance and increase leakage inductance without increasing the footprint size of the coupled inductor 70. Each of the H-shaped cores 74 has a planar surface 74P, for example, that aligns with other H-shaped cores in the same plane and facilitates mounting of inductor 70 onto PCB 74S. At least part of one passageway 71, at any location along direction D within the one passageway, is free from intervening magnetic structure between windings 72; for example air may fill the three central passageways 71 of inductor 70 and between windings 72 in those three central passageways 71. In one embodiment, intervening magnetic structure fills no more than 50% of a cross-sectional area between windings 72, and within passageway 71.

Figure 7:
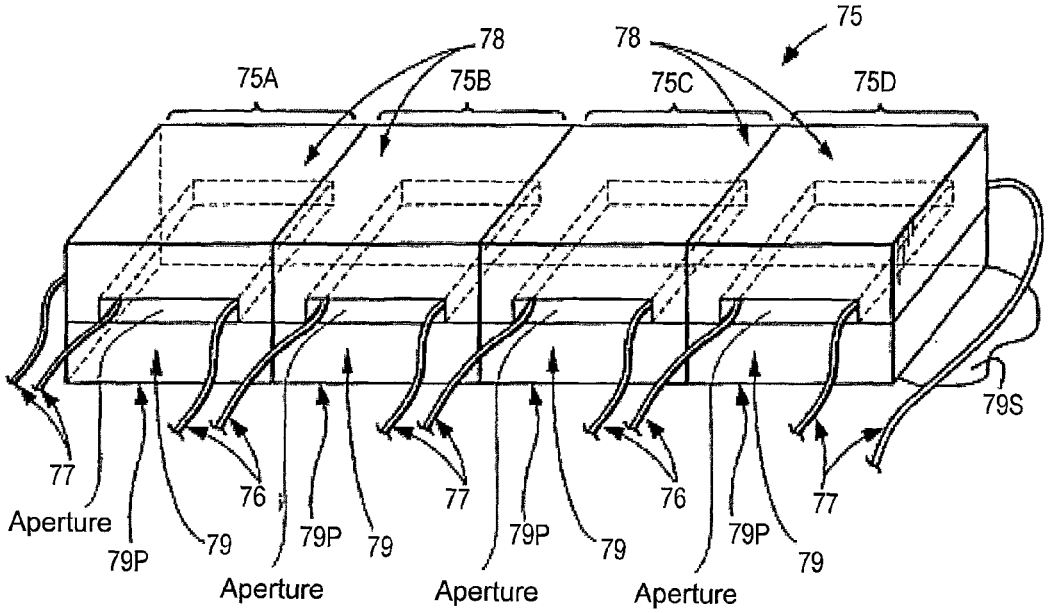
FIG. 7 shows one scalable multi-phase coupled inductor with rectangular-shaped cores.

FIG. 7 shows a scalable, multi-phase coupled inductor 75 formed from a plurality of U-shaped magnetic cores 78 and an equal number of I-shaped magnetic cores 79 (e.g., bars), in accord with one embodiment. Inductor 75 may, for example, serve as inductor 28 of FIG. 1. The U-shaped cores 78 coupled with the I-shaped cores 79 may form rectangular-shaped core cells 75A, 75B, 75C, and 75D, each of which is similar to the cell of FIG. 2, but for the winding placement. The inductor 75 may be formed by coupling each of the rectangular-shaped core cells 75A, 75B, 75C, and 75D together. The windings 76 and 77 may be wound through the passageways (labeled "APERTURE") formed by the couplings of cores 78 with cores 79 and about core elements. Similar to FIG. 6, the windings 76 and 77 of each rectangular-shaped core cell may be made prior to coupling with other rectangular-shaped core cells 75A, 75B, 75C, and 75D such that manufacturing of inductor 75 is simplified; additional inductors 75, may thus, be implemented "as needed" in a design. One advantage to inductor 75 is that cells 75A, 75B, 75C, and 75D—and/or other like cells—may be coupled together to make inductor 75 scalable. In the illustrated embodiment of FIG. 7, rectangular-shaped cells 75A, 75B, 75C, and 75D cooperatively form a five-phase coupled inductor. Each of the I-shaped cores 79 has a planar surface 79P, for example, that aligns with other I-shaped cores in the same plane and facilitates mounting of inductor 75 onto PCB 79S. At least part of the Apertures is free from intervening magnetic structure between windings 76, 77; air may for example fill the space of these passageways and between windings 76, 77. By way of example, each Aperture is shown with a pair of windings 76, 77 passing therethrough, with only air filling the space between the windings 76, 77. In one embodiment, intervening magnetic structure fills no more than 50% of a cross-sectional area between windings 76, 77, and within each respective Aperture.

Figure 8:
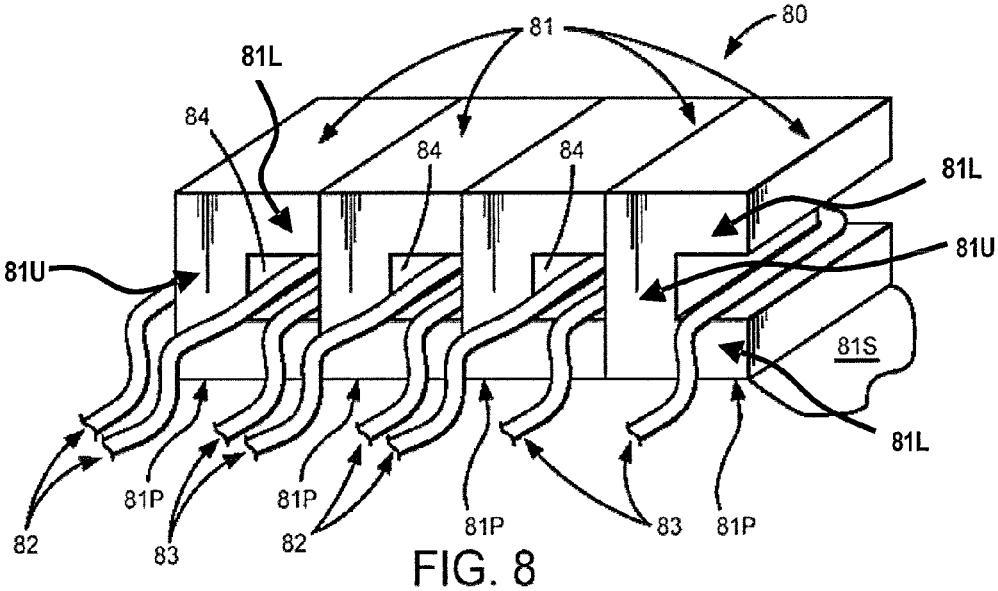
FIG. 8 shows one scalable multi-phase coupled inductor with U-shaped cores.

FIG. 8 shows a scalable, multi-phase coupled inductor 80 formed from a plurality of U-shaped magnetic cores 81 (or C-shaped depending on the orientation), in accord with one embodiment. Each magnetic core 81 has two lateral members 81L and an upright member 81U, as shown. Inductor 80 may, for example, serve as inductor 28 of FIG. 1. The inductor 80 may be formed by coupling lateral members 81L of each U-shaped core 81 (except for the last core 81 in a row) together with the upright member 81U of a succeeding U-shaped core 81, as shown. The windings 82 and 83 may be wound through the passageways 84 formed between each pair of cores 81. Scalability and ease of manufacturing advantages are similar to those previously mentioned. For example, winding 82 and its respective core 81 may be identical to winding 83 and its respective core 81, forming a pair of like cells. More cells can be added to desired scalability. Each of the U-shaped cores 81 has a planar surface 81P, for example, that aligns with other U-shaped cores 81 in the same plane and facilitates mounting of inductor 80 onto PCB 81S. At least part of one passageway 84 is free from intervening magnetic structure between windings 82, 83; air may for example fill the space of this passageway 84 and between windings 82, 83. By way of example, three passageways 84 are shown each with a pair of windings 82, 83 passing therethrough, with only air filling the space between the windings 82, 83. One winding 82 is at the end of inductor 80 and does not pass through such a passageway 84; and another winding 83 is at another end of inductor 80 and does not pass through such a passageway 84. In one embodiment, intervening magnetic structure fills no more than 50% of a cross-sectional area between windings 82, 83, and within passageway 84.

Figure 9:
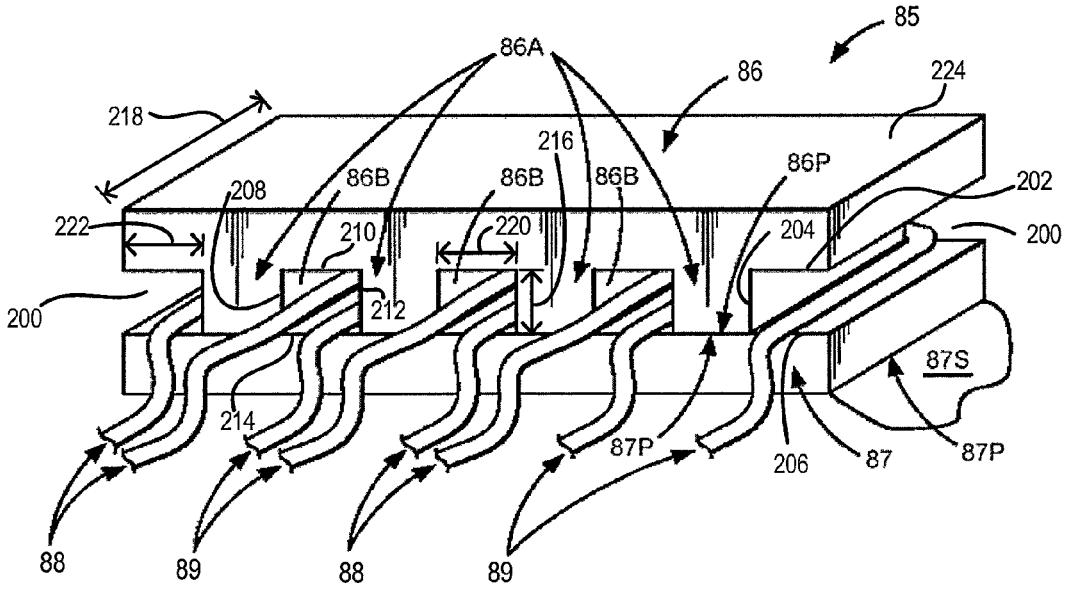
FIG. 9 shows one integrated multi-phase coupled inductor with a comb-shaped core.

FIG. 9 shows a multi-phase coupled inductor 85 formed from a comb-shaped magnetic core 86 and an I-shaped (e.g., a bar) magnetic core 87, in accord with one embodiment. Inductor 85 may, for example, serve as inductor 28 of FIG. 1. The inductor 85 may be formed by coupling a planar surface 86P of "teeth" 86A of the comb-shaped core 86 to a planar surface 87P of the I-shaped core 87 in substantially the same plane. The windings 88 and 89 may be wound through the passageways 86B formed by adjacent teeth 86A of comb-shaped core 86 as coupled with I-shaped core 87. The windings 88 and 89 may be wound about the teeth 86A of the comb-shaped core 86. FIG. 9 also shows end passageways 200, surfaces 202, 204, 206, 208, 210, 212, 214, and 224, height 216, depth 218, and widths 220 and 222. This embodiment may also be scalable by coupling inductor 85 with other inductor structures shown herein. For example, the U-shaped magnetic cores 81 of FIG. 8 may be coupled to inductor 85 to form a multi-phase inductor, or a M+1 phase inductor. The I-shaped core 87 has a planar surface 87P, for example, that facilitates mounting of inductor 85 onto PCB 87S. At least part of one passageway 86B is free from intervening magnetic structure between windings 88, 89; air may for example fill the space of this passageway 86B and between windings 88, 89. By way of example, three passageways 86B are shown each with a pair of windings 88, 89 passing therethrough, with only air filling the space between the windings 88, 89. One winding 88 is at the end of inductor 85 and does not pass through such a passageway 86B; and another winding 89 is at another end of inductor 85 and does not pass through such a passageway 86B. In one embodiment, intervening magnetic structure fills no more than 50% of a cross-sectional area between windings 88, 89, and within passageway 86B.

In one embodiment, windings 88, 89 wind around teeth 86A of core 86, rather than around I-shaped core 87 or the non-teeth portion of core 86.

Figure 10:
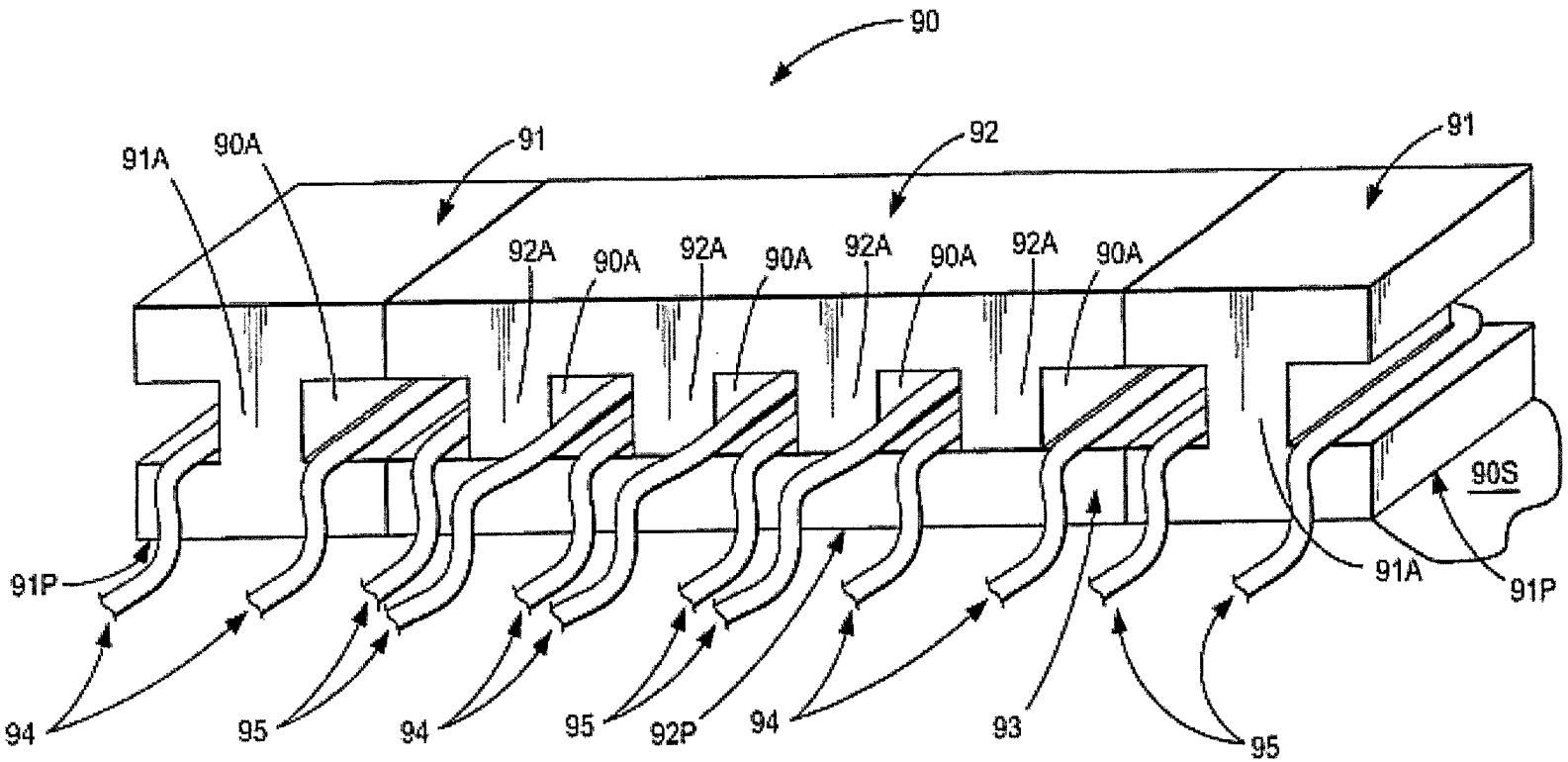
FIG. 10 shows one scalable multi-phase coupled inductor with combinations of shaped cores.

FIG. 10 shows a scalable, multi-phase coupled inductor 90 that may be formed from a comb-shaped magnetic core 92 and an I-shaped (e.g., a bar) magnetic core 93, in accord with one embodiment. Inductor 90 may, for example, serve as inductor 28 of FIG. 1. The inductor 90 may be formed by coupling "teeth" 92A of the comb-shaped core 92 to the I-shaped core 93, similar to FIG. 9. The inductor 90 may be scaled to include more phases by the addition of the one or more core cells to form a scalable structure. In one embodiment, H-shaped cores 91 (such as those shown in FIG. 6 as H-shaped magnetic cores 74) may be coupled to cores 92 and 93, as shown. The windings 94 and 95 may be wound through the passageways 90A formed by the teeth 92A as coupled with I-shaped core 93. The windings 94 and 95 may be wound about the teeth 92A of core 92 and the "bars" 91A of H-shaped cores 91. Scalability and ease of manufacturing advantages are similar to those previously mentioned. Those skilled in the art should appreciate that other shapes, such as the U-shaped cores and rectangular shaped cores, may be formed similarly to cores 92 and 93. Each of the I-shaped core 92 and the H-shaped cores 91 has a respective planar surface 92P and 91P, for example, that aligns in the same plane and facilitates mounting of inductor 90 onto PCB 90S. At least part of one passageway 90A is free from intervening magnetic structure between windings 94, 95; air may for example fill the space of this passageway 90A and between windings 94, 95. By way of example, five passageways 90A are shown each with a pair of windings 94, 95 passing therethrough, with only air filling the space between the windings 94, 95. One winding 94 is at the end of inductor 90 and does not pass through such a passageway 90A; and another winding 95 is at another end of inductor 90 and does not pass through such a passageway 90A. In one embodiment, intervening magnetic structure fills no more than 50% of a cross-sectional area between windings 94, 95, and within passageway 90A.

Figure 11:
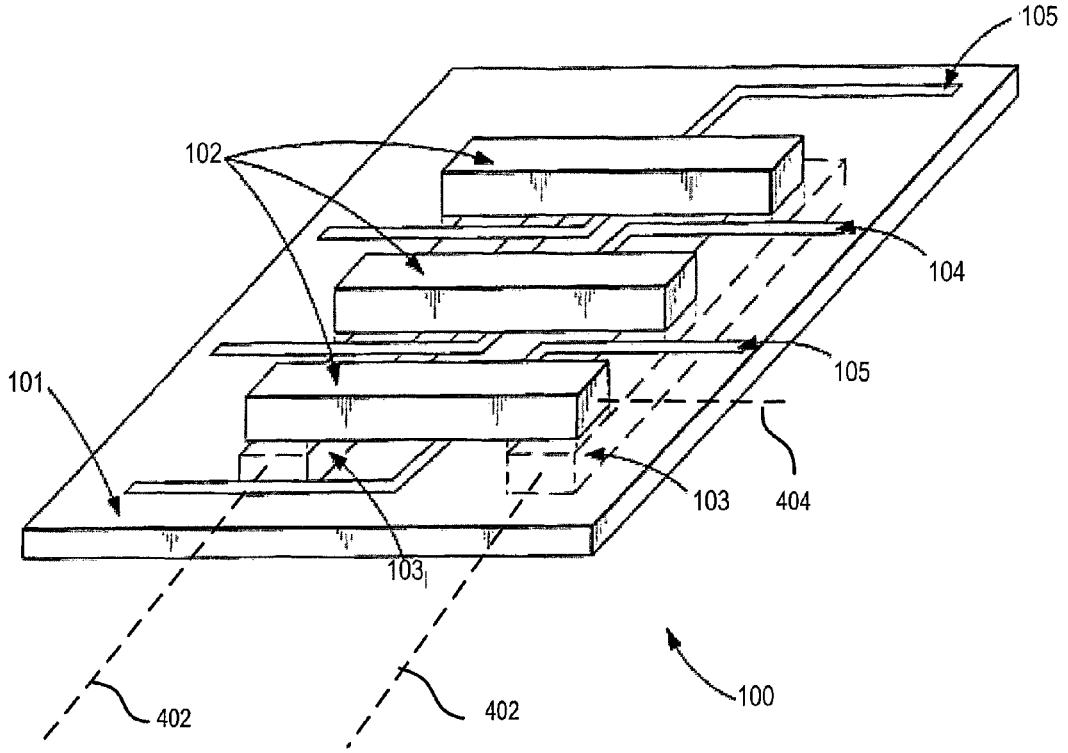
FIG. 11 shows one scalable multi-phase coupled inductor with "staple" cores.
Figure 12:
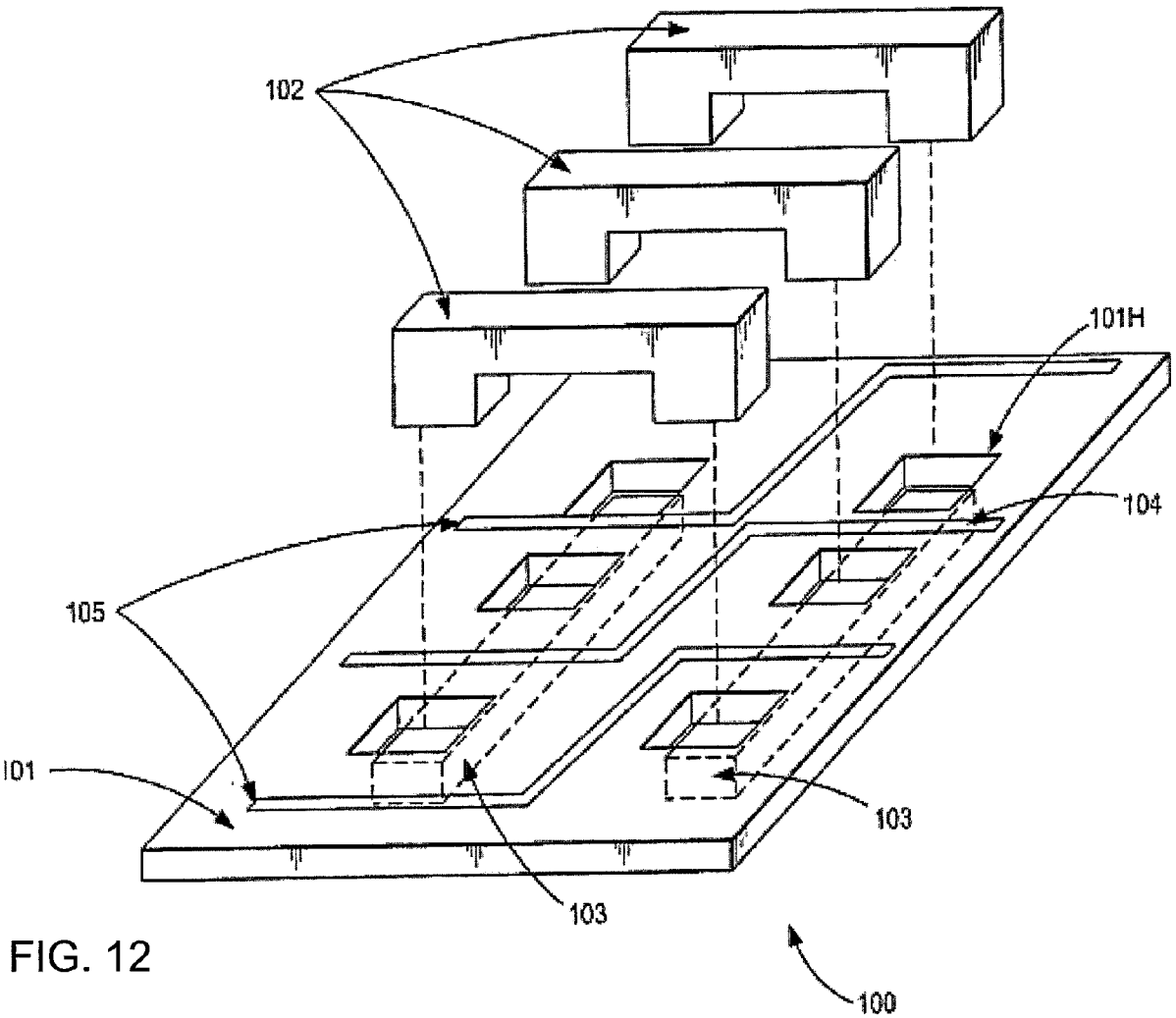
FIG. 12 shows an assembly view of the coupled inductor of FIG. 11.
Figure 13:
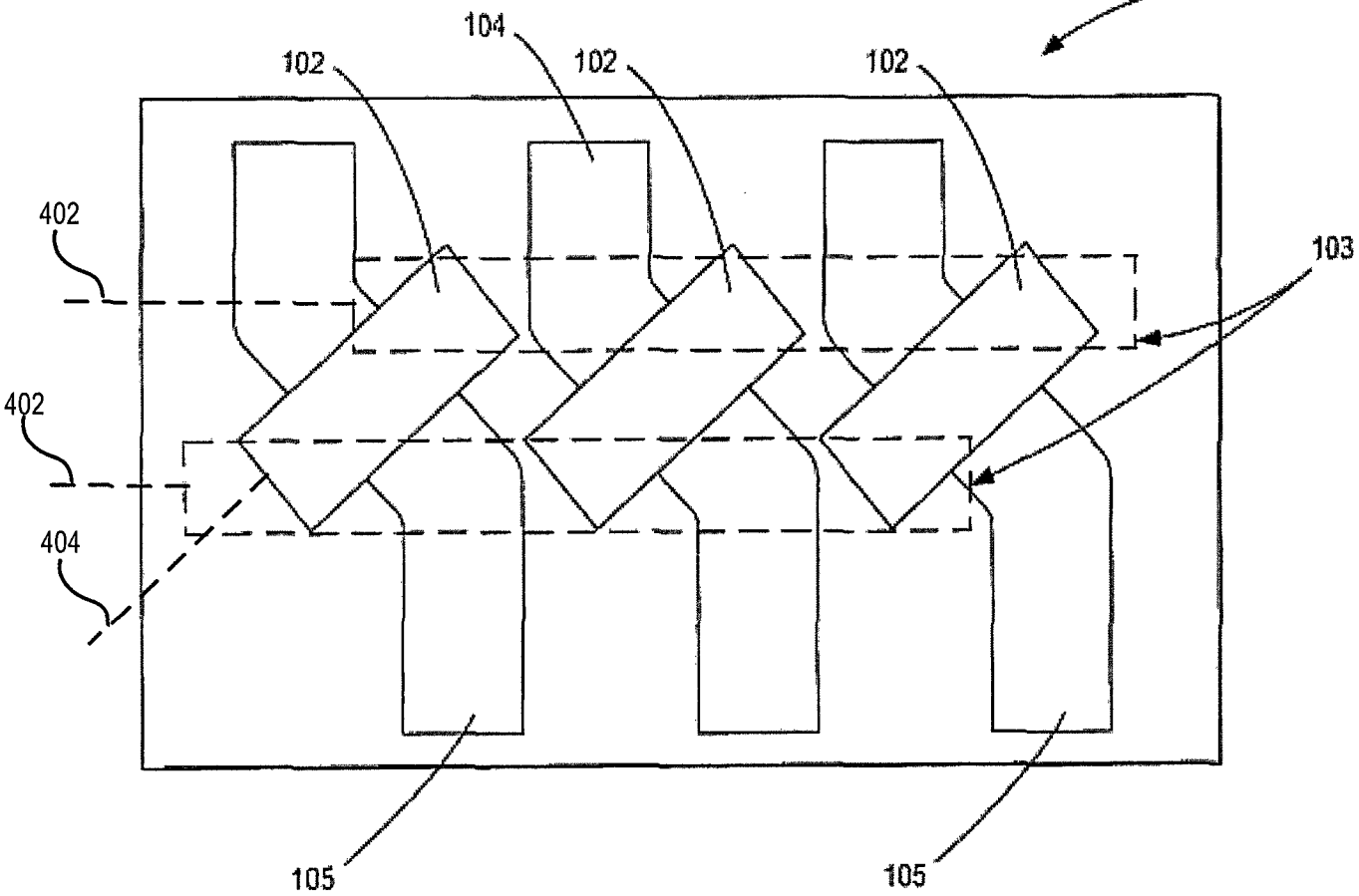
FIG. 13 shows a surface view of the coupled inductor of FIG. 11.

FIGS. 11-13 show staple magnetic cores 102 that may serve to implement a scalable multi-phase coupled inductor 100. Inductor 100 may, for example, serve as inductor 28 of FIG. 1. The staple magnetic cores 102 are, for example, U-shaped and may function similar to a "staple". The staple magnetic cores 102 may connect, or staple, through PCB 101 to bus bars 103 to form a plurality of magnetic core cells. For example, the two bus bars 103 may be affixed to one side of PCB 101 such that the staple magnetic cores 102 traverse through the PCB 101 from the opposite side of the PCB (e.g., via apertures 101H) to physically couple to the bus bars 103. One staple magnetic core may implement a single phase for the inductor 100; thus the inductor 100 may be scalable by adding more of staple magnetic cores 102 and windings 104, 105. For example, a two-phase coupled inductor would have two staple magnetic cores 102 coupled to bus bars 103 with each core having a winding, such as windings 104, 105; the number of phases are thus equal to the number of staple magnetic cores 102 and windings 104, 105. By way of example, inductor 100, FIG. 11, shows a 3-phase inductor. Bus bars 103 may have center axes 402 and staple magnetic cores 102 may have center axes 404.

Advantages of this embodiment provide a PCB structure that may be designed in layout. As such, PCB real estate determinations may be made with fewer restrictions, as the inductor 100 becomes part of the PCB design. Other advantages of the embodiment are apparent in FIG. 13. There, it can be seen that the staples 102 may connect to PCB 101 at angles to each PCB trace (i.e., windings 104 and 105) so as to not incur added resistance while at the same time improving adjustability of leakage inductance. For example, extreme angles, such as 90 degrees, may increase the overall length of a PCB trace, which in turn increases resistance due to greater current travel distance. Further advantages of this embodiment include the reduction or avoidance of solder joints, which can significantly diminish high current. Additionally, the embodiment may incur fewer or no additional winding costs as the windings are part of the PCB; this may improve dimensional control so as to provide consistent characteristics such as AC resistance and leakage inductance.

Figure 14:
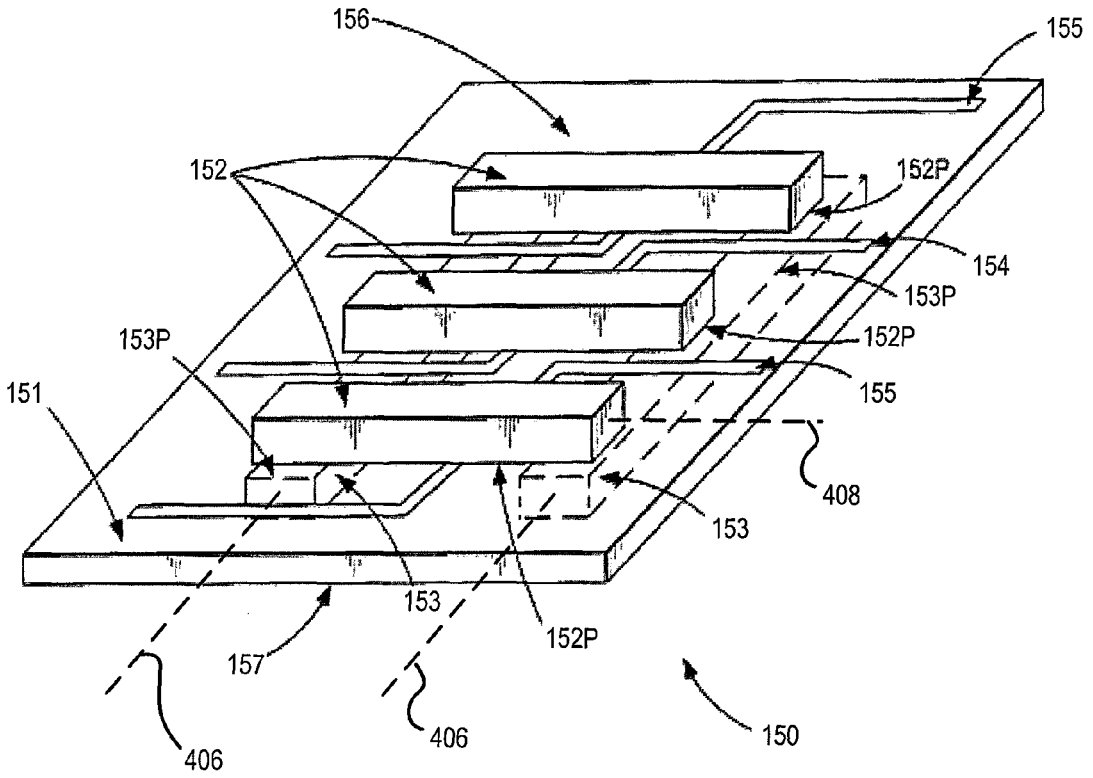
FIG. 14 shows one scaleable coupled inductor with bar magnet cores.

Similar to coupled inductor 100, FIG. 14 shows bar magnetic cores 152, 153 that serve to implement a scalable coupled inductor 150. Inductor 150 may, for example, serve as inductor 28 of FIG. 1. The bar magnetic cores 152, 153 are, for example, respectively mounted to opposing sides 156, 157 of PCB 151. Each of the bar magnetic cores 152, 153 has, for example, a respective planar surface 152P, 153P that facilitates mounting of the bar magnetic cores to PCB 151. The bar magnetic cores 152, 153, in this embodiment, do not physically connect to each other but rather affix to the sides of 156, 157 such that coupling of the inductor 150 is weaker. The coupling of the inductor 150 may, thus, be determinant upon the thickness of the PCB 151; this thickness forms a gap between cores 152 and 153. One example of a PCB that would be useful in such an implementation is a thin polyimide PCB. One bar magnetic core 152 or 153 may implement a single phase for the inductor 150; and inductor 150 may be scalable by adding additional bar magnetic cores 152 or 153. For example, a two-phase coupled inductor has two bar magnetic cores 152 coupled to two bus bars 153, each core having a winding 154 or 155 respectively. The number of phases are therefore equal to the number of bar magnetic cores 152, 153 and windings 154, 155. One advantage of the embodiment of FIG. 14 is that no through-holes are required in PCB 151. The gap between cores 152 and 153 slightly reduces coupling so as to make the DC-to-DC converter system using coupled inductor 150 more tolerant to DC current mismatch. Another advantage is that all the cores 152, 153 are simple, inexpensive I-shaped magnetic bars. Cores 152 may have center axes 408, and cores 153 may have center axes 406.

Figure 15:
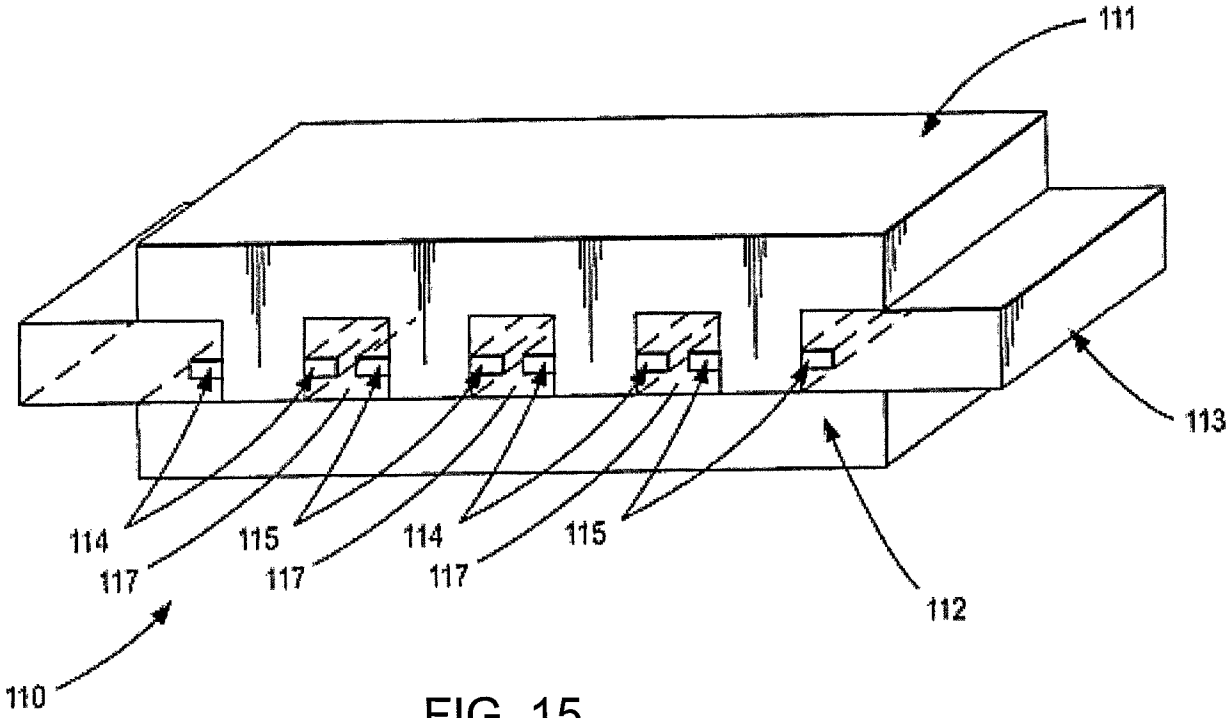
FIG. 15 shows one multi-phase coupled inductor with through-board integration.
Figure 16:
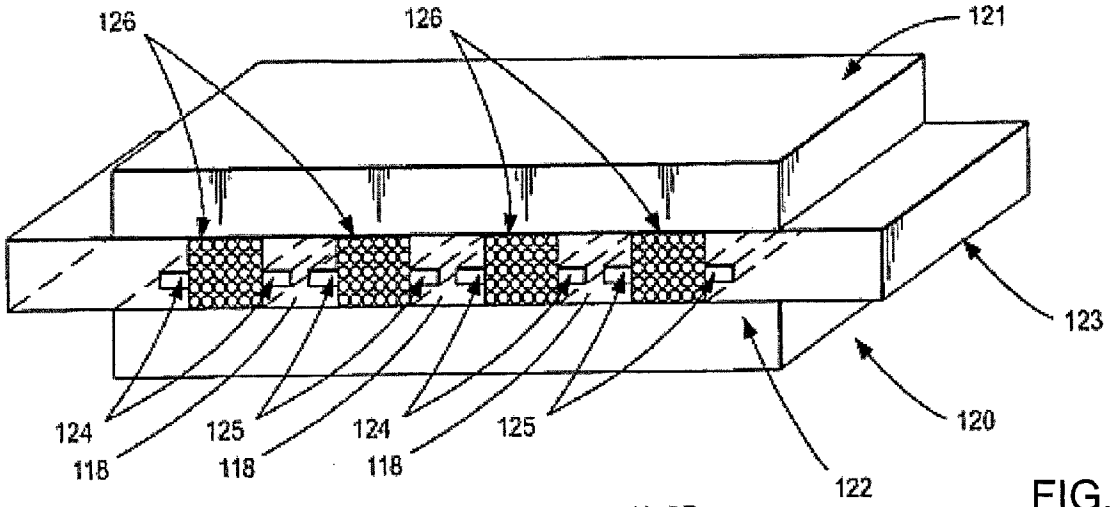
FIG. 16 shows another multi-phase coupled inductor with through-board integration.

FIGS. 15-16 each show a multi-phase coupled inductor (e.g., 110 and 120, respectively) with through-board integration, in accord with other embodiments. FIG. 15 shows a coupled inductor 110 that may be formed from a comb-shaped core 111 coupled to an I-shaped core 112 (e.g., a bar), similar to that shown in FIG. 9. In this embodiment, the cores 111 and 112 may be coupled through PCB 113 and are integrated with PCB 113. The windings 114, 115 may be formed in PCB 113 and/or as printed circuit traces on PCB 113, or as wires connected thereto.

In FIG. 15, comb-shaped core 111 and I-shaped core 112 form a series of passageways 117 within coupled inductor 110. At least part of one passageway 117 is free from intervening structure between windings 114, 115; air may for example fill the space of this passageway 117 and between windings 114, 115. By way of example, three passageways 117 are shown each with a pair of windings 114, 115 passing therethrough, with non-magnetic structure of PCB 113 filling some or all of the space between the windings 114, 115. One winding 114 is at the end of inductor 110 and does not pass through such a passageway 117; and another winding 115 is at another end of inductor 110 and does not pass through such a passageway 117. In one embodiment, intervening magnetic structure fills no more than 50% of a cross-sectional area between windings 114, 115, and within passageway 117.

FIG. 16 shows another through-board integration in a coupled inductor 120. In this embodiment, magnetic cores 121 and 122 may be coupled together by "sandwiching" the cores 121, 122 about PCB 123. The connections to the cores 121, 122 may be implemented via holes 126 in the PCB 123. The holes 126 may be filled with a ferromagnetic powder and/or bar that couples the two cores together, when sandwiched with the PCB 123. Similarly, the windings 124, 125 may be formed in PCB 123 and/or as printed circuit traces on PCB 123, or as wires connected thereto. Inductors 110 and 120 may, for example, serve as inductor 28 of FIG. 1. In the embodiment illustrated in FIG. 16, the windings 124 and 125 are illustrated as PCB traces located within a center, or interior, plane of the PCB 123. Those skilled in the art should readily appreciate that the windings 124 and 125 may be embedded into any layer of the PCB and/or in multiple layers of the PCB, such as exterior and/or interior layers of the PCB.

In FIG. 16, cores 121 and 122 and ferromagnetic-filled holes 126 form a series of passageways 118 within coupled inductor 120. At least part of one passageway 118 is free from intervening structure between windings 124, 125; air may for example fill the space of this passageway 118 and between windings 124, 125. By way of example, three passageways 118 are shown each with a pair of windings 124, 125 passing therethrough, with non-magnetic structure of PCB 123 filling some or all of the space between the windings 124, 125. One winding 124 is at the end of inductor 120 and does not pass through such a passageway 118; and another winding 125 is at another end of inductor 120 and does not pass through such a passageway 118. In one embodiment, intervening magnetic structure fills no more than 50% of a cross-sectional area between windings 124, 125, and within passageway 118.

Figure 17:
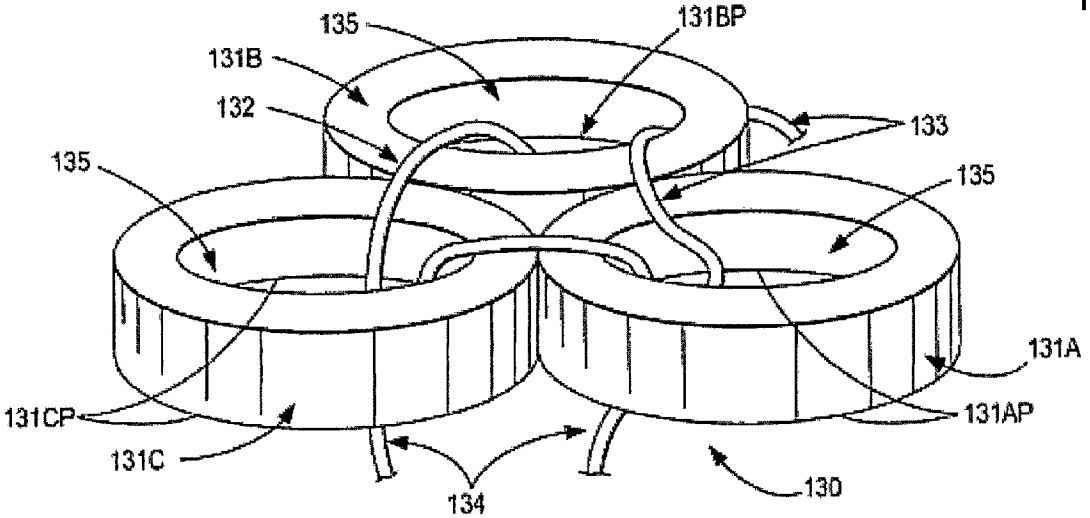
FIG. 17 shows one scalable multi-phase coupled ring-core inductor.

FIG. 17 shows a multi-phase scalable coupled ring-core inductor 130, in accord with one embodiment. The inductor 130 may be formed from multiple ring magnetic cores 131A, 131B, and 131C. In this embodiment, cores 131A, 131B, and 131C may be coupled to one another. The ring magnetic cores 131A, 131B, and 131C may have respective planar surfaces 131AP, 131BP, and 131CP, for example, that align in the same plane, to facilitate mounting with electronics such as a PCB. Each core may have a passageway 135 through which windings 132, 133, and 134 may be wound. As one example, cores 131A and 131B may be coupled to one another as winding 133 may be wound through the passageways and about the cores. Similarly, cores 131B and 131C may be coupled to one another as winding 132 may be wound through the passageways 135 of those two cores. Cores 131C and 131A may be coupled to one another as winding 134 is wound through the passageways of those two cores. In another embodiment, the multiple ring magnetic cores 131A, 131B, and 131C may be coupled together by windings such that inductor 130 appears as a string or a chain. In one embodiment, intervening magnetic structure fills no more than 50% of a cross-sectional area between the windings within each respective passageway 135.

Figure 18:
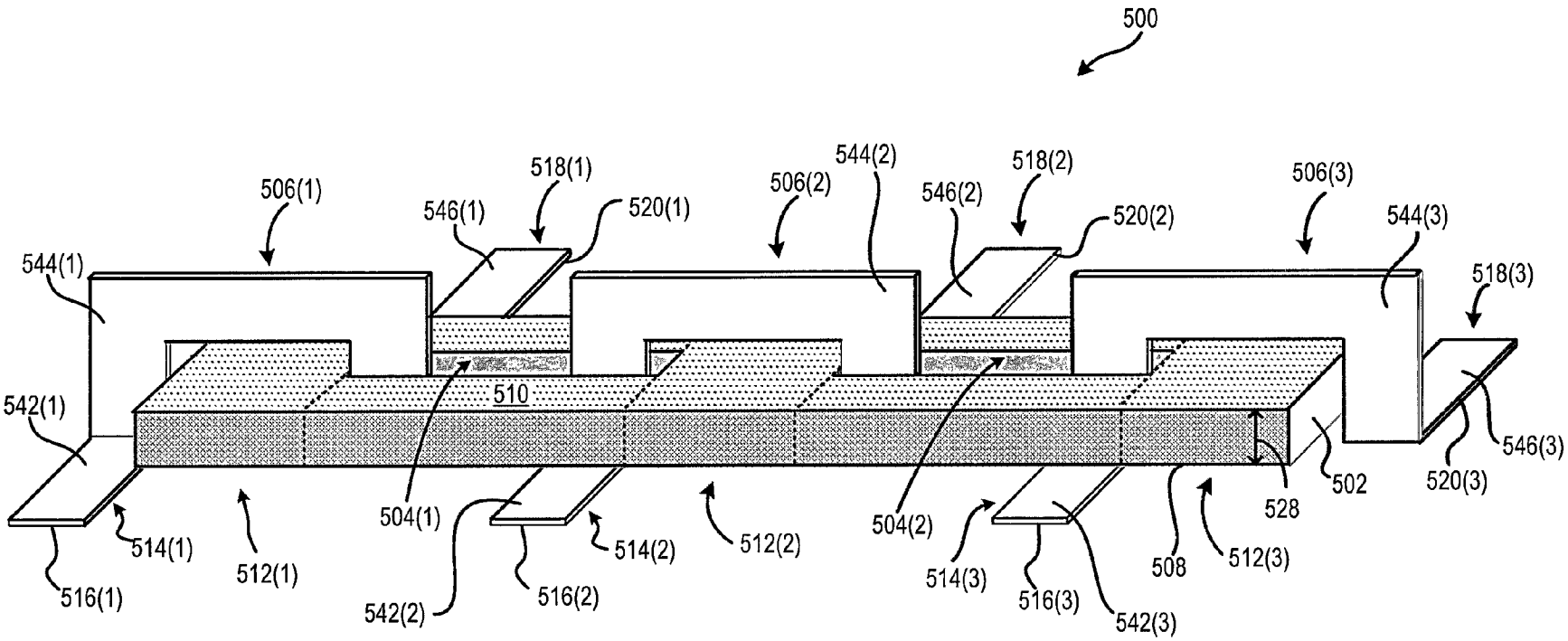
FIG. 18 is a side perspective view of one multi-phase coupled inductor, according to an embodiment.
Figure 19:
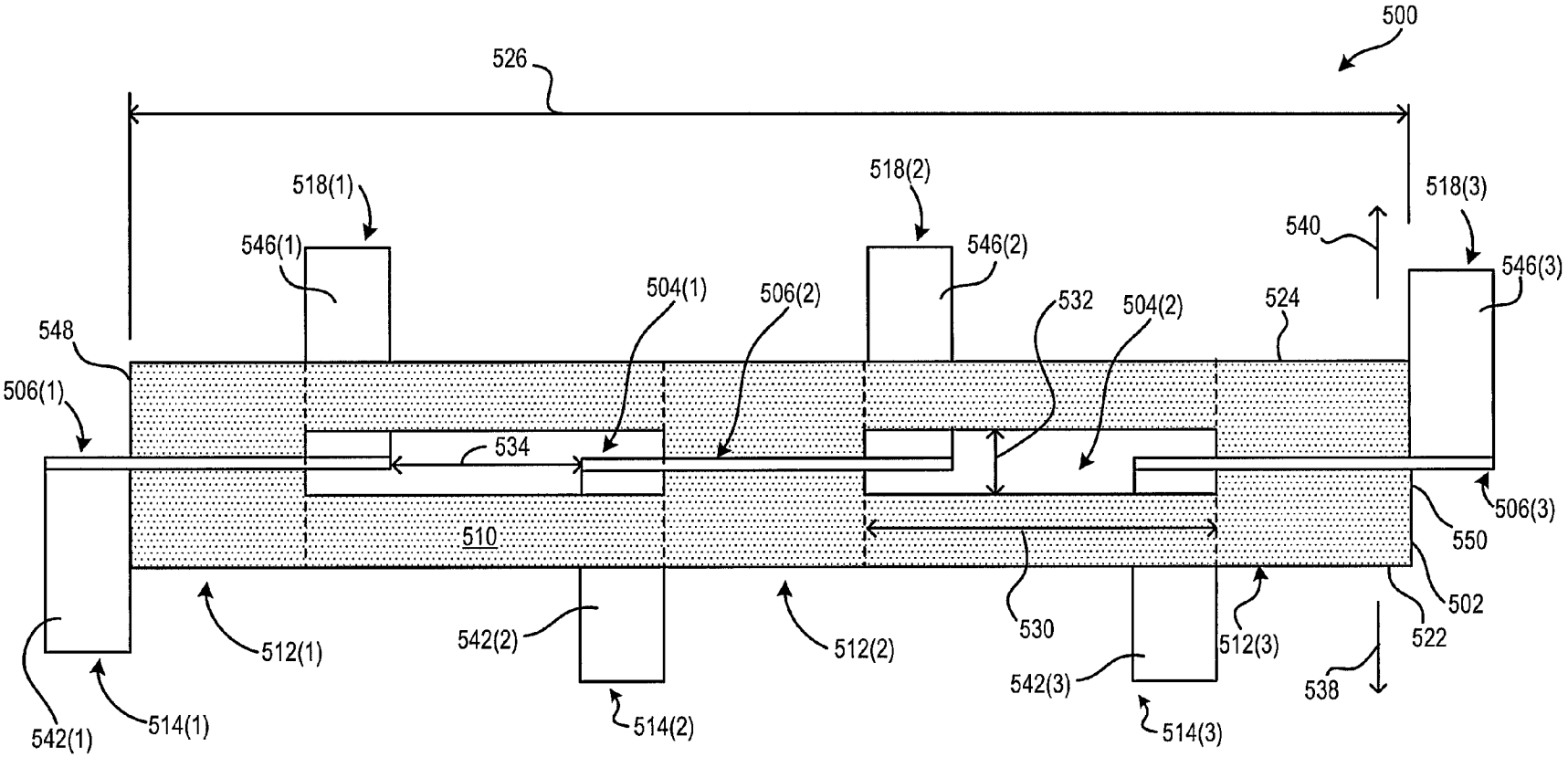
FIG. 19 is a top plan view of the multi-phase coupled inductor of FIG. 18.

FIG. 18 is a side perspective view and FIG. 19 is a top plan view of one multi-phase coupled inductor 500. Inductor 500 may, for example, serve as inductor 28 of FIG. 1. Inductor 500 is illustrated as being a three phase coupled inductor; however, embodiments of inductor 500 may support M phases, wherein M is an integer greater than one.

Inductor 500 includes core 502 and M windings 506, wherein each winding may be electrically connected to a respective phase (e.g., a phase 26 of FIG. 1) of a power converter (e.g., DC-to-DC converter system 10 of FIG. 1). Core 502 may be a single piece (e.g., a block core); alternately, core 502 may be formed of two or more magnetic elements. For example, core 502 may be formed of a comb-shaped magnetic element coupled to an I-shaped magnetic element; as another example, core 502 may be formed of a plurality of C-shaped magnetic elements or H-shaped magnetic elements coupled together. Core 502 includes a bottom surface 508 (e.g., a bottom planar surface) and a top surface 510 opposite bottom surface 508. Core 502 has a first side 522 opposite a second side 524 and a third side 548 opposite a fourth side 550 (labeled in FIG. 19).

Core 502 forms M−1 interior passageways 504. For example, inductor 500 is illustrated in FIGS. 18 and 19 as supporting three phases; accordingly, core 502 forms two interior passageways 504(1) and 504(2). Passageways 504 extend from top surface 510 to bottom surface 508. Core 502 further defines M legs 512. In FIGS. 18 and 19, legs 512(1), 512(2), and 512(3) are partially delineated by dashed lines, which are included for illustrative purposes and do not necessarily denote discontinuities in core 502. Each passageway 504 is at least partially defined by two of the M legs; for example, passageway 504(1) is partially defined by legs 512(1) and 512(2).

Core 500 has a width 526 (labeled in FIG. 19) and a height 528 (labeled in FIG. 18). Height 528 is, for example, 10 millimeters or less. Passageways 504 also have height 528. Passageways 504 each have a width 530 and a depth 532 (labeled in FIG. 19). In an embodiment of inductor 500, a ratio of passageway width 530 to passageway depth 532 is at least about 5.

As stated above, inductor 500 includes M windings 506, and inductor 500 is illustrated in FIGS. 18 and 19 as supporting three phases. Accordingly, inductor 500 includes three windings 506(1), 506(2), and 506(3). M−2 of the M windings 506 are wound at least partially about a respective leg of the magnetic core and through two of the M−1 interior passageways. For example, in FIGS. 18 and 19, winding 506(2) is wound partially about leg 512(2) and through passageways 504(1) and 504(2). Two of the M windings are wound at least partially about a respective leg of magnetic core 502 and through one interior passageway 504. For example, in FIGS. 18 and 19, winding 506(1) is wound partially about leg 512(1) and through passageway 504(1), and winding 506(3) is wound partially about leg 512(3) and through passageway 504(2). Each passageway 504 has two windings 506 wound therethrough, as may be observed from FIGS. 18 and 19.

Each passageway 504 may be at least partially free of intervening magnetic structure between the two windings wound therethrough. For example, as may be best observed from FIG. 19, in the embodiment of FIGS. 18 and 19, there is no intervening magnetic structure between windings 506(1) and 506(2) in passageway 504(1), and there is no intervening magnetic structure between windings 506(2) and 506(3) in passageway 504(2).

Each of the two windings in a passageway 504 are separated by a linear separation distance 534 (labeled in FIG. 19) in a plane parallel to first side 522 and second side 524 of core 502. In an embodiment, a ratio of separation distance 534 to passageway width 530 is at least about 0.15.

Each winding 506 has two ends, wherein the winding may be electrically connected to a circuit (e.g., a power converter) at each end. Each end of a given winding extends from opposite sides of core 502. For example, one end of winding 506(2) extends from side 522 of core 502 in the direction of arrow 538 (illustrated in FIG. 19), and the other end of winding 506(2) extends from side 524 of core 502 in the direction of arrow 540 (illustrated in FIG. 19). Such configuration of inductor 500 may allow each winding 506 to connect to a respective switching node proximate to one side (e.g., side 522 or 524) of inductor 500 and each winding 506 to connect to a common output node on an opposite side (e.g., side 524 or 522) of inductor 500. Stated differently, the configuration of inductor 500 may allow all switching nodes to be disposed adjacent to one side of inductor 500 and the common output node to be disposed on the opposite side of inductor 500. For example, each winding end extending from side 522 of core 502 may connect to a respective switching node, and each winding end extending from side 524 of core 502 may connect to a common output node. Lengths of windings 506 and/or external conductors (e.g., printed circuit board traces or bus bars) may advantageously be reduced by disposing all switching nodes on one side of inductor 500 and the common output node on the opposite side of inductor 500. Reducing the length of windings 506 and/or external conductors may reduce the resistance, cost, and/or size of inductor 500 and/or an external circuit (e.g., a power converter) that inductor 500 is installed in.

In an embodiment, windings 506 have rectangular cross section as illustrated in FIGS. 18 and 19. In such embodiment, each winding 506 forms at least three planar sections 542, 544, and 546. For example, winding 506(1) forms planar sections 542(1), 544(1), and 546(1). Planar sections 542 and 546 are about parallel with each other, and planar sections 542 and 546 are about orthogonal to planar section 544. Planar sections 542 and 546 may also be about parallel to bottom surface 508.

In an embodiment, each winding 506 has a first end forming a first tab 514 and a second end forming a second tab 518, as illustrated in FIGS. 18 and 19. First and second tabs 514, 518 are, for example, integral with their respective windings, as illustrated in FIGS. 18 and 19. For example, winding 506(1) of FIG. 18 forms first tab 514(1) and second tab 518(1). Each first tab 514 for example forms a first surface 516 (e.g., a planar surface) parallel to bottom surface 508, and each second tab 518 for example forms a second surface 520 (e.g., a planar surface) about parallel to bottom surface 508. For example, first tab 514(3) forms first surface 516(3) and second tab 518(3) forms second surface 520(3). Each first surface 516 and second surface 520 may be used to connect its respective tab to a printed circuit board disposed proximate to bottom surface 508. M−1 of first tabs 514 and M−1 of second tabs 518 are each at least partially disposed along bottom surface 508; for example, in FIGS. 18 and 19, first tabs 514(2) and 514(3) are partially disposed along bottom surface 508, and second tabs 518(1) and 518(2) are partially disposed along bottom surface 508.

Core 502 and each winding 506 collectively form a magnetizing inductance of inductor 500 as well as a leakage inductance of each winding 506. As discussed above with respect to FIG. 1, the leakage inductance of each winding, for example, ranges from 10 nH to 200 nH. Furthermore, separation distance 534 between adjacent windings may be chosen to be sufficiently large such that the leakage inductance of each winding 506 is sufficiently large. Separation distance 534 is, for example, 1.5 millimeters or greater (e.g., 3 millimeters). In embodiments of inductor 500, the magnetizing inductance of inductor 500 is greater than the leakage inductance of each winding 506.

Figure 20:
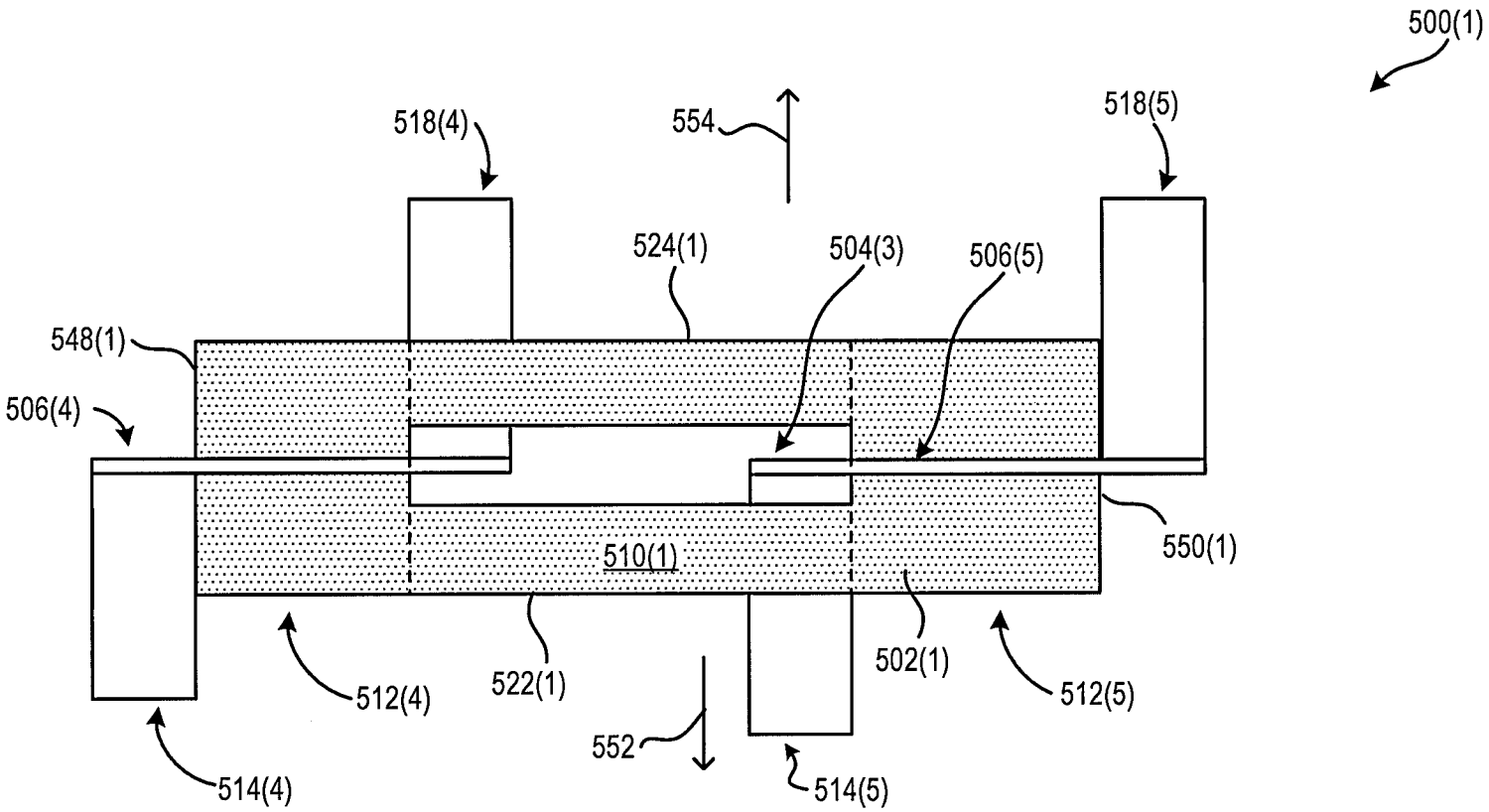
FIG. 20 is a top plan view of a two-phase embodiment of the coupled inductor of FIGS. 18 and 19.

FIG. 20 is a top plan view of a two-phase coupled inductor 500(1), which is a two-phase embodiment of inductor 500 of FIGS. 18 and 19. As illustrated in FIG. 20, core 502(1) includes legs 512(4) and 512(5). Leg 512(4) extends from first side 522(1) to second side 524(1) and defines third side 548(1); leg 512(5) extends from first side 522(1) to second side 524(1) and defines fourth side 550(1). Interior passageway 504(3) extends from a top surface 510(1) to a bottom surface of core 502(1) (not visible in the top plan view of FIG. 20). Winding 506(4) is wound partially about leg 512(4), through interior passageway 504(3), and along third side 548(1). Winding 506(5) is wound partially about leg 512(5), through interior passageway 504(3), and along fourth side 550(1).

Windings 506(4) and 506(5) each form a first end for connecting the winding to a respective switching node of a power converter. The first end of winding 506(4) forms a first tab 514(4), and the first end of winding 506(5) forms a first tab 514(5). Each of first tabs 514(4) and 514(5) for example has a surface about parallel to the bottom surface of core 502(1) for connecting the first tab to a printed circuit board disposed proximate to the bottom surface of core 502(1). Each of first tabs 514(4) and 514(5) extends beyond core 502(1) from first side 522(1) of the core in the direction indicated by arrow 552.

Windings 506(4) and 506(5) each form a second end for connecting the winding to a common output node of the power converter. The second end of winding 506(4) forms a second tab 518(4), and the second end of winding 506(5) forms a second tab 518(5). Each of second tabs 518(4) and 518(5) has for example a surface about parallel to the bottom surface of core 502(1) for connecting the second tab to the printed circuit board disposed proximate to the bottom surface of core 502(1). Each of second tabs 518(4) and 518(5) extends beyond core 502(1) from second side 524(1) of the core in the direction indicated by arrow 554.

Figure 21:
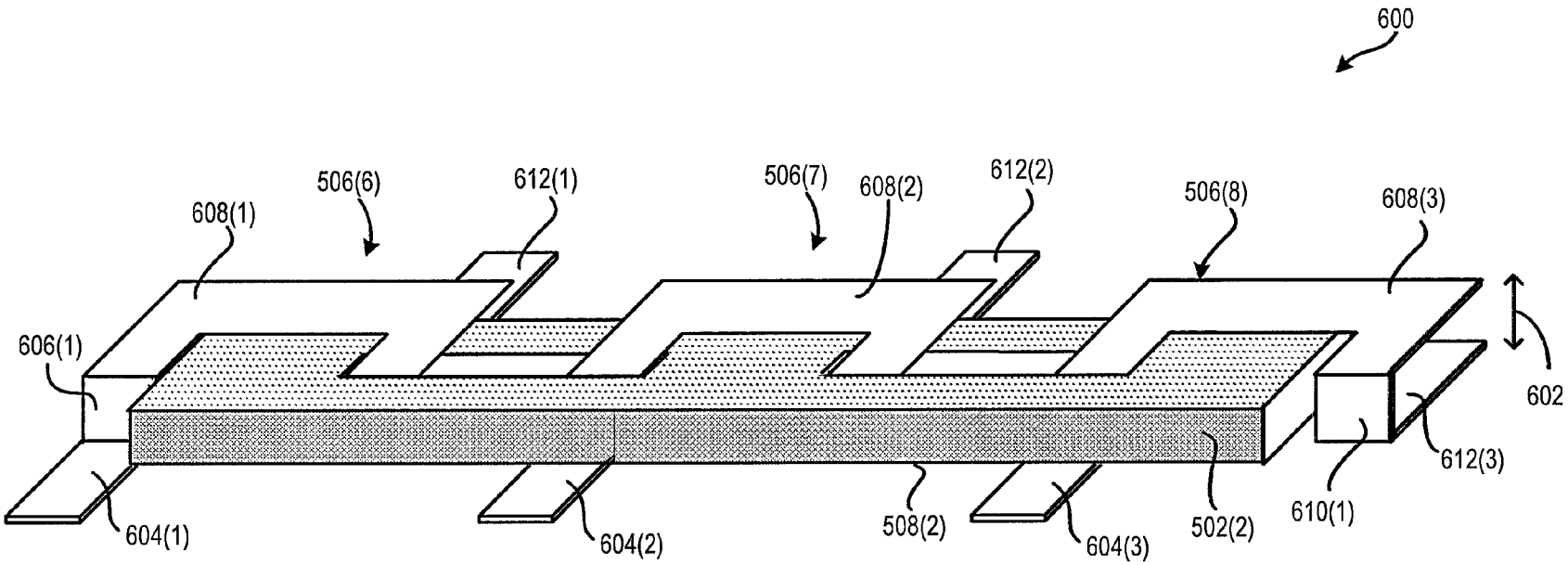
FIG. 21 is a side perspective view of one multi-phase coupled inductor, according to an embodiment.

FIG. 21 is a side perspective view of one multi-phase coupled inductor 600. Inductor 600 is essentially the same as an embodiment of inductor 500 having windings 506 with rectangular cross section with the exception that windings 506 of inductor 600 form at least five planar sections 604, 606, 608, 610, and 612. It should be noted that each of the five planar sections are not visible for each winding 506 in the perspective view of FIG. 21. For example, winding 506(8) of inductor 600 forms planar sections 604(3), 608(3), 610(1), and 612(3) as well as an additional planar section that is not visible in the perspective view of FIG. 21. Such additional planar section of winding 506(8) corresponds to planar section 606(1) of winding 506(6). Planar sections 604, 608, and 612 are, for example, about parallel to a bottom surface 508 (2) of core 502(2). Forming windings 506 with at least five planar sections may advantageously reduce a height 602 of inductor 600.

Power is lost in a coupled inductor's windings as current flows through the windings. Such power loss is often undesirable for reasons including (a) the power loss can cause undesired heating of the inductor and/or the system that the inductor is installed in, and (b) the power loss reduces the system's efficiency. Power loss in a coupled inductor may be particularly undesirable in a portable system (e.g., a notebook computer) due to limited capacity of the system's power source (e.g., limited capacity of a battery) and/or limitations in space available for cooling equipment (e.g., fans, heat sinks). Accordingly, it would be desirable to reduce power loss in a coupled inductor's windings.

One reason that power is lost as current flows through a coupled inductor's winding is that such winding is formed of a material (e.g., copper or aluminum) that is not a perfect electrical conductor. Stated differently, such material that the winding is formed of has a non-zero resistivity, and accordingly, the winding has a non-zero resistance. This resistance is commonly referred to as DC resistance, or ("$R_{DC}$"), and is a function of characteristics including the winding's length, cross sectional area, temperature, and resistivity. Specifically, $R_{DC}$ is directly proportional to the winding's length and its constituent material's resistivity; conversely, $R_{DC}$ is indirectly proportional to the winding's cross sectional area. Power loss due to DC resistance ("$P_{DC}$") is given by the following equation:

$$P_{DC}=R_{DC}I^2, \qquad \text{EQN. 1}$$

where I is either the magnitude of direct current flowing through the winding, or the root mean square ("RMS") magnitude of AC current flowing through the winding. Accordingly, $P_{DC}$ may be reduced by reducing $R_{DC}$.

Another reason that power may be lost as current flows through a coupled inductor's winding is that the winding has a non-zero AC resistance ("$R_{AC}$"). $R_{AC}$ is an effective resistance resulting from AC current flowing through the winding, and $R_{AC}$ increases with increasing frequency of AC current flowing through the winding. Power loss due to $R_{AC}$ is zero if solely direct current flows through the winding. Accordingly, if solely direct current flows through a winding, power is lost in the winding due to the winding having a non-zero $R_{DC}$, but no additional power is lost in the winding due to $R_{AC}$. However, under AC conditions, power is lost in a winding due to both $R_{AC}$ and $R_{DC}$ having non-zero values. For the purposes of this disclosure and corresponding claims, alternating current includes not only sinusoidal current having a single frequency, but also any current that varies as a function of time (e.g., a current waveform having a fundamental frequency and a plurality of harmonics such as a triangular shaped current waveform). Accordingly, it would be desirable to minimize both $R_{AC}$ and $R_{DC}$ of a coupled inductor intended to conduct AC current in order to minimize power lost in the inductor's windings.

Inductors installed in DC-to-DC converters, such as DC-to-DC converter system 10 of FIG. 1, commonly conduct alternating currents. The frequency of such alternating currents is often relatively high, such as in the tens to hundreds of kilohertz, or even in the megahertz range. Accordingly, $R_{AC}$ may result in significant power loss in inductors (e.g., coupled inductor 28) used in DC-to-DC converters.

One contributor to $R_{AC}$ is commonly called the skin effect. The skin effect describes how alternating current tends to be disproportionately distributed near the surface of a conductor (e.g., the outer surface of a winding). The skin effect becomes more pronounced as the current's frequency increases. Accordingly, as the frequency of current flowing through a conductor increases, the skin effect causes a reduced portion of the conductor's cross sectional area to be available to conduct current, and the conductor's effective resistance thereby increases.

A conductor's inductance may also contribute to its $R_{AC}$. Current flowing through a conductor (e.g., a winding) will tend to travel along the path that results in the least inductance. If a conductor is not completely linear (e.g., a winding wound around a magnetic core), current will tend to flow through the conductor in a manner that creates the smallest loop and thereby minimizes inductance. Thus, as the frequency of current flowing through the conductor increases, inductance causes a reduced portion of the conductor's cross sectional area to be available to conduct current, and the conductor's effective resistance thereby increases.

Figure 22:
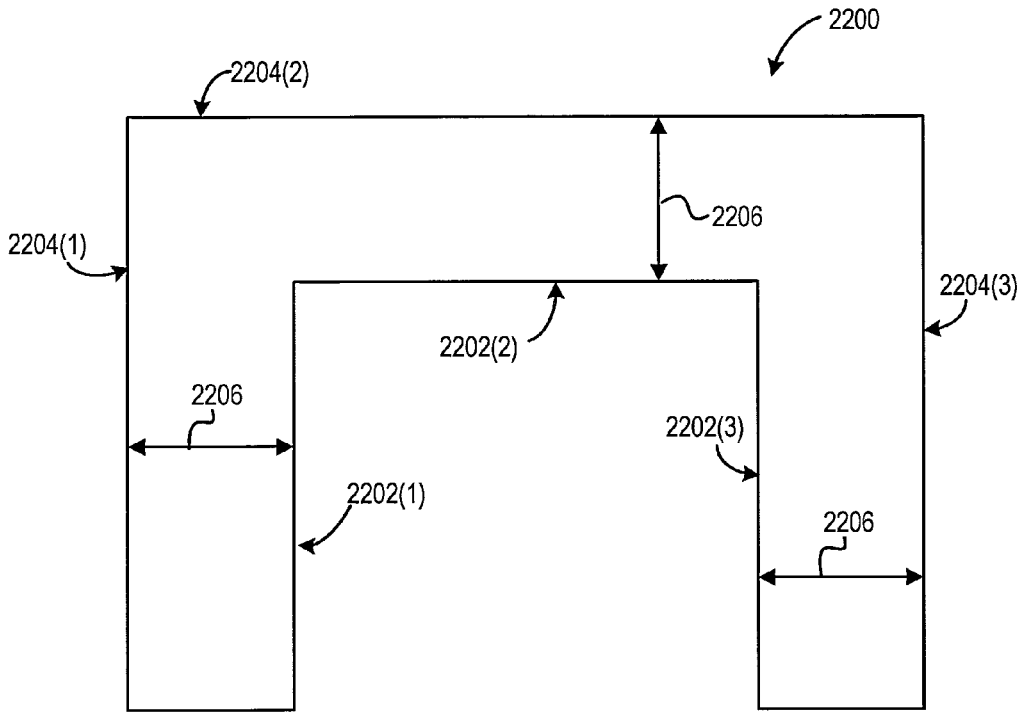
FIG. 22 is a top plan view of one inductor winding, according to an embodiment.
Figure 23:
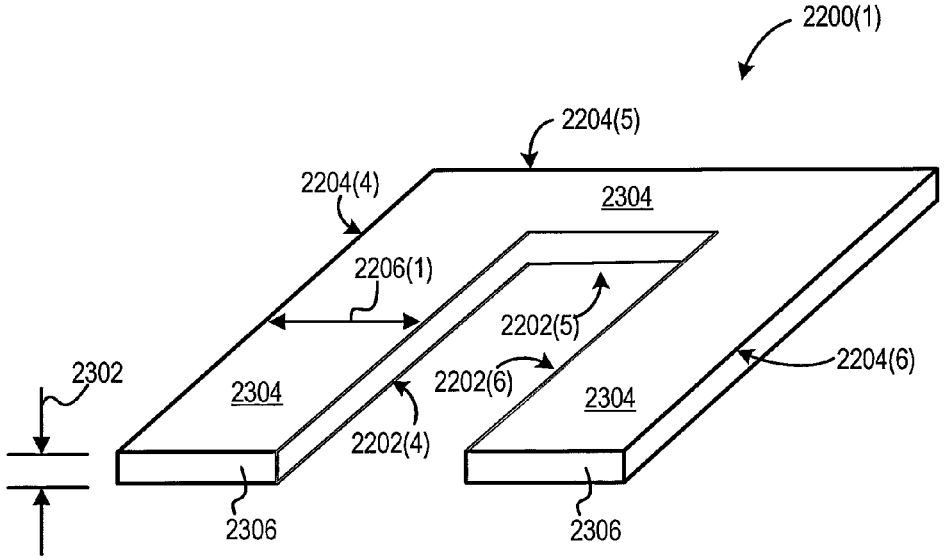
FIG. 23 is a top perspective view of one embodiment of the winding of FIG. 22.

The effects of $R_{AC}$ may be appreciated by referring to FIGS. 22 and 23. FIG. 22 is a top plan view of one inductor winding 2200. Winding 2200 has inner sides 2202 and opposite outer sides 2204. Under AC operating conditions, current flowing through winding 2200 will not be evenly distributed along width 2206 of winding 2200. Instead, current flowing through winding 2200 will be most densely distributed closest to inner sides 2202 and least densely distributed closest to outer sides 2204. Such non-uniform distribution of current flowing through winding 2200, which is due to both the skin effect and inductance of winding 2200, increases the conductor's effective resistance by reducing the cross-sectional area of winding 2200 being utilized to carry current. Accordingly, winding 2200 has a non-zero value of $R_{AC}$, which causes power loss in winding 2200 to increase in proportion to the frequency of current flowing through winding 2200.

FIG. 23 is a top perspective view of one foil winding 2200(1), which is an embodiment of winding 2200 of FIG. 22. Winding 2200(1) has width 2206(1) and thickness 2302. As can be observed from FIG. 23, width 2206(1) has a value that is significantly greater than the value of thickness 2302. Accordingly, top surface area 2304 of winding 2200(1) is significantly greater than combined surface area of inner sides 2202(4), 2202(5), and 2202(6).

In the same manner as that discussed above with respect to FIG. 22, alternating current flowing through winding 2200(1) will be most heavily distributed closest to inner sides 2202 and least heavily distributed closest to outer sides 2204. Because width 2206(1) is significantly greater than thickness of 2302, a significant portion of the cross section 2306 of winding 2200(1) may be underutilized when winding 2200 (1) is carrying alternating current. Accordingly, winding 2200 (1) is likely to have an $R_{AC}$ value larger than that expected from the skin effect alone.

Figure 24:
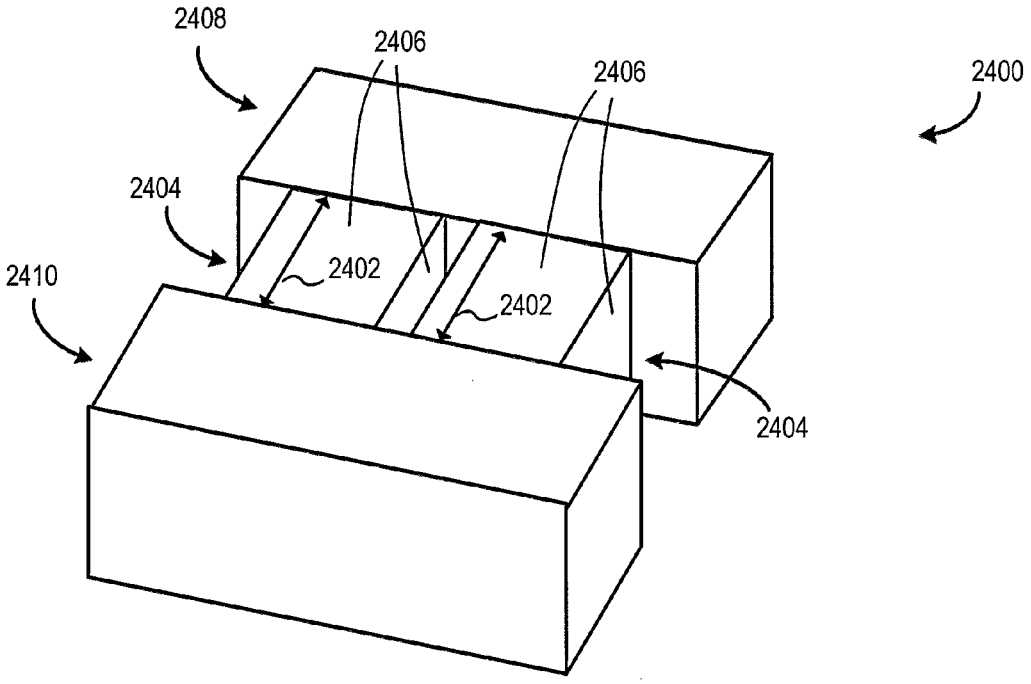
FIG. 24 is a top perspective view of one M-phase coupled inductor, according to an embodiment.

FIG. 24 is a top perspective view of one M-phase coupled inductor 2400, where M is an integer greater than one. Coupled inductor 2400 may, for example, serve as inductor 28 of FIG. 1. Coupled inductor 2400 is designed such that its windings advantageously have a low $R_{DC}$ and $R_{AC}$, as discussed below. Although coupled inductor 2400 is illustrated in FIG. 24 as having two phases, embodiments of inductor 2400 have greater than two phases. For example, coupled inductor 2400(1) illustrated in FIG. 25, which is discussed below, has three phases.

Coupled inductor 2400 includes a magnetic core having end magnetic elements 2408 and 2410 as well as M legs 2404. Legs 2404 are disposed between end magnetic elements 2408 and 2410, and legs 2404 connect end magnetic element 2408 and 2410. Each leg 2404 has a width 2402 equal to a linear separation distance between end magnetic elements 2408 and 2410 where the end magnetic elements are connected by the leg. Stated differently, each leg 2404 has a respective width 2402 in the direction connecting end magnetic elements 2408 and 2410. Each leg 2404 may have the same width 2402; alternately, width 2402 may vary among legs 2404 in coupled inductor 2400.

Each leg 2404 has an outer surface 2406. Outer surface 2406 may include a plurality of sections. For example, FIG. 24 illustrates legs 2404 having a rectangular shape such that the outer surface of each leg 2404 includes four planar sections, one of such four planar sections being a bottom planar surface. In the perspective view of FIG. 24, only two of the planar sections of outer surface 2406 of each leg 2404 are visible. For example, the bottom planar surface of each leg 2404 is not visible in the perspective view of FIG. 24.

Coupled inductor 2400 may have legs 2404 formed in shapes other than rectangles. For example, in an embodiment of coupled inductor 2400 (not shown in FIG. 24), legs 2404 have an outer surface 2406 including a planar first surface and a rounded second surface.

The core of coupled inductor 2400 is formed, for example, of a ferrite material including a gap filled with a non-magnetic material (e.g., air) to prevent coupled inductor 2400 from saturating. As another example, the core of coupled inductor 2400 may be formed of a powdered iron material, a Kool-μ® material, or similar materials commonly used for the manufacturing of magnetic cores for magnetic components. Powered iron may be used, for example, if coupled inductor 2400 is to be used in relatively low frequency applications (e.g., 250 KHz or less). Although FIG. 24 illustrates end magnetic elements 2408 and 2410 as well as legs 2404 as being discrete elements, one or more of such elements may be combined. Furthermore, at least one of end magnetic elements 2408 and 2410 as well as legs 2404 may be divided. For example, the core of coupled inductor 2400 may be formed from a comb-shaped and an I-shaped magnetic element.

Figure 25:
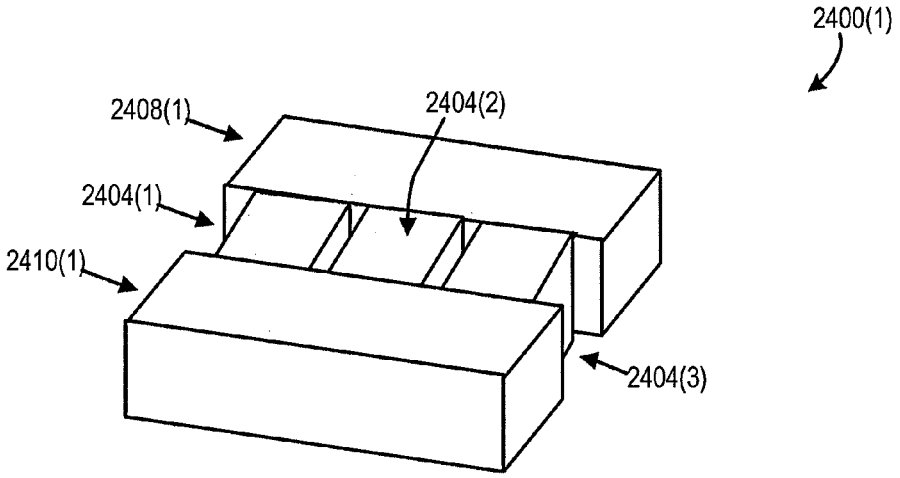
FIG. 25 is a top perspective view of one embodiment of the coupled inductor of FIG. 24.

As noted above, coupled inductor 2400 is illustrated in FIG. 24 as having two phases; accordingly, coupled inductor 2400 has two legs 2404 in FIG. 24. FIG. 25 is a top perspective view of one coupled inductor 2400(1), which is a three phase embodiment of coupled inductor 2400. Coupled inductor 2400(1) includes three legs 2404(1), 2404(2), and 2404(3) connecting end magnetic elements 2408(1) and 2410(1).

Coupled inductor 2400 includes M windings, each of which are magnetically coupled to each other. Each winding is wound at least partially about a respective leg 2404. Each winding may form a single turn or a plurality of turns, and may include solder tabs for connecting the winding to a PCB. Windings are not shown in FIGS. 24 and 25 in order to promote illustrative clarity. In some embodiments of coupled inductor 2400, at least one section of outer surface 2406 is substantially covered by a winding.

Figure 26:
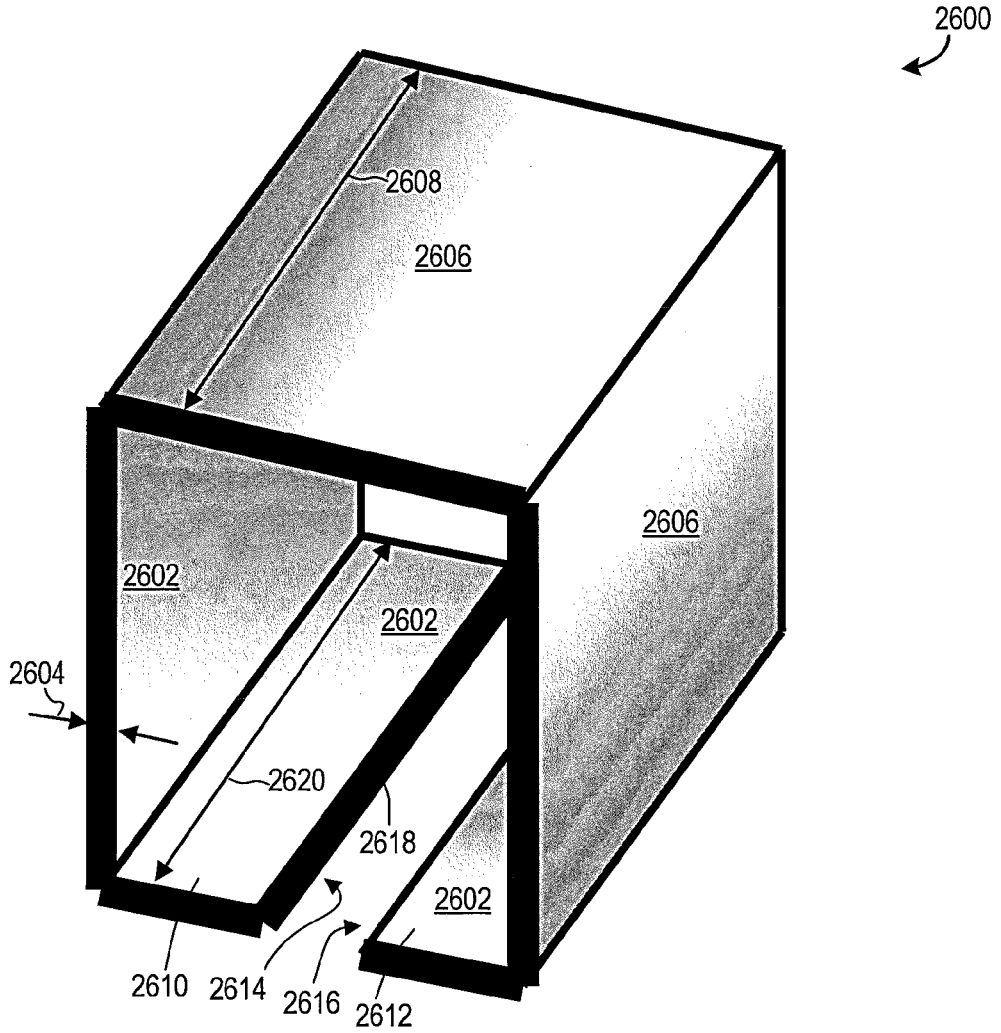
FIG. 26 is a side perspective view of one winding that may be used with the coupled inductor of FIG. 24, according to an embodiment.

FIG. 26 is a side perspective view of one winding 2600, which is an embodiment of a winding that may be used with coupled inductor 2400. As discussed above, coupled inductor 2400 includes M windings; accordingly, an embodiment of coupled inductor 2400 including windings 2600 will include M windings 2600, where each winding 2600 is at least partially wound about a respective leg 2404. Windings 2600, for example, form a single turn, as illustrated in FIG. 26. However, other embodiments of windings 2600 may form multiple turns; such multi-turn windings may be electrically insulated using a dielectric tape, a dielectric coating, or other insulating material to prevent turns from electrically shorting together.

Winding 2600 for example has a substantially rectangular cross section. In the context of this disclosure and corresponding claims, windings having a substantially rectangular cross section include, but are not limited to, foil windings. Each winding 2600 has an inner surface 2602, an opposite outer surface 2606, width 2608, and thickness 2604 that is orthogonal to inner surface 2602 and outer surface 2606. Width 2608 is, for example, greater than (e.g., at least two or five times) thickness 2604. Thus, some embodiments of winding 2600 have an aspect ratio (ratio of width 2608 to thickness 2604) of at least two or five. As discussed below, such characteristics help reduce each winding 2600's $R_{AC}$. When winding 2600 is wound about a respective leg 2404, width 2608 is parallel to width 2402 of the respective leg. Embodiments of winding 2600 have a value of width 2608 that is, for example, at least eighty percent of the value of width 2402 of the respective leg 2404 that the winding is wound about. For example, winding 2600 may have a width 2608 that is about equal to the value of width 2402 of the leg that the winding is wound at least partially about.

Winding 2600 has a first end 2614 and a second end 2616; first end 2614 and second end 2616 may form respective solder tabs for connecting winding 2600 to a PCB. For example, winding 2600 is illustrated in FIG. 26 as including solder tabs 2610 and 2612, each having a common width 2620 that is equal to width 2608 of winding 2600. Solder tabs 2610 and 2612 are, for example, integral with winding 2600 as illustrated in FIG. 26. If an embodiment of winding 2600 having solder tabs is wound about a leg 2404 having a bottom planar surface, the solder tabs may be disposed along such bottom planar surface.

Winding 2600 has a cross section 2618 orthogonal to winding 2600's length. Cross section 2618 is, for example, rectangular. Winding 2600 is illustrated in FIG. 26 as being formed into five rectangular sections. Accordingly, each of inner surface 2602 and outer surface 2606 includes five different rectangular sections, although not all of such sections are visible in the perspective view of FIG. 26. However, winding 2600 may have fewer than five sections (e.g., if it does not include solder tabs), or greater than five sections (e.g., if it is a multi-turn winding).

Figure 27:
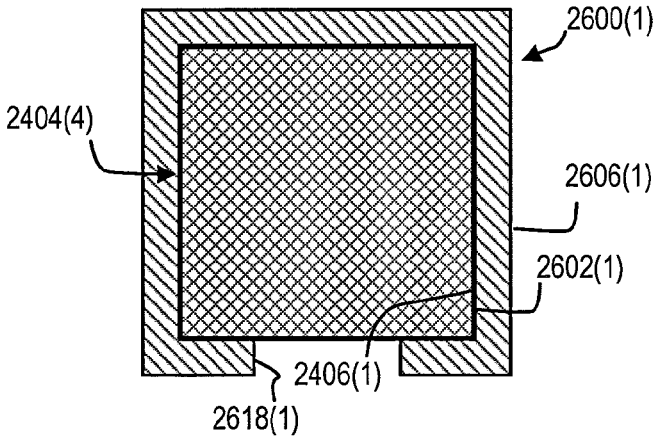
FIG. 27 is a side plan view of one leg of the coupled inductor of FIG. 24 having an embodiment of the winding of FIG. 26, according to an embodiment.

When coupled inductor 2400 includes M windings 2600, each of the M windings 2600 is wound about a respective leg 2404 such that inner surface 2602 of the winding is wound about the outer surface 2406 of the leg. Stated differently, inner surface 2602 of winding 2600 faces outer surface 2406 of the leg. For example, FIG. 27 is a side plan view of one leg 2404(4) having a winding 2600(1) partially wound about. As can be observed from FIG. 27, winding 2600(1) is a single turn winding and inner surface 2602(1) of winding 2600(1) is wound about outer surface 2406(1) of leg 2404(4).

Figure 28:
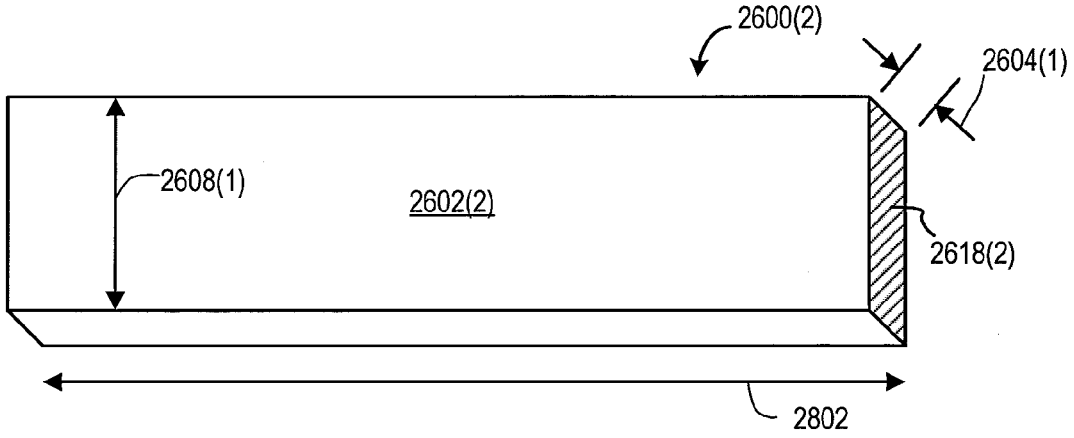
FIG. 28 is a bottom perspective view of an embodiment of the winding of FIG. 26.

FIG. 28 is a bottom perspective view of winding 2600(2), which is an embodiment of winding 2600 before it has been wound about a leg 2404. Winding 2600(2) has width 2608(1) and thickness 2604(1), where thickness 2604(1) is orthogonal to inner surface 2602(2). Width 2608(1) is greater than (e.g., at least two or five times) thickness 2604(1). Embodiments of winding 2600(2) have width 2608(1) being at least two millimeters. Cross section 2618(2), which is orthogonal to a length 2802, is visible in FIG. 28. As can be observed from FIG. 28, the surface area of inner surface 2602(2) is greater than the surface area of cross section 2618(2).

Figure 29:
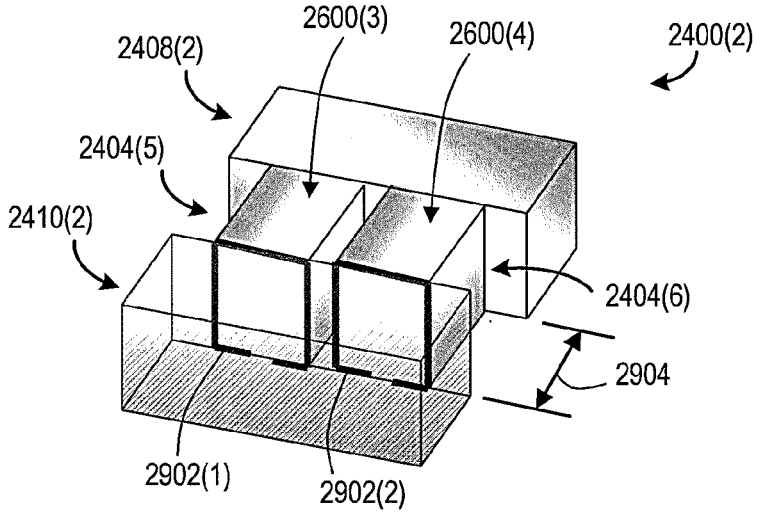
FIG. 29 is a top perspective view of another embodiment of the coupled inductor of FIG. 24.

FIG. 29 is a top perspective view of one coupled inductor 2400(2), which is another embodiment of coupled inductor 2400 of FIG. 24. Coupled inductor 2400(2) includes single turn windings 2600(3) and 2600(4) partially wound about respective legs 2404(5) and 2404(6). Legs 2404(5) and 2404(6) each have a rectangular shape having an outer surface including four planar sections, and three of the four planar sections of each leg are substantially covered by the leg's respective winding. Furthermore, legs 2404(5) and 2404(6) as well as windings 2600(3) and 2600(4) each have a common width 2904. Width 2904 is, for example, at least 1.5 millimeters. End magnetic element 2410(2) is illustrated as being partially transparent in FIG. 29 in order to show ends 2902(1) and 2902(2) of windings 2600(3) and 2600(4), respectively. Although coupled inductor 2400(2) is illustrated in FIG. 29 as having two phases, coupled inductor 2400(2) may have greater than two phases.

Figure 30:
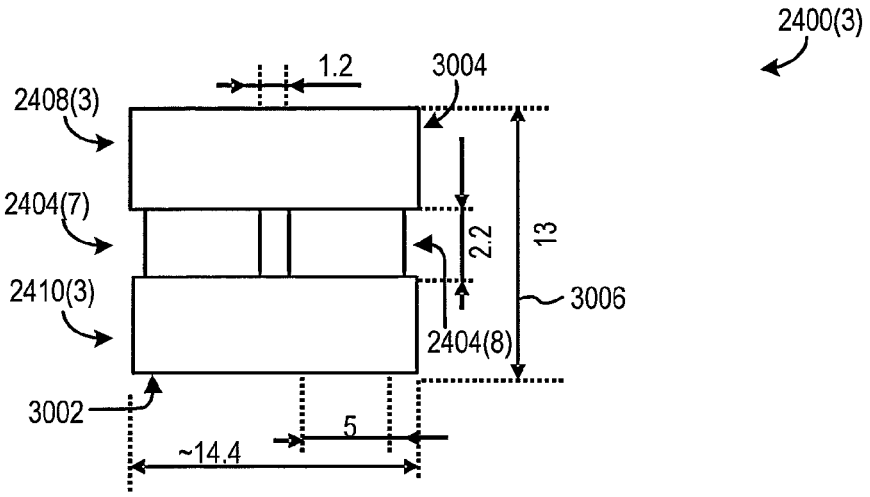
FIG. 30 is a top plan view of another embodiment of the coupled inductor of FIG. 24.

FIG. 30 is a top plan view of one coupled inductor 2400(3), which is another embodiment of coupled inductor 2400 of FIG. 24. Coupled inductor 2400(3) includes end magnetic elements 2408(3) and 2410(3) as well as legs 2404(7) and 2404(8). Coupled inductor 2400(3) is shown in FIG. 30 with dimensions specified in millimeters. However, it should be noted that the dimensions of coupled inductor 2400(3) are exemplary and may be varied as a matter of design choice. Coupled inductor 2400(3) may have, for example, a relatively small width 3006 of about 13 millimeters.

Figure 31:
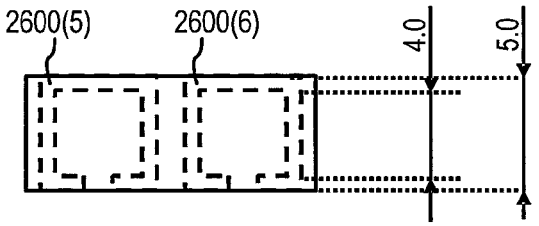
FIG. 31 is a plan view of one side of the coupled inductor of FIG. 30.
Figure 32:
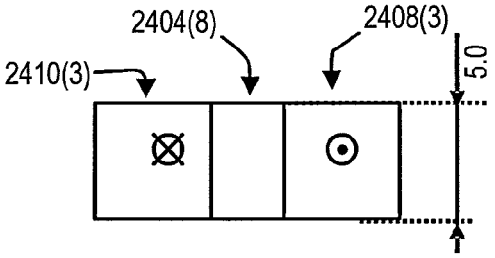
FIG. 32 is a plan view of another side of the coupled inductor of FIG. 30.

FIG. 31 is a plan view of side 3002 of coupled inductor 2400(3) of FIG. 30. Elements visible in FIG. 31 include outlines of single turn windings 2600(5) and 2600(6), which are represented by dashed lines. Windings 2600(5) and 2600(6) are not shown in FIG. 30 in order to promote clarity. FIG. 32 is a plan view of side 3004 of coupled inductor 2400(3).

Figure 33:
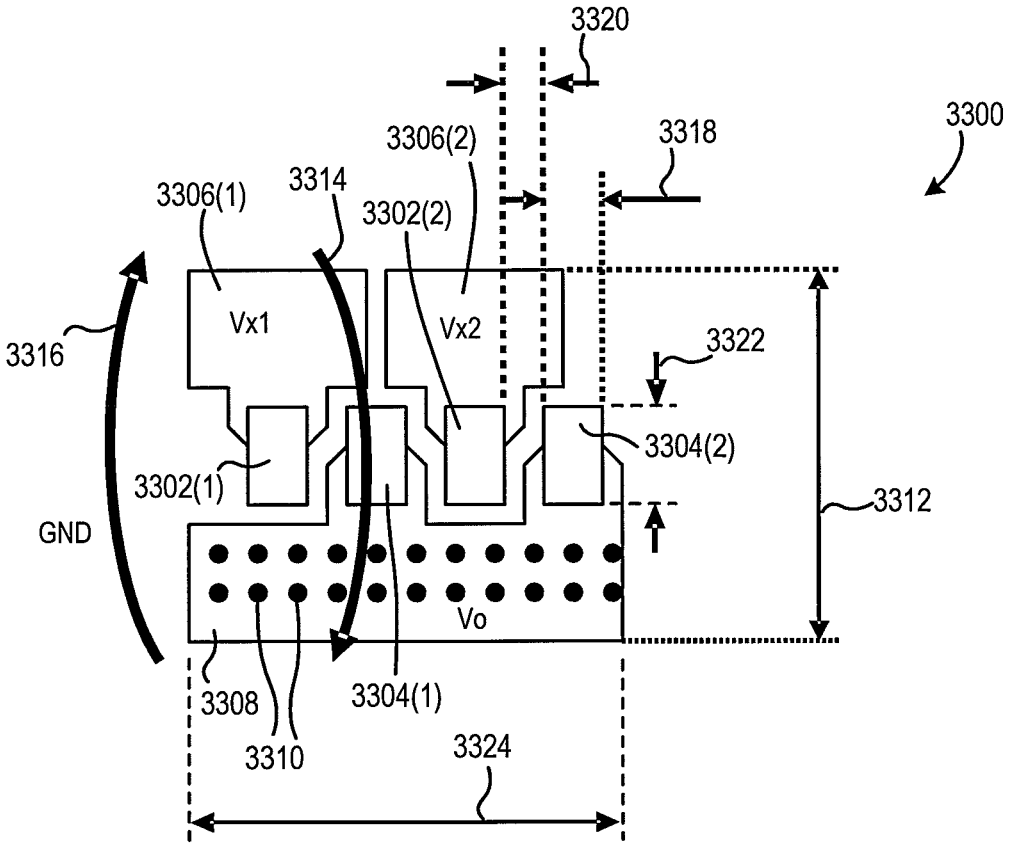
FIG. 33 is a top plan view of one PCB layout, according to an embodiment.

FIG. 33 is a top plan view of one PCB layout 3300. PCB layout 3300, which advantageously offers relatively low conduction losses as discussed below, may be used with embodiments of coupled inductor 2400 of FIG. 24 including windings 2600. Although the embodiment of layout 3300 illustrated in FIG. 33 is for a two phase embodiment of coupled inductor 2400, layout 3300 may be extended to three or more phases.

Layout 3300 includes one pad 3302 for a first terminal (e.g., solder tab 2610, FIG. 26) of each winding 2600. The configuration of coupled inductor 2400 including windings 2600 allows pads 3302 to be relatively small and thereby connect to relatively large respective switching node shapes 3306. The relatively large surface area of each switching node shape 3306 causes it to have a relatively low resistance, which helps minimize conduction losses resulting from current flowing therethrough.

Layout 3300 further includes one pad 3304 for a second terminal (e.g., solder tab 2612, FIG. 26) of each winding 2600. As with pads 3302, the configuration of coupled inductor 2400 with windings 2600 allows pads 3304 to be relatively small and thereby connect to a relatively large common output node shape 3308. The relatively large surface area of common output node shape 3308 causes it to have a relatively low resistance, which thereby helps minimize conduction losses when current flows therethrough. Furthermore, the relatively small size of pads 3304 allows a large number of vias 3310 (only some of which are labeled for illustrative clarity) connecting output node shape 3308 to one or more internal PCB layers to advantageously be disposed relatively close to pads 3304. Disposing a large number of vias 3310 close to pads 3304 further helps minimize conduction losses by providing a low resistance path between the coupled inductor and the one or more internal PCB layers.

In contrast to coupled inductor 2400 including windings 2600, some other coupled inductors require relatively large pads for connecting the inductor to a PCB. In many coupled inductor applications, the amount of PCB surface area available for mounting a coupled inductor is limited. The relatively large surface area required by the pads for the other coupled inductors reduces the amount of PCB surface area available for the shapes (e.g., shapes performing functions similar to those of 3306 and 3308) connected to such pads. Accordingly, such shapes of layouts for the other coupled inductors may have a higher resistance (and therefore a higher conduction loss) than shapes 3306 and 3308 of layout 3300.

Layout 3300 has dimensions appropriate for the embodiment of coupled inductor 2400 to be installed thereon. For example, in one embodiment of layout 3300, dimension 3312 is about 13 millimeters ("mm"), and dimension 3318 is about 2.5 mm. As another example, in another embodiment of layout 3300, dimension 3312 is about 17 mm, dimension 3322 is about 3 mm, dimension 3318 is about 2.5 mm, dimension 3320 is about 1 mm, and dimension 3324 is about 19 mm. However, it should be noted that such exemplary dimensions may be varied as a matter of design choice.

Some embodiments of coupled inductor 2400 have a relatively small width (e.g., width 3006, FIG. 30) which allows embodiments of layout 3300 to have a relatively small width 3312, such as 13 millimeters. Such small width advantageously reduces the distances current must flow across the coupled inductor and its layout as represented by arrows 3314 and 3316. Minimizing the distance current must flow in the PCB and the coupled inductor helps reduce conduction losses, especially losses in conductors of the PCB.

Figure 34:
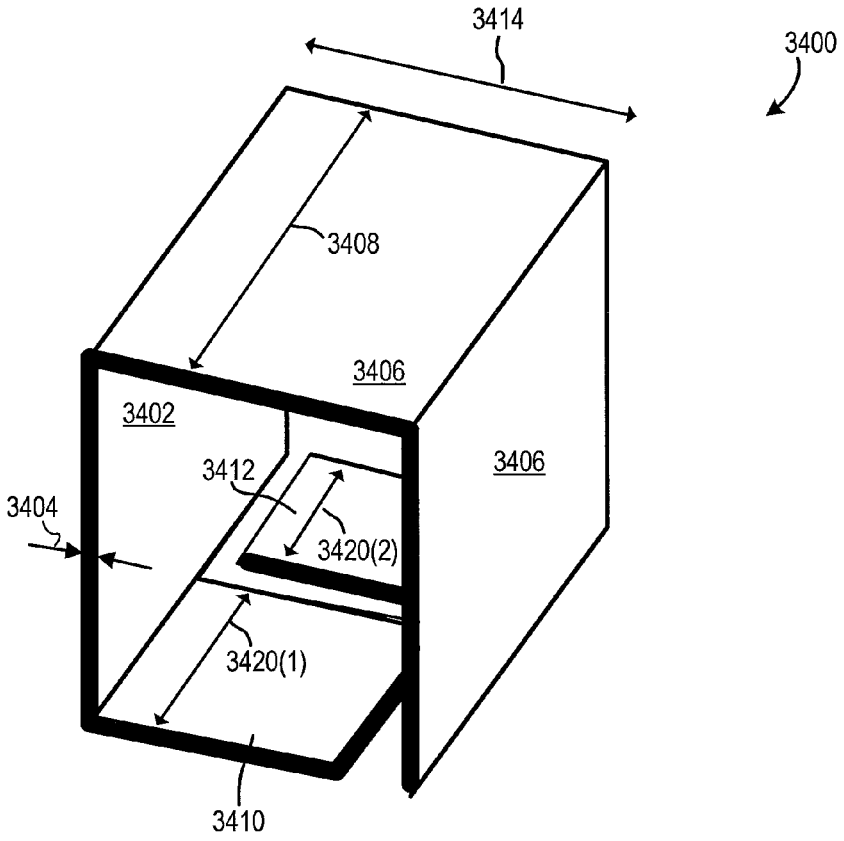
FIG. 34 is a side perspective view of another winding that may be used with the coupled inductor of FIG. 24, according to an embodiment.

FIG. 34 is a side perspective view of another winding 3400, which may be used in embodiments of coupled inductor 2400. Winding 3400, for example, has a substantially rectangular cross section. Winding 3400 includes an inner surface 3402 and an opposite outer surface 3406. It should be noted that only part of inner surface 3402 and outer surface 3406 are visible in the perspective view of FIG. 34. When windings 3400 are used in embodiments of coupled inductor 2400, inner surface 3402 of each winding 3400 is wound about an outer surface 2406 of a respective leg 2404. Thus, inner surface 3402 of each winding 3400 faces outer surface 2406 of the respective leg that the winding 3400 is wound at least partially about.

Winding 3400 has a width 3408 and a thickness 3404 orthogonal to inner surface 3402. Width 3408 is, for example, greater (e.g., at least two or five times greater) than thickness 3404. Thus, in some embodiments of winding 3400, the aspect ratio of winding 3400's cross section is at least two or at least five. When winding 3400 is wound about a respective leg 2404, winding 3400's width 3408 is for example parallel to and at least eighty percent of width 2402 of the leg. For example, winding 3400's width 3408 may be about equal to width 2402 of its respective leg 2404. Although winding 3400 is illustrated as forming a single turn, winding 3400 may form a plurality of turns and thereby be a multi-turn winding.

Winding 3400 may include two solder tabs 3410 and 3412, each having respective widths 3420(1) and 3420(2) parallel to width 3408 of winding 3400. Each of widths 3420(1) and 3420(2) are less than one half of width 3408 in order to prevent solder tabs 3410 and 3412 from touching and thereby electrically shorting. Solder tabs 3410 and 3412 may extend along the majority of depth 3414 of winding 3400, such feature may advantageously increase the surface area of a connection between solder tabs 3410 and 3412 and a PCB that winding 3400 is connected to. Solder tabs 3410 and 3412 are, for example, integral with winding 3400 as illustrated in FIG. 34.

Winding 3400 may be wound about a leg 2404 having a rectangular shape. In such case, winding 3400 will have five rectangular sections (including solder tabs 3410 and 3412) as illustrated in FIG. 34. However, winding 3400 could have a non-rectangular shape (e.g., a half circle) if wound about an embodiment of leg 2404 having a non-rectangular shape.

Figure 35:
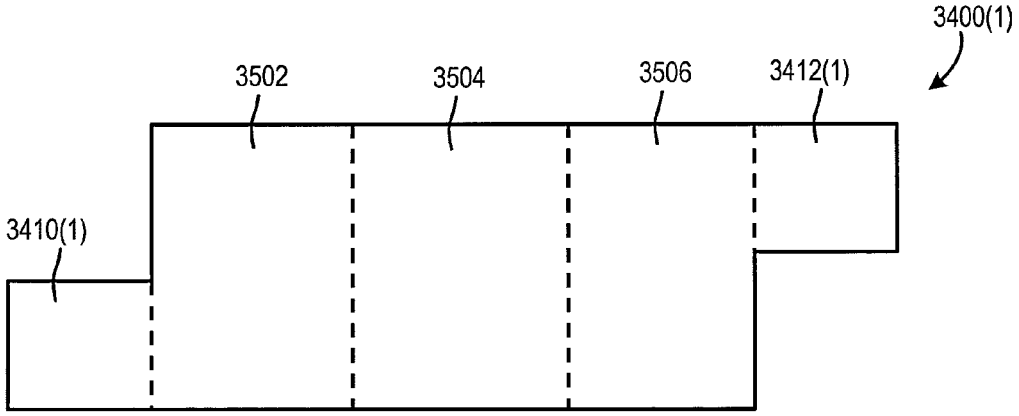
FIG. 35 is a top plan view of an embodiment of the winding of FIG. 34 before being wound about a leg of a magnetic core.

FIG. 35 is a top plan view of winding 3400(1), which is an embodiment of winding 3400 before being wound at least partially about a leg 2404 of coupled inductor 2400. The dashed lines in FIG. 35 indicate where winding 3400(1) would be folded if it were wound about a rectangular embodiment of leg 2404; in such case, winding 3400 would have rectangular sections 3502, 3504, and 3506 in addition to solder tabs 3410(1) and 3412(1) after being wound about the leg.

Figure 36:
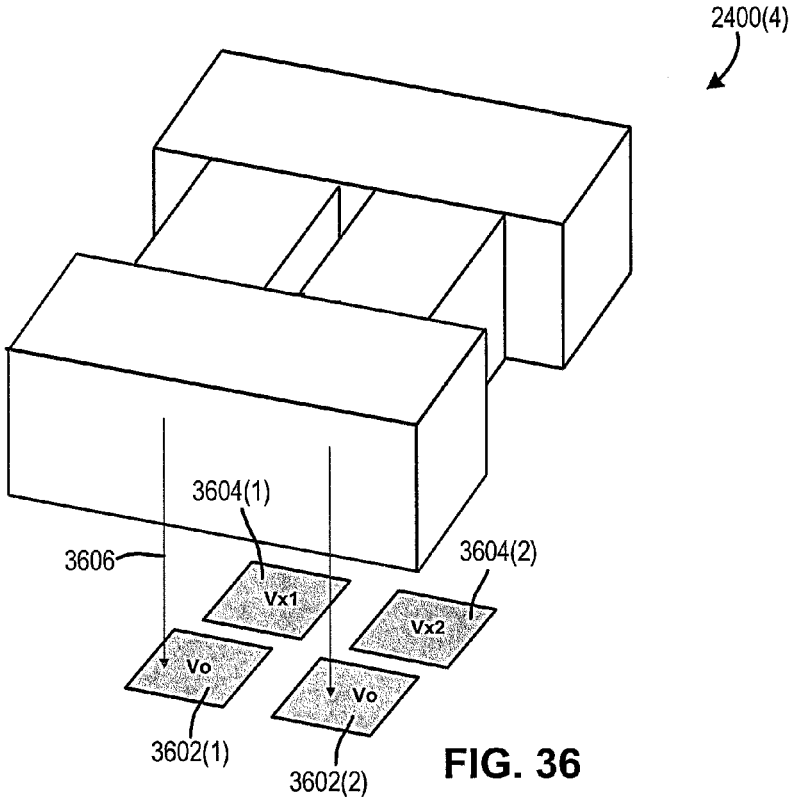
FIG. 36 shows another embodiment of the coupled inductor of FIG. 24 disposed above solder pads, according to an embodiment.

FIG. 36 is a side perspective view showing how an embodiment of coupled inductor 2400 using windings 3400 could interface with a printed circuit board. Specifically, FIG. 36 shows coupled inductor 2400(4) disposed above solder pads 3602 and 3604. Although coupled inductor 2400(4) is illustrated as having two phases, coupled inductor 2400(4) could have greater than two phases.

Coupled inductor 2400(4) includes one instance of winding 3400 for each phase; however, windings 3400 are not shown in FIG. 36 in order to promote illustrative clarity. Arrows 3606 indicate how solder tabs 3410 and 3412 (not shown in FIG. 36) would align with solder pads 3602 and 3604, respectively. Solder pads 3602(1) and 3602(2) connect to a common output node, and solder pads 3604(1) and 3604(2) connect to respective switching nodes.

Figure 37:
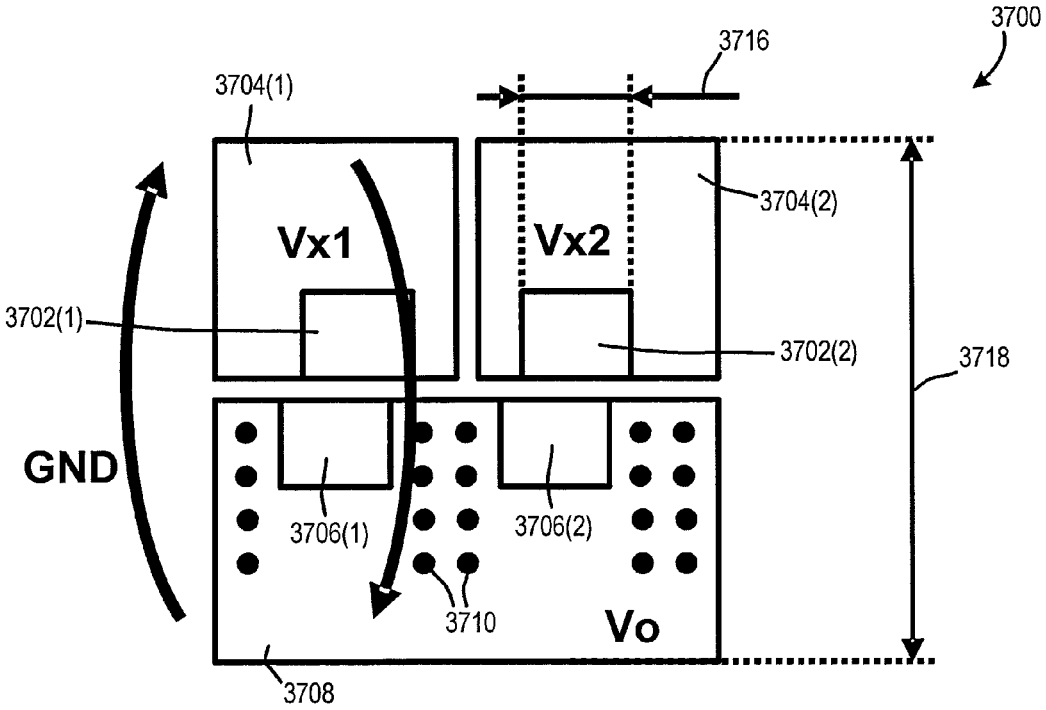
FIG. 37 is a top plan view of one PCB layout, according to an embodiment.

FIG. 37 is a top plan view of one PCB layout 3700, which may be used with embodiments of coupled inductor 2400 including windings 3400 (e.g., coupled inductor 2400(4) of FIG. 36). Although layout 3700 is illustrated as supporting two phases, other embodiments of layout 3700 may support greater than two phases.

Layout 3700 includes pads 3702(1) and 3702(2) for connecting solder tabs 3412 of windings 3400 to respective inductor switching nodes. Each of pads 3702(1) and 3702(2) is connected to a respective switching node shape 3704(1) and 3704(2). Layout 3700 further includes pads 3706(1) and 3706(2) for connecting solder tabs 3410 of windings 3400 to a common output node. Each of pads 3706(1) and 3706(2) is connected to a common output node shape 3708; shape 3708 may be connected to another layer of the PCB using vias 3710 (only some of which are labeled for clarity). Dimensions 3716 and 3718 are, for example, 5 millimeters and 17 millimeters respectively.

Layout 3700 advantageously facilitates locating pads 3702 close to respective switching node circuitry and pads 3706 close to output circuitry. Layout 3700 also allows switching node shapes 3704 and output node shape 3708 to have relatively large surface areas, thereby helping reduce conduction losses resulting from current flowing through such shapes.

Figure 38:
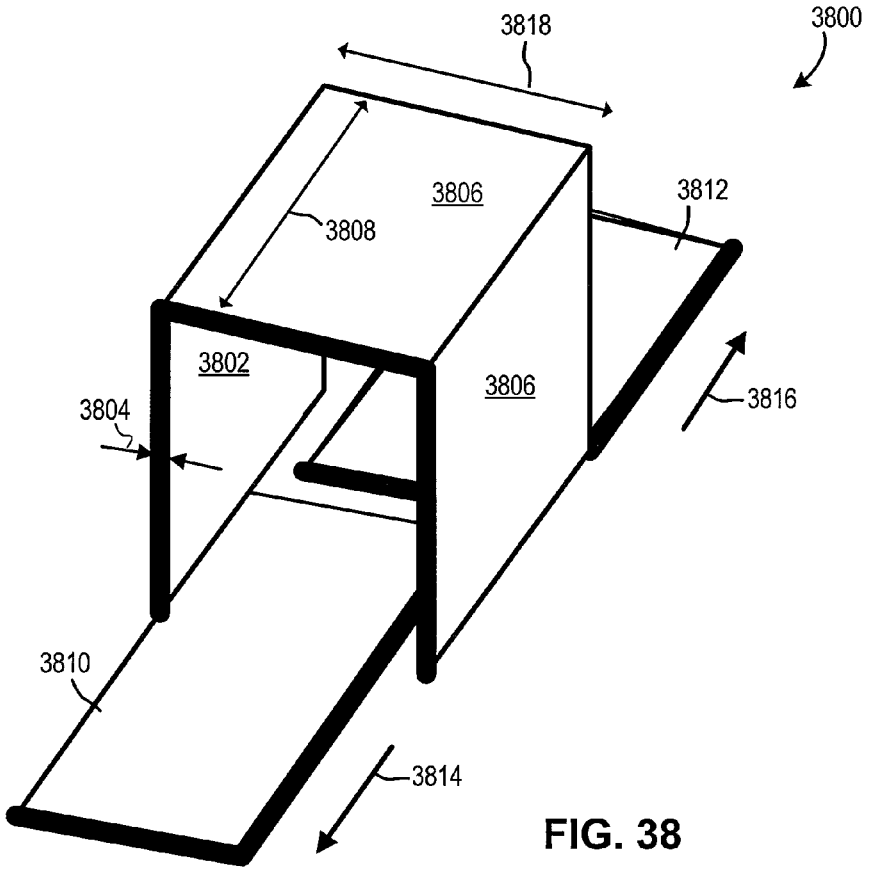
FIG. 38 is a side perspective view of another winding that may be used with the coupled inductor of FIG. 24, according to an embodiment.

FIG. 38 is a side perspective view of one winding 3800, which may be used in embodiments of coupled inductor 2400. Winding 3800 has, for example, a substantially rectangular cross section. Winding 3800 includes an inner surface 3802 and an opposite outer surface 3806. It should be noted that only part of inner surface 3802 and outer surface 3806 are visible in the perspective view of FIG. 38. When windings 3800 are used in embodiments of coupled inductor 2400, the inner surface 3802 of each winding 3800 is wound about an outer surface 2406 of a respective leg 2404. Thus, inner surface 3802 of winding 3800 faces outer surface 2406 of the respective leg that the winding is wound at least partially about.

Winding 3800 has a width 3808 and a thickness 3804 orthogonal to inner surface 3802. Width 3808 is, for example, greater (e.g., at least two or five times greater) than thickness 3804. Accordingly, some embodiments of winding 3800 have an aspect ratio of at least two or at least five. When winding 3800 is wound about a respective leg 2404, winding 3800's width 3808 is for example parallel to and is least eighty percent of width 2402 of the leg. For example, width 3808 may be about equal to width 2402 of its respective leg. Although winding 3800 is illustrated as forming single turn, winding 3800 may form a plurality of turns and thereby be a multi-turn winding.

Winding 3800 may include two solder tabs 3810 and 3812. Solder tab 3810 extends away from winding 3800 in the direction indicated by arrow 3814, and solder tab 3812 extends away from winding 3800 in the direction indicated by arrow 3816. Thus, solder tabs 3810 and 3812 extend beyond winding 3800 in a direction parallel to width 3808 of winding 3800. Solder tabs 3810 and 3812 may extend along the majority of depth 3818 of winding 3800, such feature may advantageously increase the surface area of a connection between solder tabs 3810 and 3812 and a PCB that winding 3800 is connected to. Solder tabs 3810 and 3812 are, for example, integral with winding 3800 as illustrated in FIG. 38.

Winding 3800 may be wound about a leg 2404 having a rectangular shape. In such case, winding 3800 will have five rectangular sections (including solder tabs 3810 and 3812) as illustrated in FIG. 38. However, winding 3800 could have a non-rectangular shape (e.g., a half circle) if wound about an embodiment of leg 2404 having a non-rectangular shape.

Figure 39:
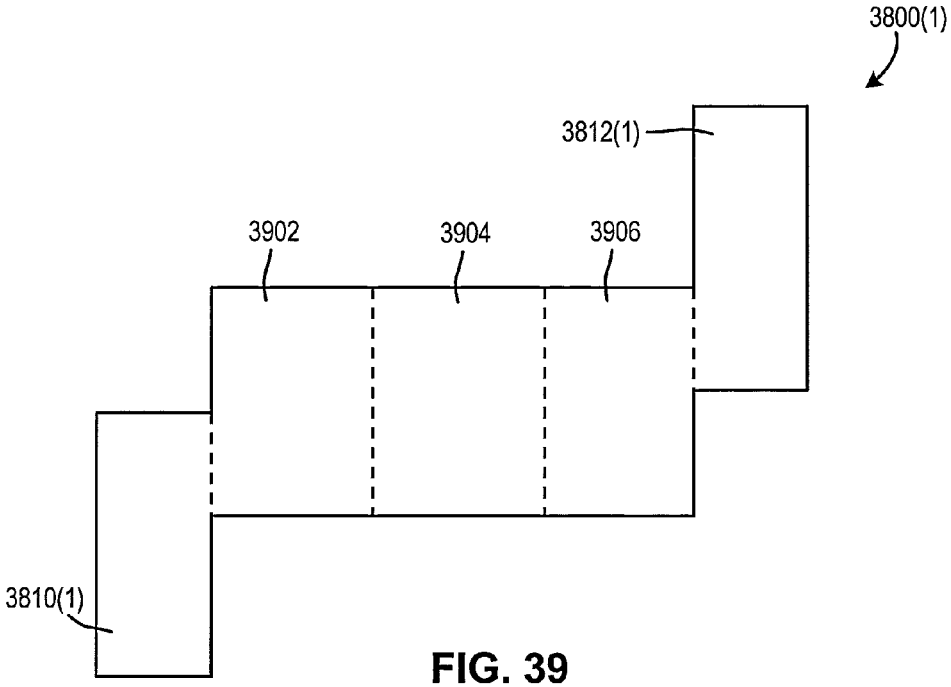
FIG. 39 is a top plan view of an embodiment of the winding of FIG. 38 before being wound about a leg of a magnetic core.

FIG. 39 is a top plan view of winding 3800(1), which is an embodiment of winding 3800 before being wound at least partially about a leg 2404 of coupled inductor 2400. The dashed lines in FIG. 39 indicate where winding 3800(1) would be folded if it were wound about a rectangular embodiment of leg 2404; in such case, winding 3800 would have rectangular sections 3902, 3904, and 3906 in addition to solder tabs 3810(1) and 3812(1) after being wound about the leg.

Figure 40:
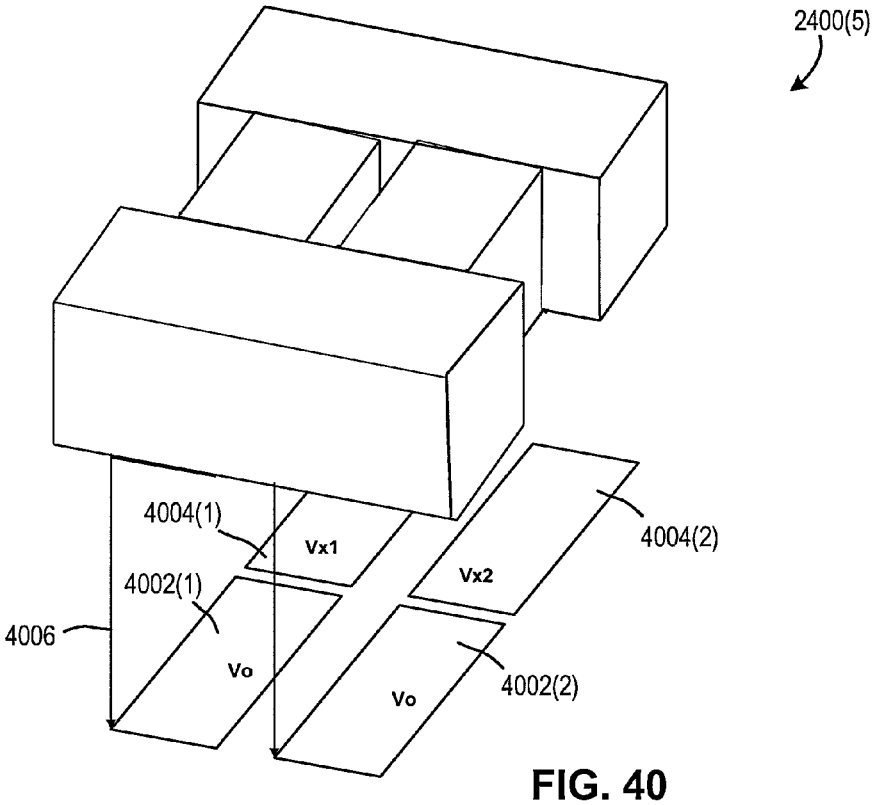
FIG. 40 shows another embodiment of the coupled inductor of FIG. 24 disposed above solder pads, according to an embodiment.

FIG. 40 is a side perspective view showing how an embodiment of coupled inductor 2400 including windings 3800 could interface with a printed circuit board. In particular, FIG. 40 shows coupled inductor 2400(5) disposed above solder pads 4002 and 4004. Although coupled inductor 2400(5) is illustrated as having two phases, coupled inductor 2400(5) could have greater than two phases.

Coupled inductor 2400(5) includes one instance of winding 3800 for each phase. However, the windings are not shown in FIG. 40 in order to promote clarity. Arrows 4006 indicate how solder tabs 3810 and 3812 (not shown in FIG. 40) would align with solder pads 4002 and 4004, respectively. Solder pads 4002(1) and 4002(2) connect to a common output node, and solder pads 4004(1) and 4004(2) connect to respective switching nodes.

Figure 41:
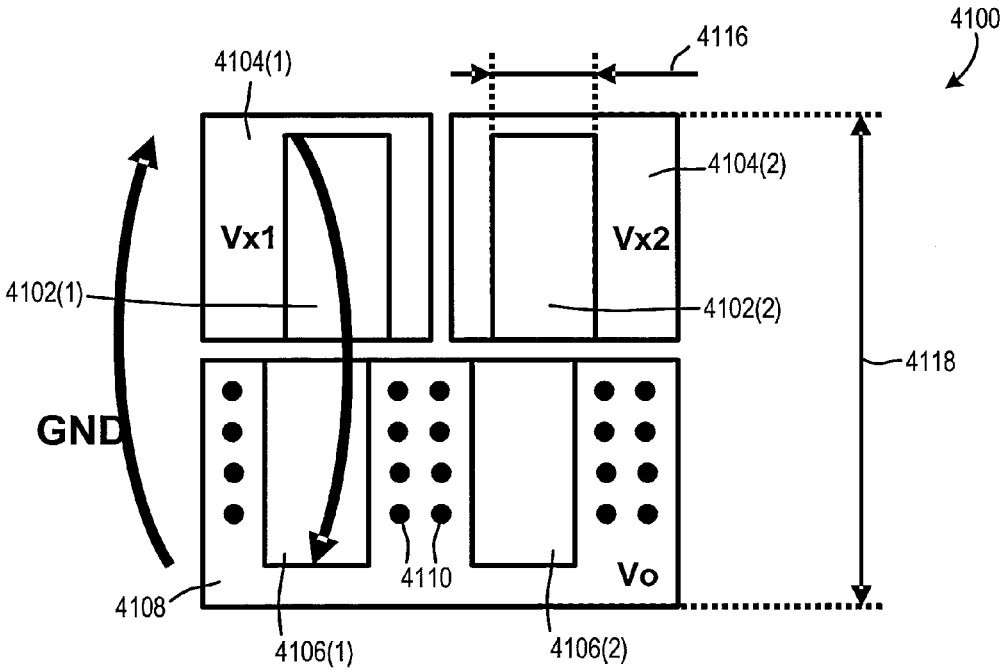
FIG. 41 is a top plan view of one PCB layout, according to an embodiment.

FIG. 41 is a top plan view of one printed circuit board layout 4100, which may be used with embodiments of coupled inductor 2400 including windings 3800 (e.g., coupled inductor 2400(5) of FIG. 40). Although layout 4100 is illustrated as supporting two phases, other embodiments of layout 4100 may support more than two phases.

Layout 4100 includes pads 4102(1) and 4102(2) for connecting solder tabs 3812 of windings 3800 to respective switching nodes. Each of pads 4102(1) and 4102(2) is connected to a respective switching node shape 4104(1) and 4104(2). Layout 4100 further includes pads 4106(1) and 4106(2) for connecting solder tabs 3810 of windings 3800 to a common output node. Each of pads 4106(1) and 4106(2) is connected to a common output node shape 4108; shape 4108 may be connected to another layer of the PCB using vias 4110 (only some of which are labeled for clarity). Dimensions 4116 and 4118 are, for example, 5 millimeters and 17 millimeters respectively.

Layout 4100 advantageously facilitates locating pads 4102 close to respective switching node circuitry and allows pads 4102 to extend towards respective switching circuitry. Additionally, layout 4100 facilitates locating pads 4106 close to output circuitry and allows pads 4106 to extend towards the output circuitry. Furthermore, layout 4100 also allows switching node shapes 4104 and output node shape 4108 to have relatively large surface areas, thereby helping reduce conduction losses resulting from current flowing through such shapes.

Figure 42:
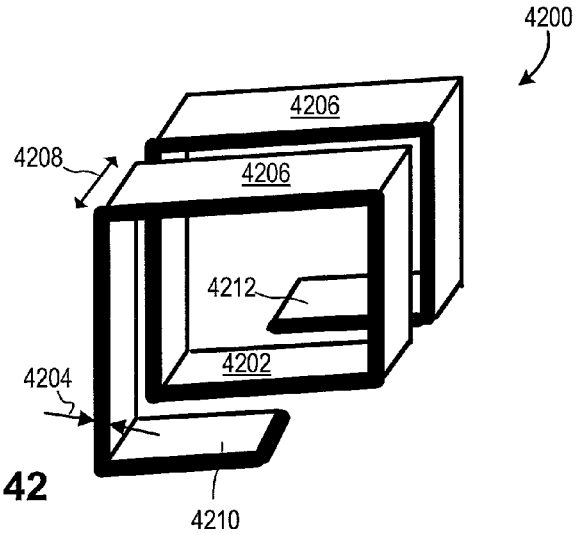
FIG. 42 is a side perspective view of another winding that may be used with the coupled inductor of FIG. 24, according to an embodiment.

FIG. 42 is a side perspective view of one winding 4200, which may be used in embodiments of coupled inductor 2400. Winding 4200 is a multi-turn winding. Although winding 4200 is illustrated in FIG. 42 as forming two turns, winding 4200 can form more than two turns.

Winding 4200, for example, has a substantially rectangular cross section. Winding 4200 includes an inner surface 4202 and an opposite outer surface 4206. It should be noted that only part of inner surface 4202 and outer surface 4206 are visible in the perspective view of FIG. 42. When windings 4200 are used in embodiments of coupled inductor 2400, the inner surface 4202 of each winding 4200 is wound about an outer surface 2406 of a respective leg 2404. Thus, inner surface 4202 of winding 4200 faces outer surface 2406 of the respective leg that the winding is wound at least partially about.

Winding 4200 has a width 4208 and a thickness 4204 orthogonal to inner surface 4202. Width 4208 is greater (e.g., at least two or five times greater) than thickness 4204. Accordingly, some embodiments of winding 4200 have an aspect ratio of at least two or at least five. Winding 4200 is, for example, formed of a metallic foil.

Winding 4200 may further include solder tabs 4210 and 4212 for connecting winding 4200 to a printed circuit board. Solder tabs 4210 and 4212 are, for example, rectangular and extend along a bottom surface of a respective leg 2404 that the winding 4200 is wound at least partially about. Additionally, solder tabs 4210 and/or 4212 may be extended (not shown in FIG. 42) to increase printed circuit board contact area. Solder tabs 4210 and 4212 are, for example, integral with winding 4200.

Figure 43:
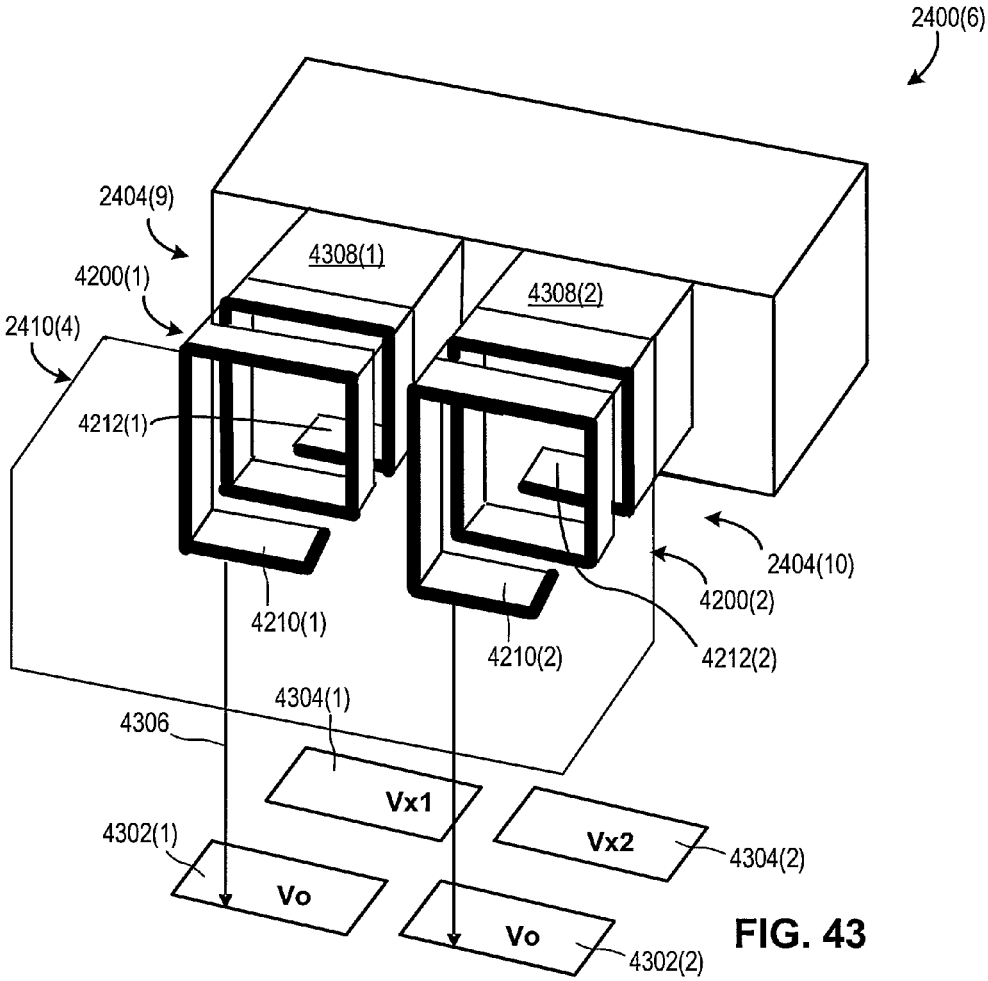
FIG. 43 shows another embodiment of the coupled inductor of FIG. 24 disposed above solder pads, according to an embodiment.

FIG. 43 is a side perspective view showing how an embodiment of coupled inductor 2400 including windings 4200 could interface with a printed circuit board. In particular, FIG. 43 shows coupled inductor 2400(6) disposed above solder pads 4302 and 4304. Coupled inductor 2400(6) is illustrated in FIG. 43 with end magnetic element 2410(4) being transparent in order to show windings 4200(1) and 4200(2). Although coupled inductor 2400(6) is illustrated as having two phases, coupled inductor 2400(6) could have greater than two phases. In coupled inductor 2400(6), winding 4200(1) extends diagonally across a portion of outer surface 4308(1) of leg 2404(9), and winding 4200(2) extends diagonally across a portion of outer surface 4308(2) of leg 2404(10).

Arrows 4306 indicate how solder tabs 4210(1) and 4210(2) would align with respective solder pads 4302(1) and 4302(2) and how solder tabs 4212(1) and 4212(2) would align with respective solder pads 4304(1) and 4304(2). Solder pads 4302(1) and 4302(2) connect to a common output node, and solder pads 4304(1) and 4304(2) connect to respective switching nodes.

As discussed above, each winding (e.g., winding 2600, 3400, 3800, or 4200) of coupled inductor 2400 is at least partially wound about a respective leg 2404 such that each winding's inner surface is adjacent to outer surface 2406 of the respective leg. Accordingly, the inner surface of the winding forms the smallest loop within the winding. However, as noted above, each winding's width may be greater than the winding's thickness. For example, winding 2600's width 2608 is greater than its thickness 2604. Therefore, each winding is configured such that a significant portion of its cross-sectional area is distributed along its inner surface (e.g., inner surface 2602 of winding 2600). As a result, although AC current will be most densely distributed near the inner surface in order to minimize inductance, a significant portion of the winding's cross-sectional area will still conduct such AC current because a significant portion of the winding's cross-sectional area is predominately distributed along the inner surface. Accordingly, the configuration of the windings in coupled inductor 2400 helps reduce the winding's $R_{AC}$. The configuration of the windings may be contrasted to that of winding 2200 of FIG. 22 where inductive effects may cause AC current to be confined to a relatively small portion of winding 2200's cross-sectional area. For example, an embodiment of winding 2600 having a width 2608 of 3.0 millimeters and a thickness 2604 of 0.5 millimeters may have a value of $R_{AC}$ that is approximately 8 times less than an embodiment of winding 2200 having a width 2206 of 2.2 millimeters and a thickness 2302 of 0.5 millimeters.

Additionally, as discussed above, each winding of coupled inductor 2400 may have a width that is greater than the winding's thickness. Accordingly, such embodiments of windings of coupled inductor 2400 do not have a completely symmetrical cross section. Such configuration of the windings results in a larger portion of their cross-sectional area being close to a surface of the winding. For example, the configuration of winding 2600 results in a relatively large portion of its cross-sectional area being relatively close to surfaces 2602 or 2606. Accordingly, the configuration of the windings of coupled inductor 2400 helps reduce the impact of the skin effect on the windings' current conduction, thereby helping reduce their $R_{AC}$.

Additionally, in some embodiments of coupled inductor 2400, the windings span essentially the entire width 2402 of legs 2404. Accordingly, the windings of coupled inductor 2400 may be relatively wide, and therefore have a relative low $R_{DC}$. Furthermore, the configuration of coupled inductor 2400 and its windings may allow embodiments of its windings to be shorter and thereby have a lower $R_{DC}$ than windings of prior art coupled inductors.

Figure 44:
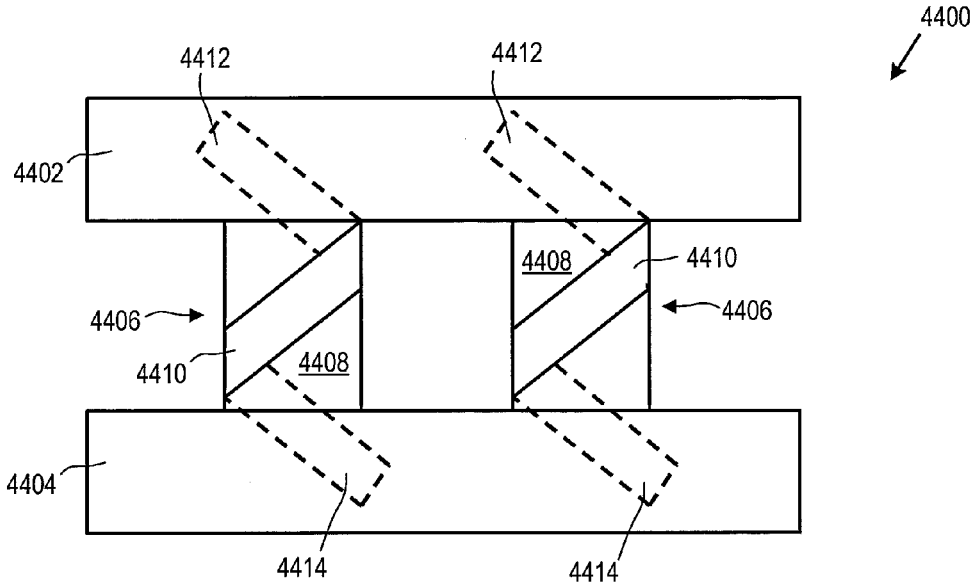
FIG. 44 is a top plan view of one M-phase coupled inductor, according to an embodiment.

FIG. 44 is a top plan view of one M-phase coupled inductor 4400, where M is an integer greater than one. Coupled inductor 4400 may, for example, serve as inductor 28 of FIG. 1. Although coupled inductor 4400 is illustrated in FIG. 44 as having two phases, some embodiments of inductor 4400 have greater than two phases.

Coupled inductor 4400 includes a magnetic core including end magnetic elements 4402 and 4404 and M rectangular legs 4406 disposed between end magnetic elements 4402 and 4404. Legs 4406 connect end magnetic elements 4402 and 4404, and each of legs 4406 has an outer surface including a top surface 4408 (e.g., a planar surface) and a bottom surface (e.g., a planar surface), which is not visible in the top plan view of FIG. 44. The magnetic core of coupled inductor 4400 is formed, for example, of a ferrite material, a powdered iron material, or a Kool-μ® material. Although FIG. 44 illustrates end magnetic elements 4402 and 4404 as well as legs 4406 as being discrete elements, two or more of the elements may be combined. Furthermore, at least one of end magnetic elements 4402 and 4404 as well as legs 4406 may be divided.

Figure 45:
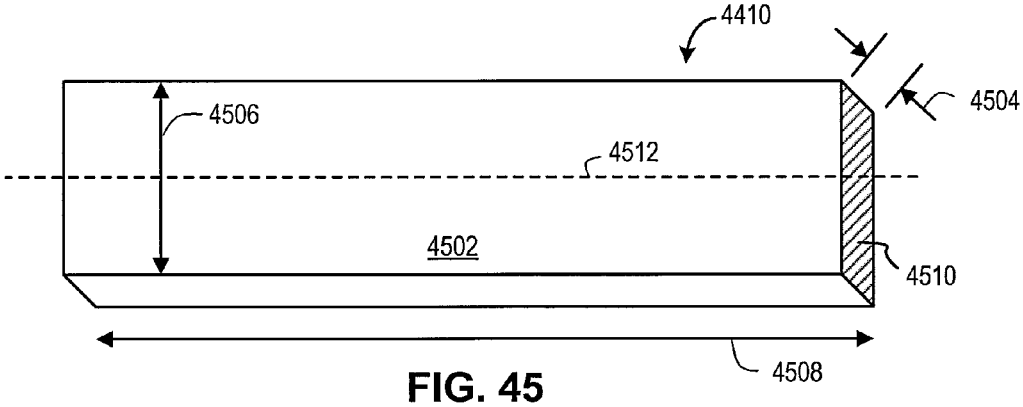
FIG. 45 is a bottom perspective view of an embodiment of a winding of the coupled inductor of FIG. 44 before being wound about a leg of the coupled inductor.

Coupled inductor 4400 further includes M windings 4410, which are magnetically coupled together. Windings 4410, for example, have a substantially rectangular cross section. FIG. 45 is a bottom perspective view of an embodiment of winding 4410 before being wound about a leg 4406 of coupled inductor 4400. Winding 4410 has an inner surface 4502, a thickness 4504 orthogonal to inner surface 4502, a width 4506, a length 4508, a center axis 4512 parallel to the winding's longest dimension or length 4508, and a cross section 4510. Width 4506 is greater than thickness 4504—such feature helps lower $R_{AC}$ as discussed below.

Each winding 4410 is wound at least partially about a respective leg 4406 such that inner surface 4502 of winding 4410 faces the outer surface of the leg. Furthermore, each winding 4410 diagonally crosses top surface 4408 of its respective leg. Although each winding 4410 is illustrated in FIG. 44 as forming a single turn, other embodiments of windings 4410 may form multiple turns.

Each winding 4410 may form a first solder tab 4412 and a second solder tab 4414 at respective ends of the winding. Solder tabs 4412 and 4414 are disposed along the bottom of coupled inductor 4400; however, their outline is denoted by dashed lines in FIG. 44. Each first solder tab 4412 diagonally crosses a portion of its respective leg's bottom surface (e.g., planar surface) to extend under end magnetic element 4402. Similarly, each second solder tab 4414 diagonally crosses a portion of its respective leg's bottom surface (e.g., planar surface) to extend under end magnetic element 4404. Solder tabs 4412 and 4414 are, for example, integral with winding 4410 as illustrated in FIG. 44.

Figure 46:
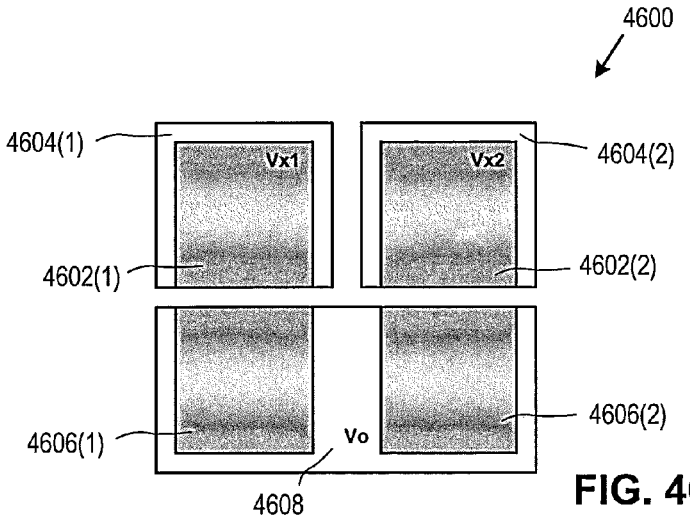
FIG. 46 is a top plan view of one PCB layout, according to an embodiment.

FIG. 46 is a top plan view of one PCB layout 4600 for embodiments of coupled inductor 4400. Layout 4600 is illustrated as supporting a two phase embodiment of coupled inductor 4400; however, layout 4600 can be extended to support more than two phases.

Layout 4600 includes pads 4602 for connecting solder tabs 4412 of windings 4410 to respective switching nodes. Each pad 4602 is connected to a respective switching node shape 4604. Layout 4600 further includes pads 4606 for connecting solder tabs 4414 to a common output node. Each pad 4606 is connected to a common output shape 4608. Layout 4600 advantageously permits pads 4602 and 4606 as well as shapes 4604 and 4608 to be relatively large. Furthermore, layout 4600 permits pads 4602 to be disposed close to switching circuitry and pads 4606 to be disposed close to output circuitry.

As discussed above, each winding 4410 of coupled inductor 4400 is at least partially wound about a respective leg 4406 such that each winding's inner surface 4502 faces the outer surface of the respective leg. Accordingly, the inner surface 4502 of winding 4410 forms the smallest loop within the winding. However, as noted above, each winding's width 4506 is greater than the winding's thickness 4504. Therefore, each winding is configured such that a large portion of its cross-sectional area is predominately distributed along its inner surface 4502. As a result, although AC current will be most densely distributed near inner surface 4502 in order to minimize inductance, a significant portion of the cross-sectional area of winding 4410 will still conduct such AC current because a large portion of the winding's cross-sectional area is predominately distributed along inner surface 4502. Accordingly, the configuration of the windings in coupled inductor 4400 helps reduce $R_{AC}$.

Additionally, as discussed above, embodiments of the windings of coupled inductor 4400 do not have a completely symmetrical cross section because their width 4506 is greater than their thickness 4504. Such configuration of winding 4410 results in a larger portion of its cross-sectional area being close to a surface of the winding, thereby helping reduce the impact of the skin effect on the winding's current conduction, in turn helping reduce its $R_{AC}$.

Furthermore, the fact that each winding 4410 diagonally crosses top surface 4408 of its respective leg and solder tabs 4412 and 4414 diagonally cross a portion of their respective leg's bottom surface helps reduce length 4508 of each winding 4410. Such reduction in length is advantageous because it helps reduce $R_{AC}$ and $R_{DC}$ of winding 4410.

Figure 47:
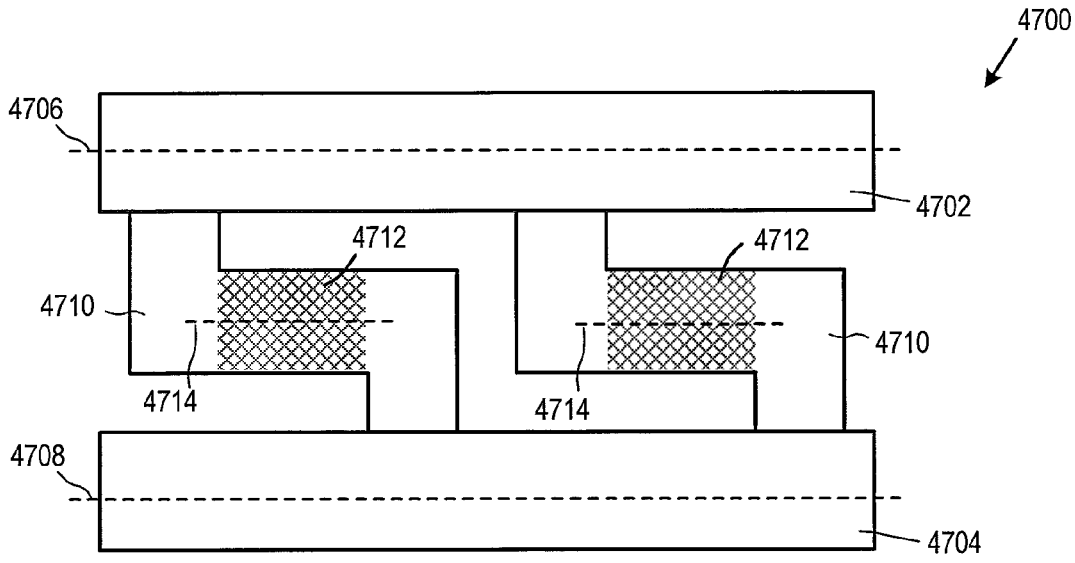
FIG. 47 is a top plan view of one M-phase coupled inductor, according to an embodiment.

FIG. 47 is a top plan view of one M-phase coupled inductor 4700, where M is an integer greater than one. Inductor 4700 may, for example, serve as inductor 28 of FIG. 1. Although coupled inductor 4700 is illustrated in FIG. 47 as having two phases, some embodiments of coupled inductor 4700 have greater than two phases.

Coupled inductor 4700 includes a magnetic core including a first end magnetic element 4702 and a second end magnetic element 4704. First end magnetic element 4702 has a center axis 4706 parallel to its longest dimension, and second end magnetic element 4704 has a center axis 4708 parallel to its longest dimension. Second end magnetic element 4704 is, for example, disposed such that its center axis 4708 is parallel to center axis 4706 of first end magnetic element 4702.

The magnetic core of coupled inductor 4700 further includes M legs 4710 disposed between first and second end magnetic elements 4702 and 4704. Each leg 4710 forms at least two turns. For example, legs 4710 are illustrated in FIG. 47 as each forming two turns where each turn is about ninety degrees. Legs 4710 connect first and second end magnetic elements 4702 and 4704, and each leg has a winding section 4712 that a respective winding is wound at least partially about. Top surfaces of windings sections 4712 are designated by crosshatched shading in FIG. 47. Each winding section 4712 has a center axis 4714 that is, for example, parallel to center axes 4706 and 4708 of first and second end magnetic elements 4702 and 4704, respectively. Each winding section 4712 has an outer surface. Winding sections 4712 have, for example, a rectangular shape. The magnetic core of coupled inductor 4700 is formed, for example, of a ferrite material, a powdered iron material, or a Kool-μ® material. Although FIG. 47 illustrates first end magnetic element 4702, second end magnetic element 4704, and legs 4710 as being discrete elements, two or more of these elements may be combined. Furthermore, one or more of these elements may be divided.

Figure 48:
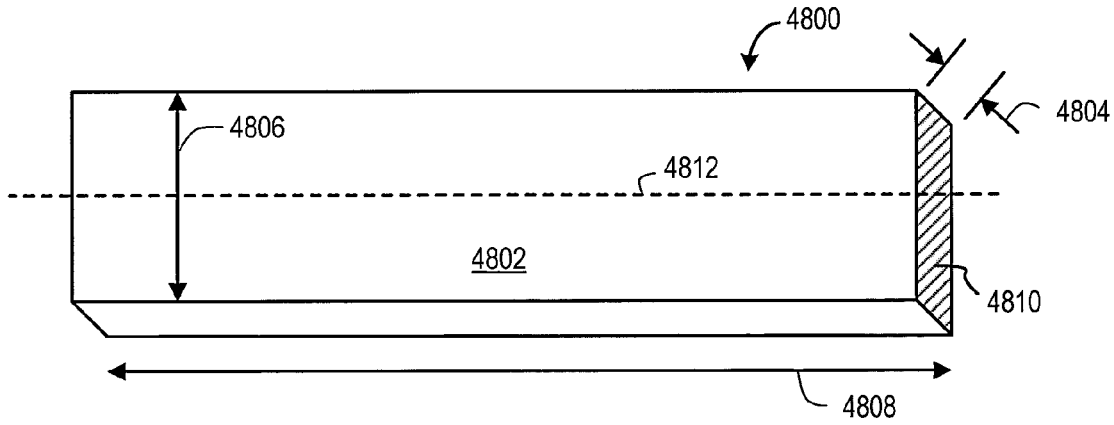
FIG. 48 is a bottom perspective view of a winding of the coupled inductor of FIG. 47 before being wound about a leg of the coupled inductor.

Coupled inductor 4700 further includes M windings 4800. FIG. 48 is a bottom perspective view of winding 4800 before being wound about a leg 4710 of coupled inductor 4700. Winding 4800, for example, has a substantially rectangular cross section 4810. Winding 4800 has an inner surface 4802, a thickness 4804 orthogonal to inner surface 4802, a width 4806, a length 4808, and a center axis 4812 parallel to the winding's longest dimension or length 4808. Width 4806 is, for example, greater than thickness 4804—such feature helps lower $R_{AC}$ as discussed below.

Each winding 4800 is wound at least partially about the winding section 4712 of a respective leg 4710 such that inner surface 4802 of winding 4800 faces the outer surface of the winding section 4712. Furthermore, the center axis 4812 of each winding 4800 is, for example, about perpendicular to center axes 4706 and 4708 of first and second end magnetic elements 4702 and 4704. Winding 4800 may form a single turn or a plurality of turns.

Each winding 4800 may form a solder tab (not shown in FIG. 48) at each end of the winding. Such solder tabs may be integral with winding 4800. Each solder tab may extend along a bottom surface (e.g., a planar surface) of one of first end magnetic element 4702 and second end magnetic element 4704.

Figure 49:
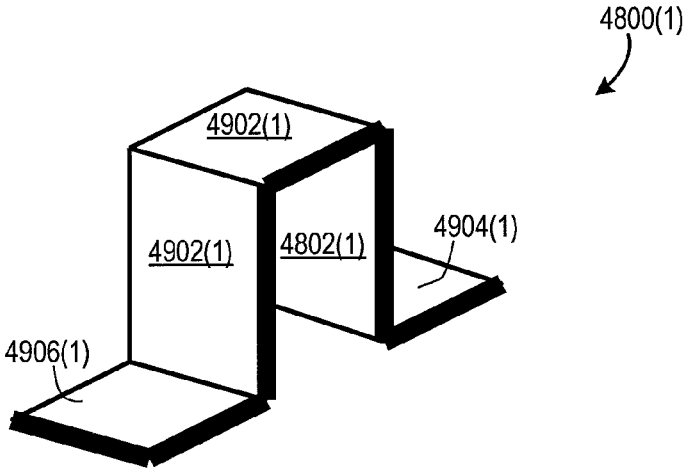
FIG. 49 is a side perspective view of one embodiment of the winding of FIG. 48.

FIG. 49 is a side perspective view of one winding 4800(1), which is an embodiment of winding 4800. Winding 4800(1) is illustrated in FIG. 49 as having the shape it would have after being partially wound about a respective winding section 4712 having a rectangular shape. Winding 4800(1) includes inner surface 4802(1) and an opposite outer surface 4902(1). When winding 4800(1) is wound about a respective winding section 4712, inner surface 4802(1) faces the winding section's outer surface. Also shown in FIG. 49 are first solder tab 4904(1) and second solder tab 4906(1). Solder tabs 4904(1) and 4906(1) are, for example, integral with winding 4800(1) as illustrated in FIG. 49.

Figure 50:
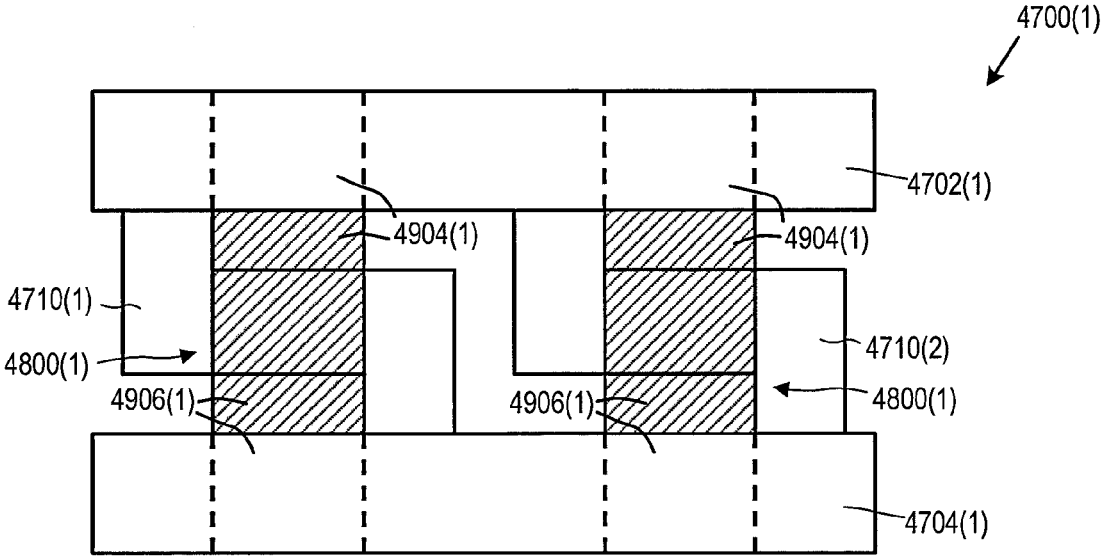
FIG. 50 is a top plan view of one embodiment of the coupled inductor of FIG. 47.

FIG. 50 is a top plan view of one embodiment of coupled inductor 4700(1) including M windings 4800(1) of FIG. 49. Although coupled inductor 4700(1) is illustrated in FIG. 50 as having two phases, coupled inductor 4700(1) may have more than two phases. Visible portions of windings 4800(1) are shown with cross shading in FIG. 50. The dashed lines indicate the outlines of first solder tabs 4904(1) extending under first end magnetic element 4702(1) and second solder tabs 4906(1) extending under second end magnetic element 4704 (1).

Figure 51:
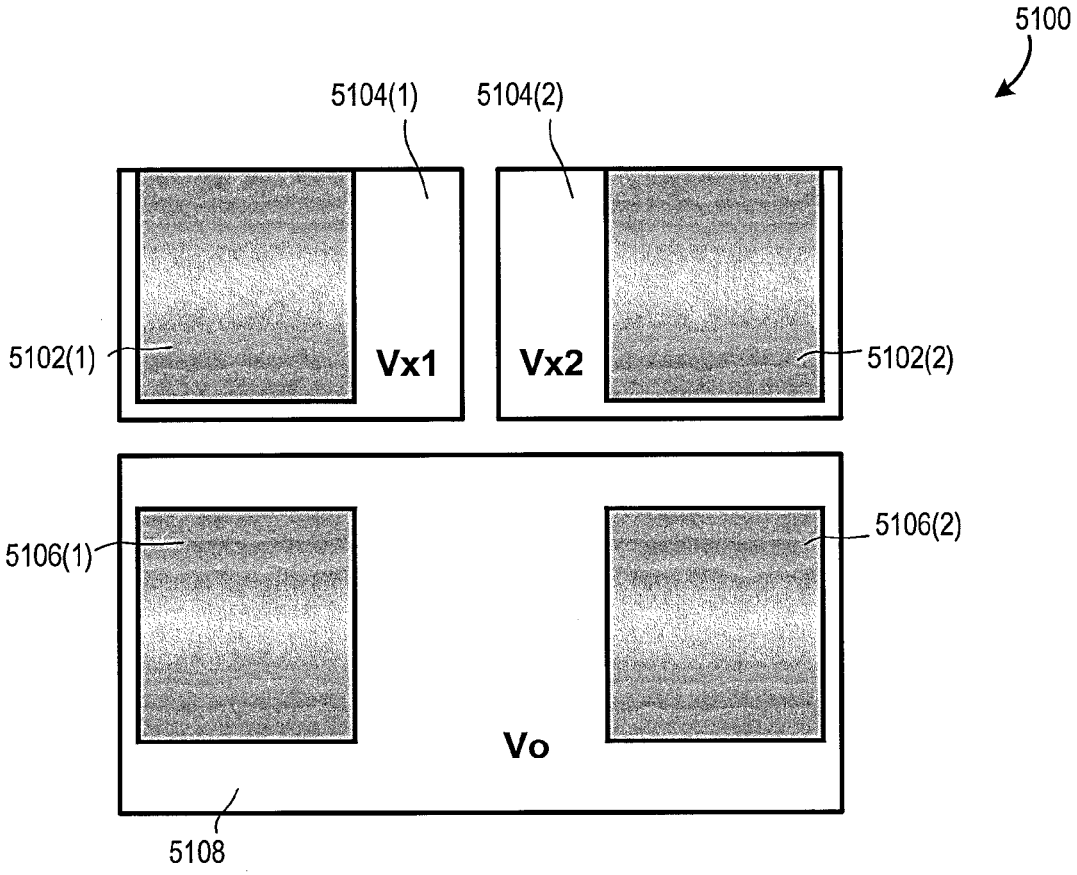
FIG. 51 is a top plan view of one PCB layout, according to an embodiment.

FIG. 51 is a top plan view of one layout 5100 for embodiments of coupled inductor 4700. Layout 5100 is illustrated as supporting a two phase embodiment of coupled inductor 4700; however, layout 5100 can be extended to support more than two phases.

Layout 5100 includes pads 5102 for connecting solder tabs (e.g., first solder tab 4904(1) of winding 4800(1), FIG. 49) of winding 4800 to respective switching nodes. Each pad 5102 is connected to a respective switching node shape 5104. Layout 5100 further includes pads 5106 for connecting solder tabs (e.g., second solder tab 4906(1) of winding 4800(1), FIG. 49) to a common output node. Each pad 5106 is connected to a common output shape 5108. Layout 5100 advantageously permits pads 5102 and 5106 as well as shapes 5104 and 5108 to be relatively large. Furthermore, layout 5100 permits pads 5102 to be disposed close to switching circuitry and pads 5106 to be disposed close to output circuitry.

As discussed above, each winding 4800 of coupled inductor 4700 is at least partially wound about the winding section of a respective leg 4710 such that each winding's inner surface 4802 is adjacent to the winding sections' outer surface. Accordingly, the inner surface 4802 of the winding 4800 forms the smallest loop within the winding. However, as noted above, each winding's width 4806 may be greater than the winding's thickness 4804. In such case, each winding is configured such that a large portion of its cross-sectional area is distributed along its inner surface 4802. As a result, although AC current will be most densely distributed near inner surface 4802 in order to minimize inductance, a significant portion of the winding's cross-sectional area will still conduct such AC current because a large portion of the winding's cross-sectional area is predominately distributed along inner surface 4802. Accordingly, the configuration of the windings 4800 in coupled inductor 4700 helps reduce $R_{AC}$.

Additionally, as discussed above, embodiments of windings 4800 of coupled inductor 4700 do not have a completely symmetrical cross section because their width 4806 is greater than their thickness 4804. Such configuration of winding 4800 results in a larger portion of its cross-sectional area being close to a surface of the winding, thereby helping reduce the impact of the skin effect on the winding's current conduction, in turn helping reduce its $R_{AC}$.

A coupled inductor has a magnetizing inductance, and each winding of the coupled inductor has a respective leakage inductance. In some applications of coupled inductors (e.g., coupled inductor 2400, 4400, 4700), such as in DC-to-DC converter applications, the leakage inductance values may be critical. For example, leakage inductance values may control the magnitude of the peak to peak ripple current flowing in the windings as well as the DC-to-DC converter's transient response. Accordingly, it may be desirable to control a coupled inductor's windings' leakage inductance values.

In coupled inductors such as coupled inductor 2400, 4400, or 4700, the leakage inductance values may be smaller than desired due to the windings being disposed close to one another. In order to control or increase the leakage inductance values, additional paths may be created for magnetic flux to flow through the core. Alternately or in addition, existing leakage flux conductance paths may be exaggerated.

Figure 52:
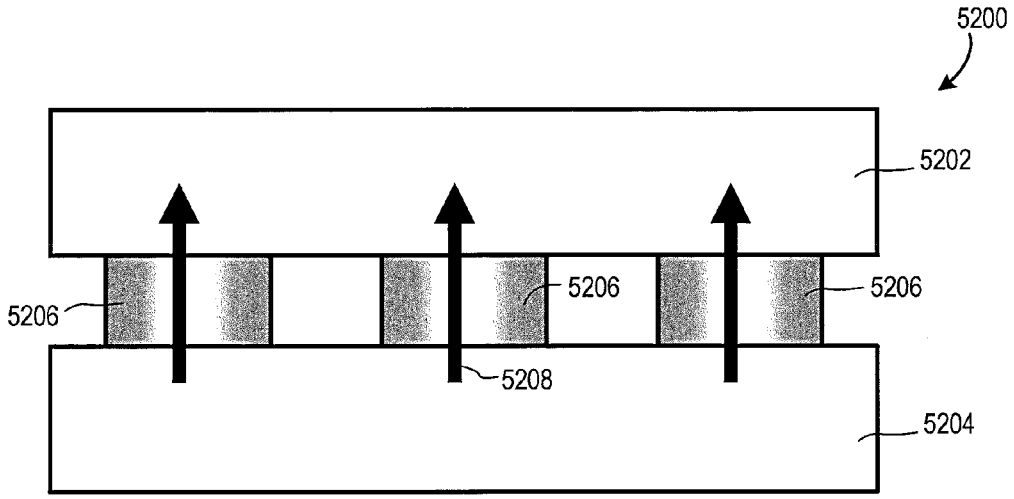
FIG. 52 is a top plan view of one magnetic core, according to an embodiment.
Figure 53:
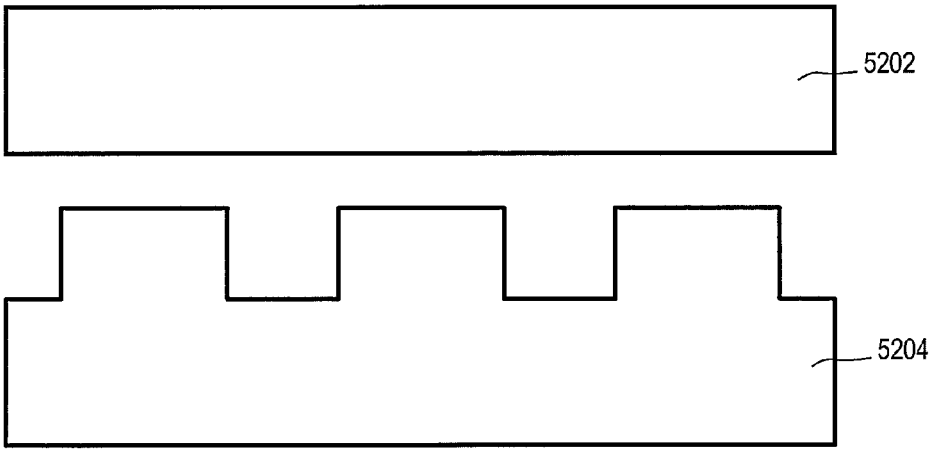
FIG. 53 is an exploded top plan view of the magnetic core of FIG. 52.

For example, FIG. 52 is a top plan view of a magnetic core 5200, and FIG. 53 is an exploded top plan view of magnetic core 5200. Magnetic core 5200, which is an embodiment of the magnetic core of coupled inductor 2400, includes end magnetic elements 5202 and 5204 as well as legs 5206. Upward pointing arrows 5208 represent magnetic flux flowing through legs 5206. Magnetic core 5200 could have two phases or more than three phases.

Figure 54:
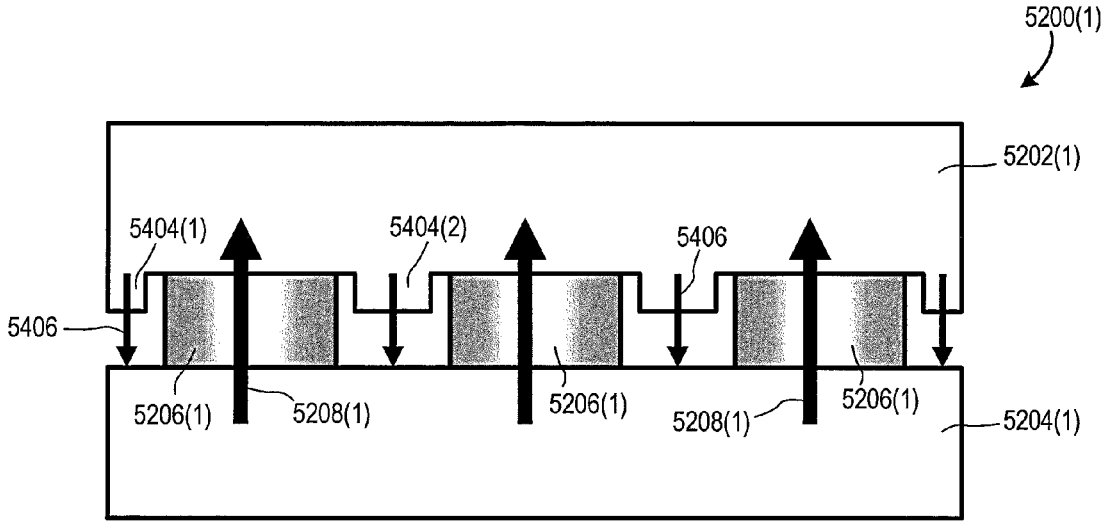
FIG. 54 is a top plan view of one embodiment of the magnetic core of FIG. 52.

In order to increase the leakage inductance values of a coupled inductor formed from magnetic core 5200, magnetic protrusions or extrusions may be added to exaggerate paths for leakage flux. For example, FIG. 54 is a top plan view of magnetic core 5200(1), which is an embodiment of magnetic core 5200 including M+1 magnetic protrusions 5404 (only some of which are labeled for clarity). Protrusions 5404 exaggerate the path of leakage flux 5406; thereby increasing the leakage inductance values of windings wound around legs 5206(1).

Figure 55:
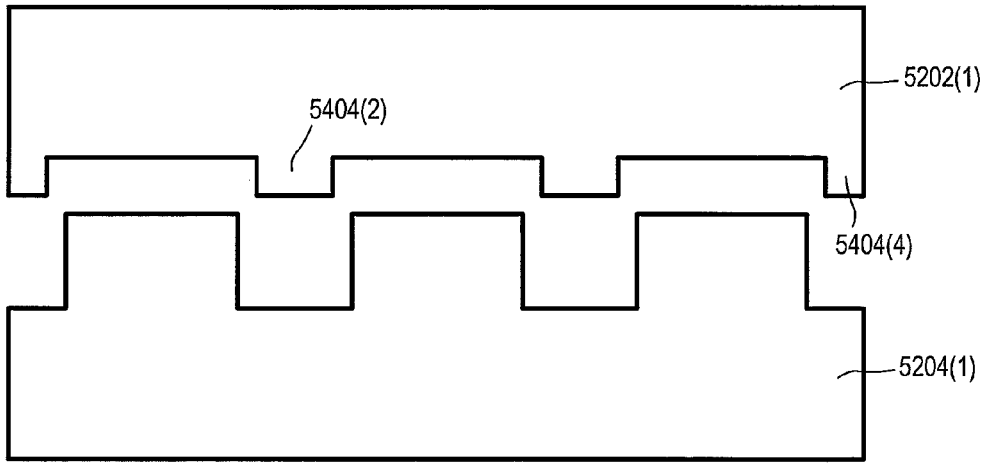
FIG. 55 is an exploded top plan view of the magnetic core of FIG. 54.

FIG. 55 is an exploded view of magnetic core 5200(1). It should be noted that protrusions 5404 may be integrally formed with end magnetic element 5202(1); alternately, protrusions 5404 may be separate elements affixed to end magnetic element 5202(1).

Figure 56:
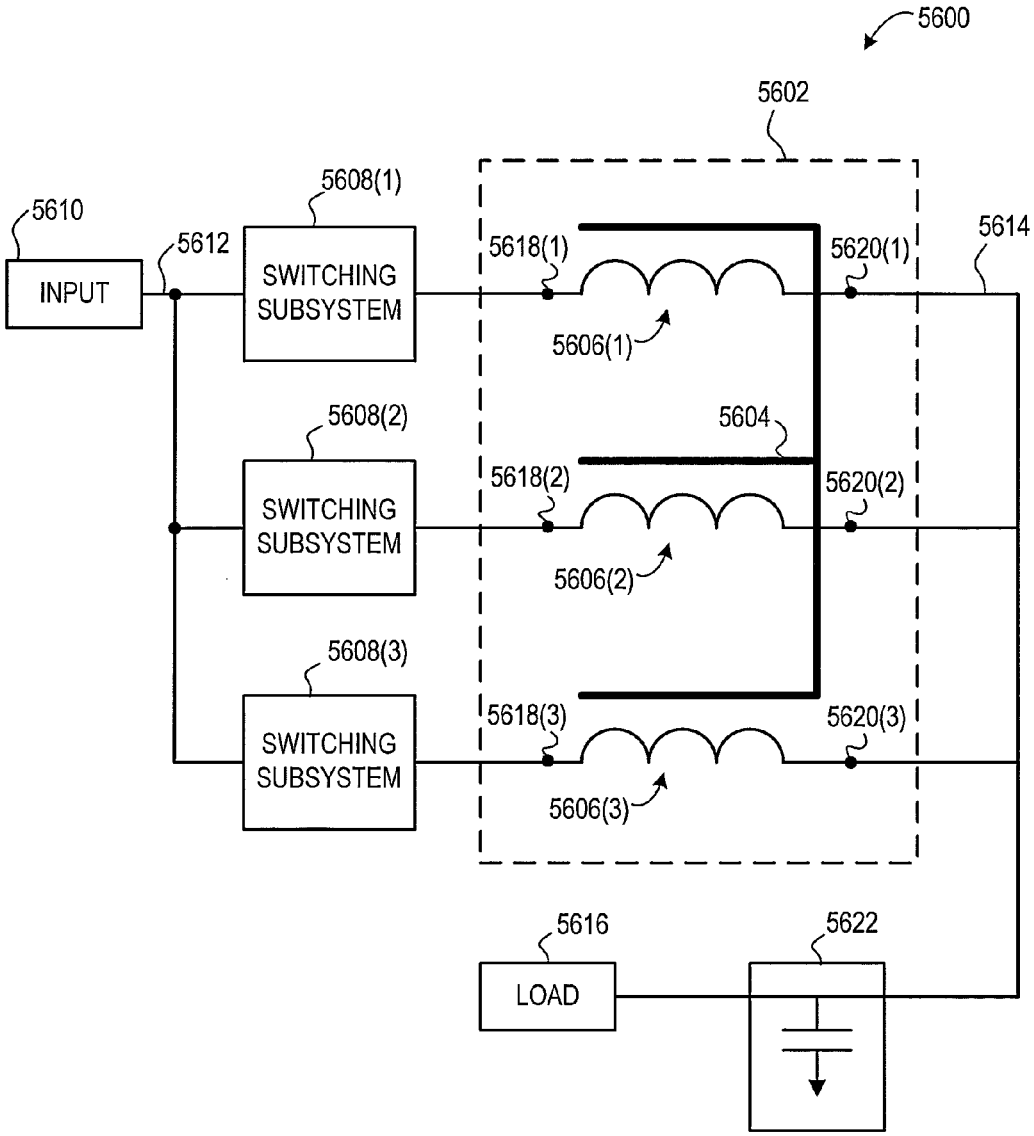
FIG. 56 schematically illustrates one multiphase DC-to-DC converter, according to an embodiment.

FIG. 56 schematically illustrates one multiphase DC-to-DC converter 5600, which is one example of an application of the coupled inductors disclosed herein. DC-to-DC converter 5600, which is an embodiment of system 10 of FIG. 1, includes M phases, where M is an integer greater than one. Although DC-to-DC converter 5600 is illustrated in FIG. 56 as having three phases, DC-to-DC converter 5600 could have two phases or four or more phases.

DC-to-DC converter 5600 converts direct current power at input 5612 having a first voltage to direct current power at output 5614 having a second voltage. Direct current input power source 5610 is connected to input 5612 to power DC-to-DC converter 5600, and DC-to-DC converter 5600 powers load 5616 connected to output 5614.

DC-to-DC converter 5600 includes M phase coupled inductor 5602. In FIG. 56, coupled inductor 5602 is shown as including an inductor for each of the M phases of DC-to-DC converter 5600. However, DC-to-DC converter 5600 could have a plurality of coupled inductors, where each coupled inductor supports fewer than all M of the phases. For example, if DC-to-DC converter 5600 had four phases, the DC-to-DC converter could include two coupled inductors, where each coupled inductor supports two phases.

Coupled inductor 5602 includes core 5604 and M windings 5606. Each winding 5606 has a first terminal 5618 (e.g., in the form of a first solder tab) and a second terminal 5620 (e.g., in the form of a second solder tab). Coupled inductor 5602 may be an embodiment of coupled inductor 2400 with windings 5606 being embodiments of windings 2600, 3400, 3800, or 4200. Alternately, coupled inductor 5602 may be an embodiment of coupled inductor 4400, 4700, or 5700.

DC-to-DC converter 5600 further includes M switching subsystems 5608, where each switching subsystem 5608 couples a first terminal of a respective winding of coupled inductor 5602 to input 5612. For example, switching subsystem 5608(2) couples first terminal 5618(2) of respective winding 5606(2) to input 5612. An output filter 5622 is coupled to the second terminal 5620 of each winding 5606. Output filter 5622, for example, includes a capacitor coupling output 5614 to ground. Switching subsystems 5608, which for example include a high side and a low side switch, selectively energize and de-energize respective windings 5606 to control the voltage on output node 5614.

As discussed above, use of windings having rectangular cross section promotes low winding AC resistance. However, use of windings having circular or square cross section promotes short magnetic flux path around the windings, and short flux path in turn promotes low magnetic core losses. Additionally, use of circular or square cross section windings also promotes small magnetic core volume. Accordingly, certain embodiments of the coupled inductors disclosed herein have windings with square, substantially square, or circular cross sections. "Substantially square" in the context of this document means that winding width is within 85% to 115% of winding thickness.

Figure 57:
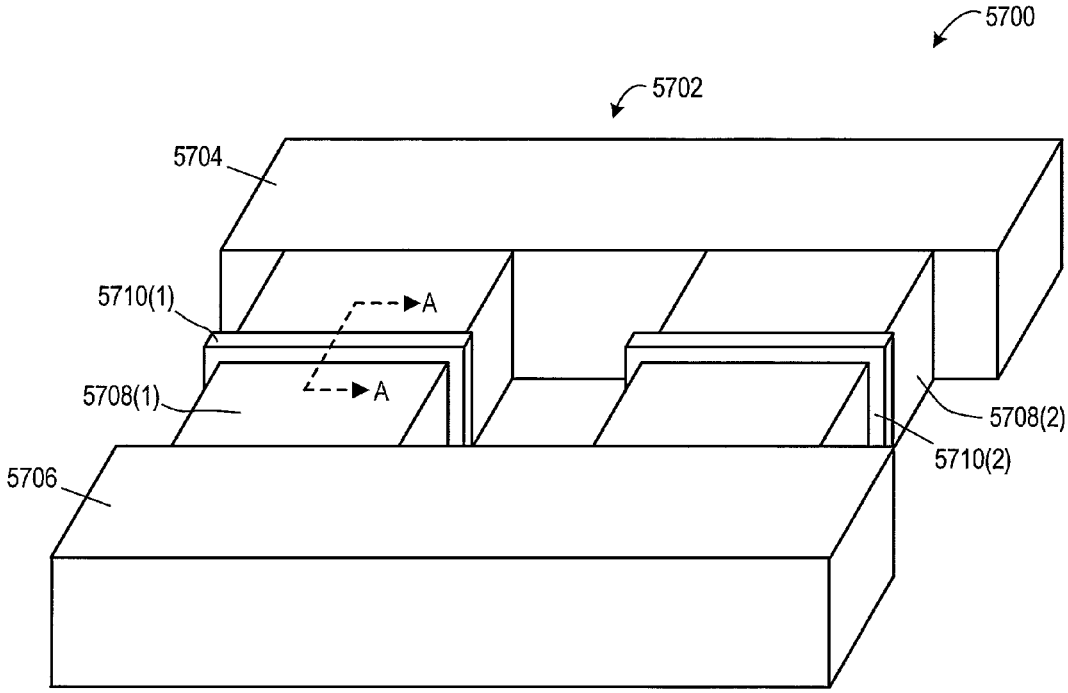
FIG. 57 is a perspective view of a coupled inductor including windings having square cross section, according to an embodiment.

For example, FIG. 57 shows a perspective view of a coupled inductor 5700, which is similar to coupled inductor 2400(2) (FIG. 29), but includes windings having square, as opposed to rectangular, cross section. Coupled inductor 5700 includes a magnetic core 5702 including end magnetic elements 5704, 5706 and N legs 5708 connecting end magnetic elements 5704, 5706. N is an integer greater than one, and in the FIG. 57 embodiment, N is two. Coupled inductor 5700 further includes N windings 5710, each wound around a respective one of the N legs 5708. Although windings 5710 have a square cross section in the FIG. 57 embodiment, windings 5710 have a circular cross section in alternate embodiments.

Figure 58:
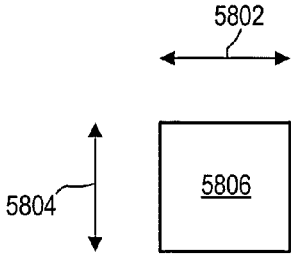
FIG. 58 shows a cross section of one of the windings of the FIG. 57 coupled inductor.

FIG. 58 shows a cross section of winding 5710(1) taken along line A-A of FIG. 57. Winding 5710(1) has a width 5802 and a thickness 5804. Width 5802 and thickness 5804 are the same since winding 5710(1) has a square cross section 5806. However, in alternate embodiments, windings 5710 have only a substantially square cross section 5806, such that width 5802 can range from 85% to 115% of thickness 5804.

Use of windings having square cross section may also simplify winding formation since winding width and thickness are the same, thereby promoting efficient use of winding material (e.g., copper). For example, rectangular cross section windings with large cross section aspect ratios are typically manufactured by stamping/cutting metallic foil on a bobbin, resulting in waste of some of the metallic foil. Square cross section windings, in contrast, can typically be cut to desired length on a bobbin without winding material waste. Furthermore, it is often significantly easier to bend square cross section windings along multiple axes and/or in different directions than rectangular cross section windings with large cross section aspect ratios.

While some inductor embodiments disclosed herein include two-phase coupling, such as those shown in FIGS. 2-5, it is not intended that inductor coupling should be limited to two-phases. For example, a coupled inductor with two windings would function as a two-phase coupled inductor with good coupling, but coupling additional inductors together may advantageously increase the number of phases as a matter of design choice. Integration of multiple inductors that results in increased phases may achieve current ripple reduction of a power unit coupled thereto; examples of such are shown in FIGS. 6-8, 10, and 17. Coupling two or more two-phase inductor structures together to create a scalable M-phase coupled inductor may achieve an increased number of phases of an inductor. The windings of such an M-phase coupled inductor may be wound through the passageways and about the core such as those shown in FIGS. 6-8, 10, and 17.

Since certain changes may be made in the above methods and systems without departing from the scope hereof, one intention is that all matter contained in the above description or shown in the accompanying drawings be interpreted as illustrative and not in a limiting sense. By way of example, those skilled in the art should appreciate that items as shown in the embodiments may be constructed, connected, arranged, and/or combined in other formats without departing from the scope of the invention. Another intention includes an understanding that the following claims are to cover generic and specific features of the invention described herein, and all statements of the scope of the invention which, as a matter of language, might be said to fall there between.

What is claimed is:

1. A coupled inductor, comprising:

a ladder magnetic core having length and width, the ladder magnetic core including first and second rails and N rungs, N being an integer greater than one, the first and second rails extending the lengthwise direction and the N rungs joining the first and second rails in the widthwise direction;

N windings; and a printed circuit board extending in a plane substantially parallel to the lengthwise and widthwise directions, each of the N windings including a respective conductive trace of a printed circuit board;

two of the N windings being wound at least partially around a respective one of the N rungs and one of the first and second rails; and N−2 of the N windings being wound at least partially around a respective one of the N rungs and both of the first and second rails.

2. The coupled inductor of claim 1, N being greater than two.

3. The coupled inductor of claim 2, each of the N windings being a single turn winding.

4. The coupled inductor of claim 2, each of the N windings having a zigzag shape as when looking cross-sectionally in a height direction, the height direction being orthogonal to the widthwise direction and to the lengthwise direction.

5. The coupled inductor of claim 2, each of the N windings having opposing first and second ends, and for each of the N windings the first end of the winding being offset from the second end of the winding in the lengthwise direction.

6. The coupled inductor of claim 2, each of the N windings non-overlapping with each of the other N windings, as when looking cross-sectionally in a height direction, the height direction being orthogonal to the widthwise direction and to the lengthwise direction.

7. The coupled inductor of claim 2, each of the N windings being a planar winding.

8. The coupled inductor of claim 2, the ladder magnetic core not forming a closed loop around any of the N windings.

* * * * *